US006859174B2

(12) United States Patent
Kane et al.

(10) Patent No.: US 6,859,174 B2
(45) Date of Patent: Feb. 22, 2005

(54) ANTENNA DEVICE AND COMMUNICATIONS SYSTEM

(75) Inventors: Joji Kane, Nara (JP); Hirotaka Ishihara, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 30 days.

(21) Appl. No.: 10/203,218

(22) PCT Filed: Dec. 6, 2001

(86) PCT No.: PCT/JP01/10665

§ 371 (c)(1),
(2), (4) Date: Jan. 13, 2003

(87) PCT Pub. No.: WO02/47202

PCT Pub. Date: Jun. 13, 2002

(65) Prior Publication Data

US 2003/0146874 A1 Aug. 7, 2003

(30) Foreign Application Priority Data

Dec. 8, 2000 (JP) ..... 2000-374858
May 16, 2001 (JP) ..... 2001-146977

(51) Int. Cl.[7] ..... H01Q 1/38
(52) U.S. Cl. ..... 343/700 MS; 343/833; 343/846
(58) Field of Search ..... 343/700 MS, 833, 343/834, 846, 895, 700 M

(56) References Cited

U.S. PATENT DOCUMENTS

| | | | | |
|---|---|---|---|---|
| 5,585,807 | A | * 12/1996 | Takei | 343/702 |
| 5,966,097 | A | * 10/1999 | Fukasawa et al. | 343/700 MS |
| 6,476,769 | B1 | * 11/2002 | Lehtola | 343/702 |
| 6,535,172 | B2 | * 3/2003 | Hirabayashi | 343/725 |
| 6,608,594 | B1 | * 8/2003 | Kane et al. | 343/700 MS |
| 6,639,555 | B1 | * 10/2003 | Kane et al. | 343/700 MS |
| 2002/0044090 | A1 | * 4/2002 | Bahr et al. | 343/700 MS |

FOREIGN PATENT DOCUMENTS

| | | |
|---|---|---|
| EP | 0 987 789 A | 3/2000 |
| EP | 1011167 | 6/2000 |
| JP | 06-69715 | 3/1994 |
| JP | 08-298405 | 11/1996 |
| JP | 11-150412 | 6/1999 |
| JP | 11-214914 | 8/1999 |
| JP | 2997451 | 10/1999 |
| JP | 11-330842 | 11/1999 |
| JP | 3032664 | 2/2000 |
| JP | 2000-156607 | 6/2000 |
| WO | WO 03/044892 A | 5/2003 |

OTHER PUBLICATIONS

Japanese International Search Report for PCT/JP01/10665 dated Apr. 2, 2002.
English translation of Japanese International Search Report for PCT/JP01/10665 dated Apr. 2, 2002.
European Search Report for Application No. EP 01 99 9986, Feb. 9, 2004.
M.A. Sultan, "The Mode Features of An Ideal–Gap Open-Ring Microstrip Antenna", IEEE Transactions on Antennas and Propagation, IEEE Inc., vol. 37, NR. 2, pp. 137–142.

* cited by examiner

*Primary Examiner*—Tan Ho
(74) *Attorney, Agent, or Firm*—RatnerPrestia

(57) ABSTRACT

Conventional antennas devices provide in sufficient performance in terms of directivity, efficiency, or the like. An antenna device includes a radiating element 11 which is provided with a feed terminal 16 to draw power and has a spiral shape; a passive element 12 which is installed side by side with the radiating element 11 and has a spiral shape; an earth ground 15 disposed in opposing relation to the radiating element 11 and the passive element 12; a first connecting electrode 13 for connecting one end of the radiating element 11 to the earth ground 15; and a second connecting electrode 14 for connecting one end of the passive element 12 to the earth ground 15, and the first and second connecting electrodes 13 and 14 are displaced with respect to each other in a plane which includes the spiral shape.

26 Claims, 46 Drawing Sheets

Simulation model and current distribution analysis of 90-degree displaced double spiral Simulation analysis of directive gains in horizontal plane with respect to vertical polarization

Fig. 35

Comparison of simulation analysis characteristics with respect to vertical polarization

| Type | 5/8-λ monopole | Single-spiral | 0-degree displaced double-spiral | 90-degree displaced double-spiral |
|---|---|---|---|---|
| Average gain (elevation angle = 0) | +1.9 dBi | −3.0 dBi | +0.5 dBi | +3.7 dBi |
| Antenna efficiency | 40% | 15% | 60% | 85% |

Capability of 90-degree displaced double spiral to increase gains in horizontal plane with respect to vertical polarization Azimuth pattern gain display (dBi)

Simulation model and current distribution analysis of 90-degree displaced double spiral with respect to right hand circular polarization for GPS Simulation analysis of gain-direction characteristics of 90-degree displaced double spiral in vertical plane with respect to right hand circular polarization for GPS Elevation pattern gain display (dBi)

Simulation analysis of gain-direction characteristics of 90-degree displaced double spiral in horizontal plane with respect to right hand circular polarization (elevation angle = 10) for GPS Azimuth pattern gain display (dBi)

Fig. 40
Comparison of 90-degree displaced double-spiral GPS antenna and conventional patch antenna
| Type | Conventional patch antenna | | 90-degree displaced double-spiral GPS antenna (example) |
|---|---|---|---|
| Size (mm) | 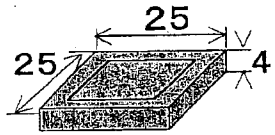  | 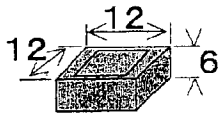  | 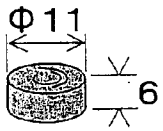  |
| Dielectric (permittivity) (dissipation loss) | Ceramic 37 0. 0001 | Ceramic 90 0. 0001 | Resin 10 0. 004 |
| Volume ($mm^3$) | 2500 | 864 | 570 |
| Area ($mm^2$) | 625 | 144 | 95 |
| Weight (mg) | 9,288 | 4,998 | 1,683 |

Size reduction and gain characteristics of double spirals

| | ① Basic model | ② With thin electric-field generating part | ③ Thin type without spacer |
|---|---|---|---|
| |   | | |
| Size & volume | 684 mm³ | 452 mm³ | 362 mm³ |
| Average gain In H plane | +0.2 | -2.4 | -3.2 |
| Average gain In V plane | -3.9 | -6.1 | -6.4 |

(Unit of right hand circular polarization gain: dBi)

Fig. 44

Winding direction and gain characteristics of double spirals

| Winding direction of double spiral | Counterclockwise winding | Clockwise winding | | Clockwise/counterclockwise winding | |
|---|---|---|---|---|---|
| | +90-degree displacement | -90-degree displacement | +90-degree displacement | +90-degree displacement | 0-degree displacement |
| | (A) 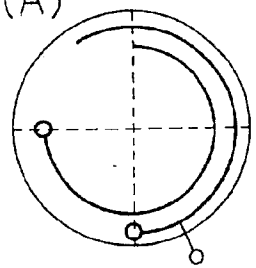 PPO t3.2mm | (B) 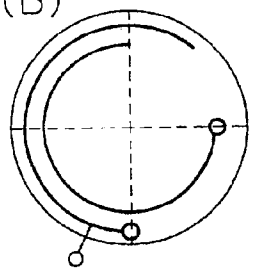 PPO t3.2mm | (C) 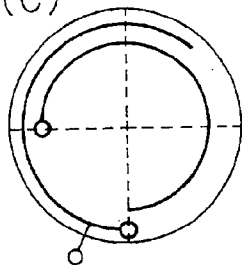 PPO t3.2mm | (D) 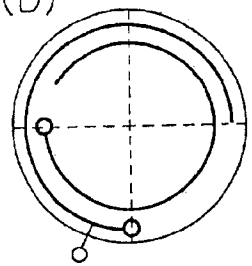 PPO t3.2mm | (E) 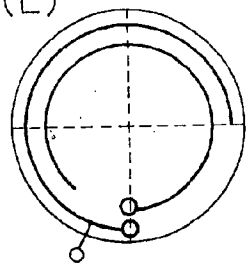 PPO t3.2mm |
| Average gain In H plane | −3. 2 | −3. 0 | −3. 1 | −3. 2 | −2. 9 |
| Average gain In V plane | −6. 4 | −5. 2 | −5. 3 | −5. 5 | −5. 0 |

(Unit of right hand circular polarization gain: dBi)

Gain characteristics of double spiral - example of (D) on previous page (To improve gain in direction as close to zenith direction as possible, i.e., gain in horizontal polarization component)

Combining magnetic-current-mode element and electric-current-mode element

Generation of vertical polarization mode and horizontal polarization mode by a single feed Combining magnetic-current-mode element and electric-current-mode element Generation of circular polarization mode by two feeds Size and performance on this page and later are examples for GPS (1575.42 MHz)

Generation of circular polarization through a combination of magnetic-current-mode element and electric-current-mode element Generation of spherical circular polarization mode by a single feed Generation of circular polarization through combination of magnetic-current-mode element and electric-current-mode element Generation of spherical circular polarization mode by two feeds Simulation analysis of principles model
Model structure (example of generating spherical circular polarization mode by single feed)

Fig. 51
Gain characteristics obtained by simulation analysis of principles model
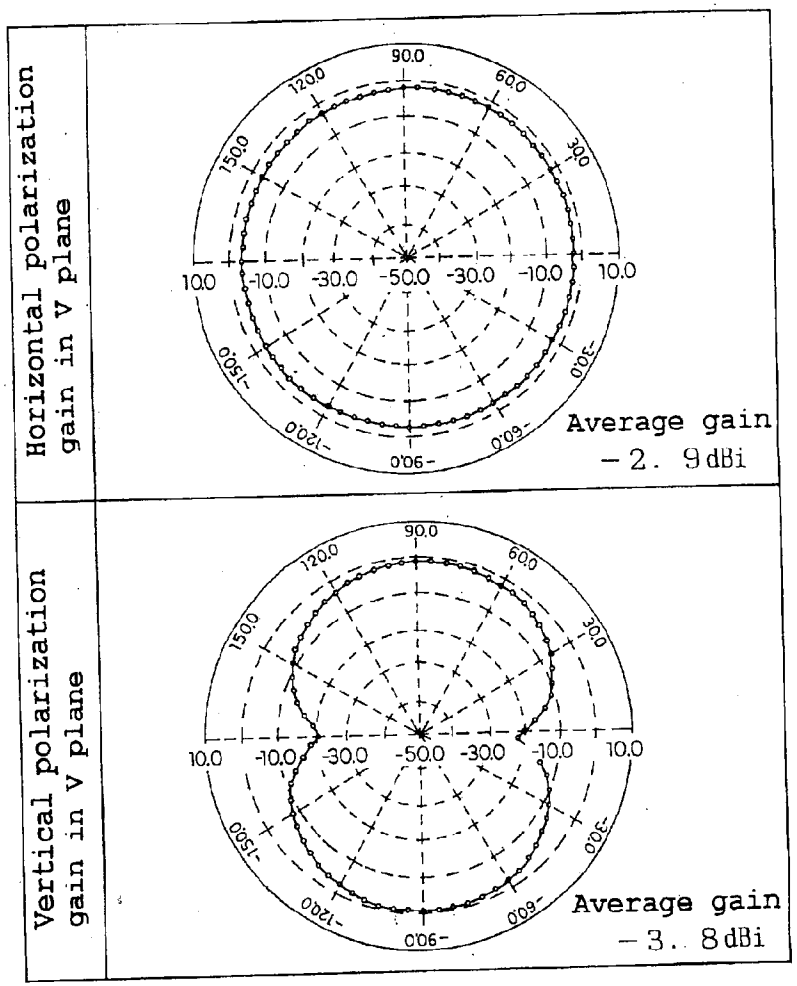
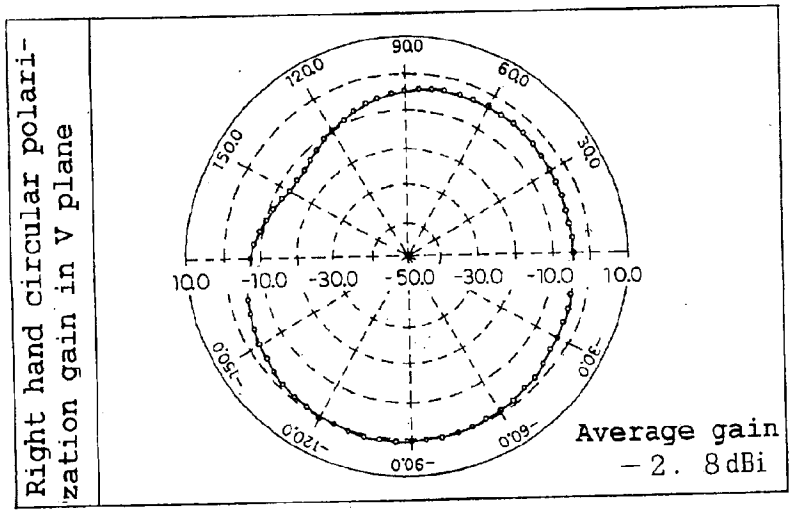

structure of principles functional model

Gain characteristics of principles functional model

Simulation analysis of quad-spiral model
Model structure (example of generating spherical circular polarization mode by a single feed)

Gain characteristics obtained by simulation analysis of quad-spiral model

Fig. 56
Structure of quad-spiral functional model
Perspective view
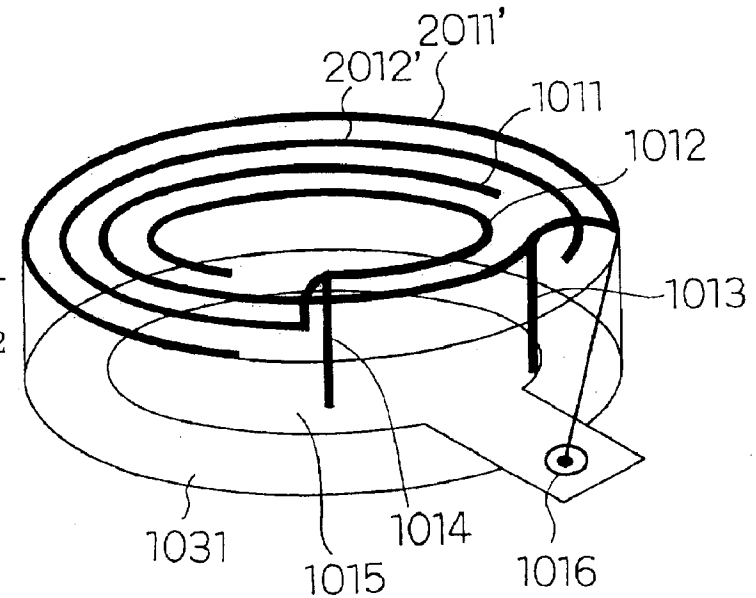
Top view
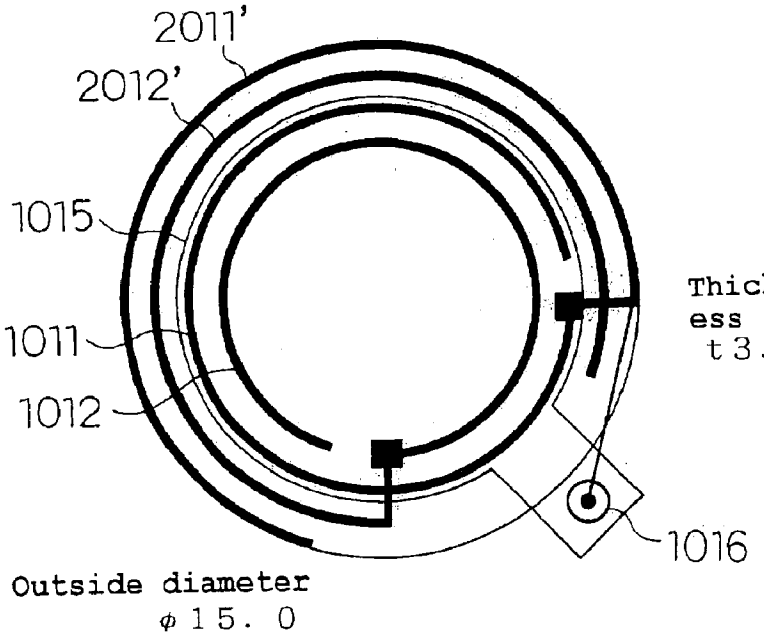

Fig. 57 Comparison of gains between quad-spiral and double-spiral (functional model)

Fig. 58 Comparison of gains between quad-spiral and conventional patch antenna

Fig. 59

Effect of quad spiral

| Type | | Conventional patch antenna | Double-spiral | Quad-spiral |
|---|---|---|---|---|
| Shape & size | | □12mm<br>t4.0mm<br>Ceramic εr=90<br>tan δ=0.0001 | φ12mm<br>t3.2mm<br>PPO εr=10.2<br>tan δ=0.004 | φ15mm<br>t3.2 mm<br>PPO εr=10.2<br>tan δ=0.004 |
| Volume ($mm^3$) | | 576 | 362 | 565 |
| Weight (mg) | | 3,355 | 970 | 1,516 |
| Gain in zenith direction (dBi) | | -2.0 | -20.0 | -10.0 |
| Average gain (dBi) | In H plane | -6.4 | -3.2 | -0.9 |
| | In V plane | -3.9 | -5.5 | -2.5 |

Fig. 60

Size reduction effect of the quad-spiral (when air is used as dielectric) - illustrated Conventional patch antenna Conventional product (εr = 90) → calculated value for air-based model

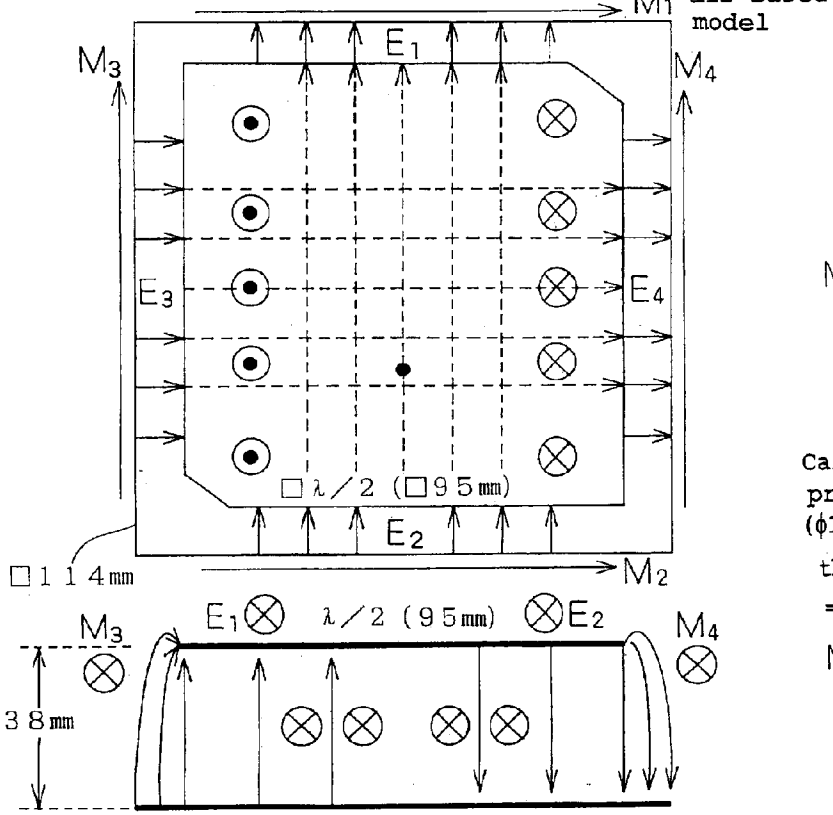

Quad-spiral antenna

PPO-based model (εr = 10.2) → calculated value for air-based model (Outer shape only)

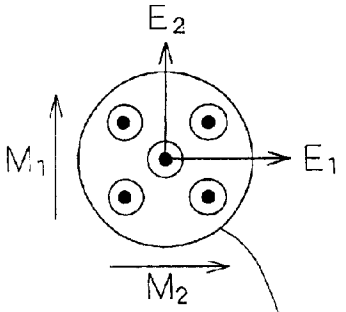

Calculated value for newly developed product: φ34.5 (φ15 mm × 2.3 = φ34.5 mm, assuming that $\sqrt{\varepsilon}$ eff times = $\sqrt{5.29}$ times = 2.3 times)

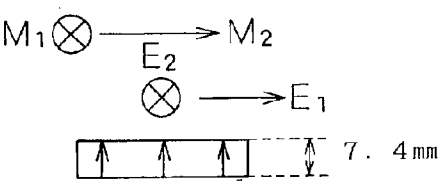

Structure of quad-spiral functional model

Another example of layout relationship between magnetic-current-mode element and electric-current-mode element Top view Perspective view Structure of quad-spiral functional model Another example of layout relationship between magnetic-current-mode element and electric-current-mode element Top view Perspective view Structure of quad-spiral functional model Another example of layout relationship between magnetic-current-mode element and electric-current-mode element Top view Perspective view

ANTENNA DEVICE AND COMMUNICATIONS SYSTEM

This Application is a U.S. National Phase Application of PCT International Application PCT/JP01/10665.

TECHNICAL FIELD

The present invention relates to an antenna device and communications system used, for example, for mobile communication.

BACKGROUND ART

Conventional antenna devices include a ⅝-λ monopole antenna device (λ represents a radio wavelength), a single-spiral antenna device, and patch antenna device.

Incidentally, not all of the above antennas are publicly known. The term "spiral" here means not only helical shapes, but also arc shapes.

However, the conventional antenna devices described above do not provide any sufficient performance in terms of directivity, efficiency, or the like.

DISCLOSURE OF THE INVENTION

In view of this conventional problem, an object of the present invention is to provide an antenna device and communications system with improved directivity, efficiency, etc.

One aspect of the present invention is an antenna device comprising:

a first element which is provided with a feeding point for drawing power and has a bent or curved shape;

a second element which is installed side by side with said first element and has a bent or curved shape;

an earth ground disposed in opposing relation to said first element and said second element;

a first connecting electrode for connecting one end of said first element to said earth ground; and a second connecting electrode for connecting one end of said second element to said earth ground, and wherein said first and second connecting electrodes are displaced with respect to each other in the plane which includes said bent or curved shapes.

Another aspect of the present invention is the antenna device according to the 1st invention, wherein the fact that "being displaced with respect to each other in the plane which includes said bent or curved shapes" means that said first and second connecting electrodes are displaced with respect to each other by virtually 90 degrees when viewed from the virtual center of said bent or curved shapes.

Still another aspect of the present invention is the antenna device, wherein a dielectric is inserted between said first element and said earth ground.

Yet still another aspect of the present invention is the antenna device, wherein said first element is provided with a neutral electrode for drawing power.

Still yet another aspect of the present invention is the antenna device, wherein said power is supplied from above or below said earth ground.

A further aspect of the present invention. The antenna device, wherein said first element is located on the outer or inner side of said second element when viewed from the virtual center of said bent or curved shapes.

A still further aspect of the present invention is an antenna device comprising:

a first element which is provided with a feeding point for drawing power and has a bent or curved shape;

a second element which is installed side by side with said first element and has a bent or curved shape;

a suspended electrode disposed in opposing relation to said first element and said second element;

an earth ground disposed in opposing relation to said suspended electrode, being located across said suspended electrode from said first element and said second element;

a first connecting electrode for connecting one end of said first element to said suspended electrode; and a second connecting electrode for connecting one end of said second element to said suspended electrode, and wherein said first and second connecting electrodes are displaced with respect to each other in the plane which includes said bent or curved shapes.

A yet further aspect of the present invention is the antenna device, wherein the fact that "being displaced with respect to each other in the plane which includes said bent or curved shapes" means that said first and second connecting electrodes are displaced with respect to each other by virtually 90 degrees when viewed from the virtual center of said bent or curved shapes.

A still yet further aspect of the present invention is the antenna device, wherein a dielectric is inserted between said first element and said suspended electrode.

An additional aspect of the present invention is the antenna device, wherein said first element is provided with a neutral electrode for drawing power.

A still additional aspect of the present invention is the antenna device, wherein said power is supplied from above or below said earth ground.

A yet additional aspect of the present invention is the antenna device, wherein said first element is located on the outer or inner side of said second element when viewed from the virtual center of said bent or curved shapes.

A still yet additional aspect of the present invention is the antenna device, wherein a dielectric is inserted between said suspended electrode and said earth ground.

A supplementary aspect of the present invention is the antenna device, wherein said first and second elements differ from each other in the curving or bending direction.

A still supplementary aspect of the present invention is an antenna device comprising:

a first element which is provided with a feeding point for drawing power and has a bent or curved shape;

a second element which is installed side by side with said first element and has a bent or curved shape;

an earth ground disposed in opposing relation to said first element and said second element;

a first connecting electrode for connecting one end of said first element to said earth ground; and a second connecting electrode for connecting one end of said second element to said earth ground, and wherein said first and second connecting electrodes adjoin each other in the plane which includes said bent or curved shapes.

A yet supplementary aspect of the present invention is an antenna device comprising a magnetic-current-mode element and a electric-current-mode element which share a feeding point.

a still yet supplementary aspect of the present invention is the antenna device, wherein the plane where current flows in said magnetic-current-mode element and the plane where current flows in said electric-current-mode element are virtually identical or parallel.

Another aspect of the present invention is the antenna device, wherein:

Still another aspect of the present invention is the antenna device, wherein said electric-current-mode element further comprises a fourth element connected to said second element.

said magnetic-current-mode element comprises a first element which has a bent or curved shape, a second element which is installed side by side with said first element and has a bent or curved shape, an earth ground disposed in opposing relation to said first element and said second element, a first connecting electrode for connecting one end of said first element to said earth ground, and a second connecting electrode for connecting one end of said second element to said earth ground;

said electric-current-mode element comprises a third element connected to said first element; and power is supplied to said first element or said third element.

A 19th invention of the present invention (corresponding to claim 19) is the antenna device according to the 18th invention, wherein said electric-current-mode element further comprises a fourth element connected to said second element.

Yet still another aspect of the present invention is the antenna device, wherein said third element and said fourth element are virtually orthogonal to each other.

Still yet another aspect of the present invention is the antenna device, wherein:

power is also supplied to said second element or said fourth element; and the power supply to said first element or said third element and the power supply to said second element or said fourth element are virtually 90 degrees apart in phase.

A further aspect of the present is the antenna device, wherein said third element and/or said fourth element are not disposed in opposing relation to said earth ground and are located on the outer side of said first element and said second element.

A still further aspect of the present invention is the antenna device, wherein said third element and/or said fourth element have a straight linear shape.

A yet further aspect of the present invention is the antenna device, wherein said third element and/or said fourth element have a bent or curved shape.

A still yet further of the present invention is the antenna device, wherein said first to fourth elements are bent or curved in the same direction or in different directions.

An additional aspect of the present invention is a communications system comprising:

an antenna device;

a transmission processing circuit which processes signals sent from said antenna device; and a reception processing circuit which processes signals received by said antenna device.

A still additional aspect of the present invention is the communications system, wherein:

said communications system comprises a communications earth ground for use in communications; and said earth ground and said communications earth ground are connected in close vicinity to each other.

A yet additional aspect of the present invention is the communications system, wherein said antenna device and the main unit of said communications system are installed on opposite sides of the ground plane to which said earth ground and said communications earth ground are connected in close vicinity to each other.

BRIEF DESCRIPTION OF THE DRAWINGS

FIG. 35 is an explanatory diagram comparing simulation analysis characteristics with respect to vertical polarization;

FIG. 40 is an explanatory diagram comparing a 90-degree displaced double-spiral GPS antenna and conventional patch antenna;

FIG. 44 is an explanatory diagram illustrating relationships between the winding directions and gain characteristics of the double spiral for right hand circular polarization in the antenna device of the present invention;

FIG. 51 is an explanatory diagram illustrating gain characteristics of the antenna device (principles model) according to the third embodiment of the present invention;

FIG. 56 is an explanatory diagram illustrating configuration of the antenna device according to the fourth embodiment of the present invention;

FIG. 59 is an explanatory diagram comparing the quad-spiral antenna device of the present invention, double-spiral antenna device of the present invention, and conventional patch antenna device;

FIG. 60 is an explanatory diagram illustrating size reduction effect of the quad-spiral antenna device of the present invention;

DESCRIPTION OF SYMBOLS

Figure 1:
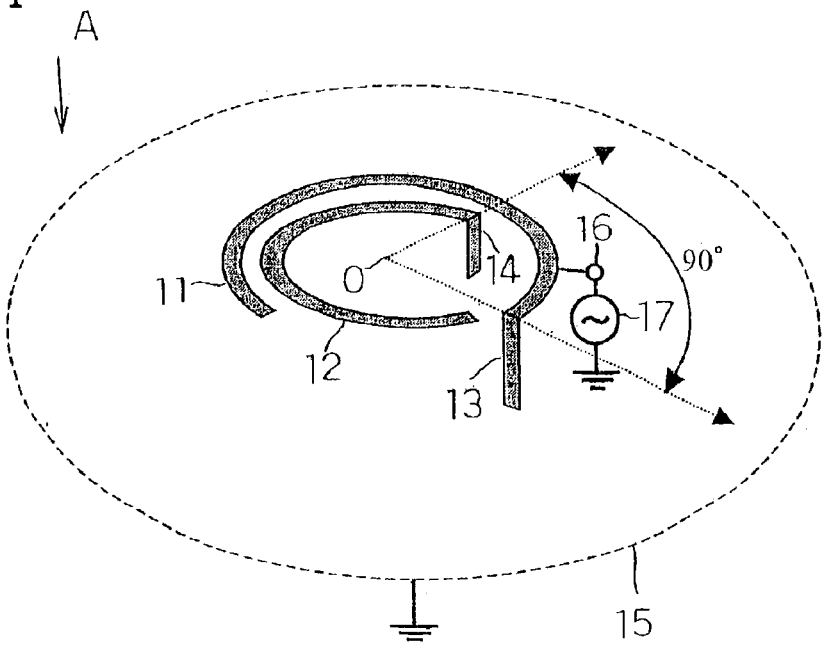
FIG. 1 is a perspective view of a 90-degree displaced double-spiral antenna device for left hand circular polarization according to a first embodiment of the present invention.

11 Radiating element
12 Passive element
13, 172 First connecting electrode
14, 173 Second connecting electrode
15 Earth ground
16 Feed terminal
17 Power source
171 Suspended electrode
31, 191 Dielectric
91 Neutral electrode

BEST MODE FOR CARRYING OUT THE INVENTION

Hereunder, embodiments of the present invention will be described with reference to the drawings.

(First Embodiment)

Figure 2:
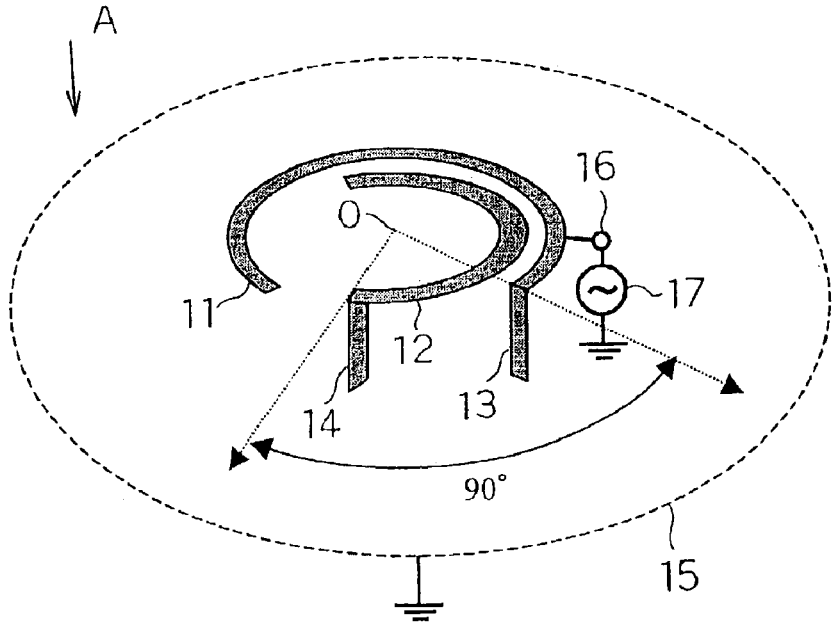
FIG. 2 is a perspective view of a 90-degree displaced double-spiral antenna device for right hand circular polarization according to the first embodiment of the present invention.

First, a configuration of an antenna device according to a first embodiment of the present invention will be described with reference to FIGS. 1 and 2, which are a perspective view of a 90-degree displaced double-spiral antenna device for left hand circular polarization according to the first embodiment of the present invention and a perspective view of a 90-degree displaced double-spiral antenna device for right hand circular polarization according to the first embodiment of the present invention, respectively.

The terms "bent shape" or "curved shape" herein means a spiral shape, helical shape, arc shape such as an arc of a perfect circle or arc of an ellipse, angular arc such as an L-shape which has one or more bends, or the like. However, in the following discussion, spiral shape will be used as an example.

Also, in the following discussion, no particular distinction will be made between left hand circular polarization and right hand circular polarization. However, as shown in FIGS. 1 and 2, when viewed in the direction of arrow A, the angle from a first connecting electrode (also called a short-circuiting electrode, inductance) 13 to a second connecting electrode 14 is measured counterclockwise with respect to left hand circular polarization, and clockwise with respect to right hand circular polarization. Such a difference in angle direction is irrelevant to transmission and reception of vertical polarization.

A radiating element 11 is arc-shaped and has a feed terminal (feeding point) 16 to connect to a power source 17 located above an earth ground 15. Incidentally, the feed terminal 16 is connected directly to the radiating element 11, but alternatively they may be connected across a small gap.

The radiating element 11 is connected to the earth ground 15 at one end via the first connecting electrode 13 to stabilize its potential. Arc length of the radiating element 11 is limited to an electrical wavelength approximately ¼ the radio wavelength, but it may be about an integral multiple of a ¼ radio wavelength.

A passive element 12 is of virtually identical shape with the radiating element 11 and installed side by side with the radiating element 11. Also, the radiating element 11 is connected to the earth ground 15 at one end via the second connecting electrode 14 to stabilize its potential.

The first connecting electrode 13 and second connecting electrode 14 are displaced with respect to each other in the plane which includes the arc shape described above. More specifically, the first connecting electrode 13 and second connecting electrode 14 are displaced with respect to each other by virtually 90 degrees when viewed from the virtual center O of the spiral shape. This is a major characteristic of the antenna device of the present invention and brings about desirable effects as described later.

A combination of an arc-shaped radiating element 11 and passive element 12 arranged in this way with respect to each other is traditionally referred to as a 90-degree displaced double-spiral.

The earth ground 15 is grounded and is disposed in opposing relation to the radiating element 11 and passive element 12.

Incidentally, the radiating element 11, passive element 12, earth ground 15, first connecting electrode 13, and second connecting electrode 14, correspond to the first element, second element, earth ground, first connecting electrode, and second connecting electrode of the present invention, respectively.

Next, operation of the antenna device according to this embodiment will be described.

The antenna device of this embodiment transmits and receives radio waves by generating electric fields between the radiating element 11 and earth ground 15 as well as between the passive element 12 and earth ground 15.

More specifically, for example, a transmission output terminal (not shown) of a communications device (not shown) produces signal output to the radiating element 11 via the feed terminal 16.

This signal output generates electric fields between the radiating element 11 and earth ground 15 as well as between the passive element 12 and earth ground 15. Then, the combined sum of the two electric fields is sent out as a radio wave.

The receive operation of the antenna device according to this embodiment is understood to be approximately opposite to the transmit operation described above, and thus detailed description thereof will be omitted.

The basic description of operation above commonly applies to any type of polarization used for transmission and reception.

Next, detailed description will be given with reference to FIGS. 33 to 36 about how the antenna device of this embodiment can transmit and receive both vertical polarization and circular polarization with high efficiency.

First, detailed description will be given with reference to FIGS. 33 to 36 about how the antenna device of this embodiment can transmit and receive vertical polarization with high efficiency.

Figure 36:
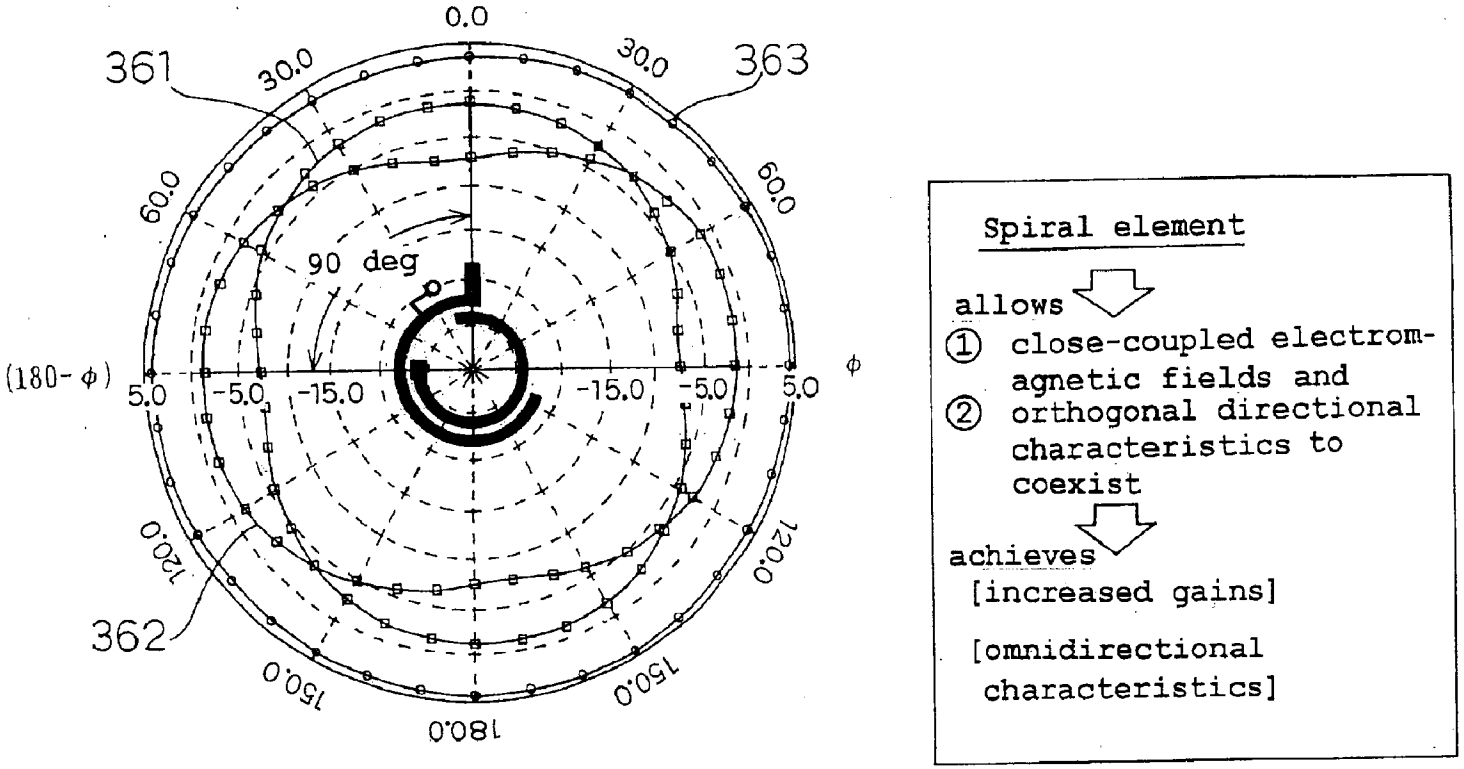
FIG. 36 is an explanatory diagram illustrating a capability of the 90-degree displaced double spiral to increase gains in the horizontal plane with respect to vertical polarization.

To begin with, the principles of how the antenna device of this embodiment can transmit and receive vertical polarization with high efficiency will be described with reference to FIGS. 33 and 36. Incidentally, FIG. 33 is an explanatory diagram illustrating a simulation model and current distribution analysis of a 90-degree displaced double spiral while FIG. 36 is an explanatory diagram illustrating a capability of the 90-degree displaced double spiral to increase gains in the horizontal plane with respect to vertical polarization.

Since the first connecting electrode 13 and second connecting electrode 14 (see FIG. 1) are displaced with respect to each other by virtually 90 degrees when viewed from the virtual center O (see FIG. 1) as described above, the antenna device of this embodiment has isotropically increased gains.

Figure 33:
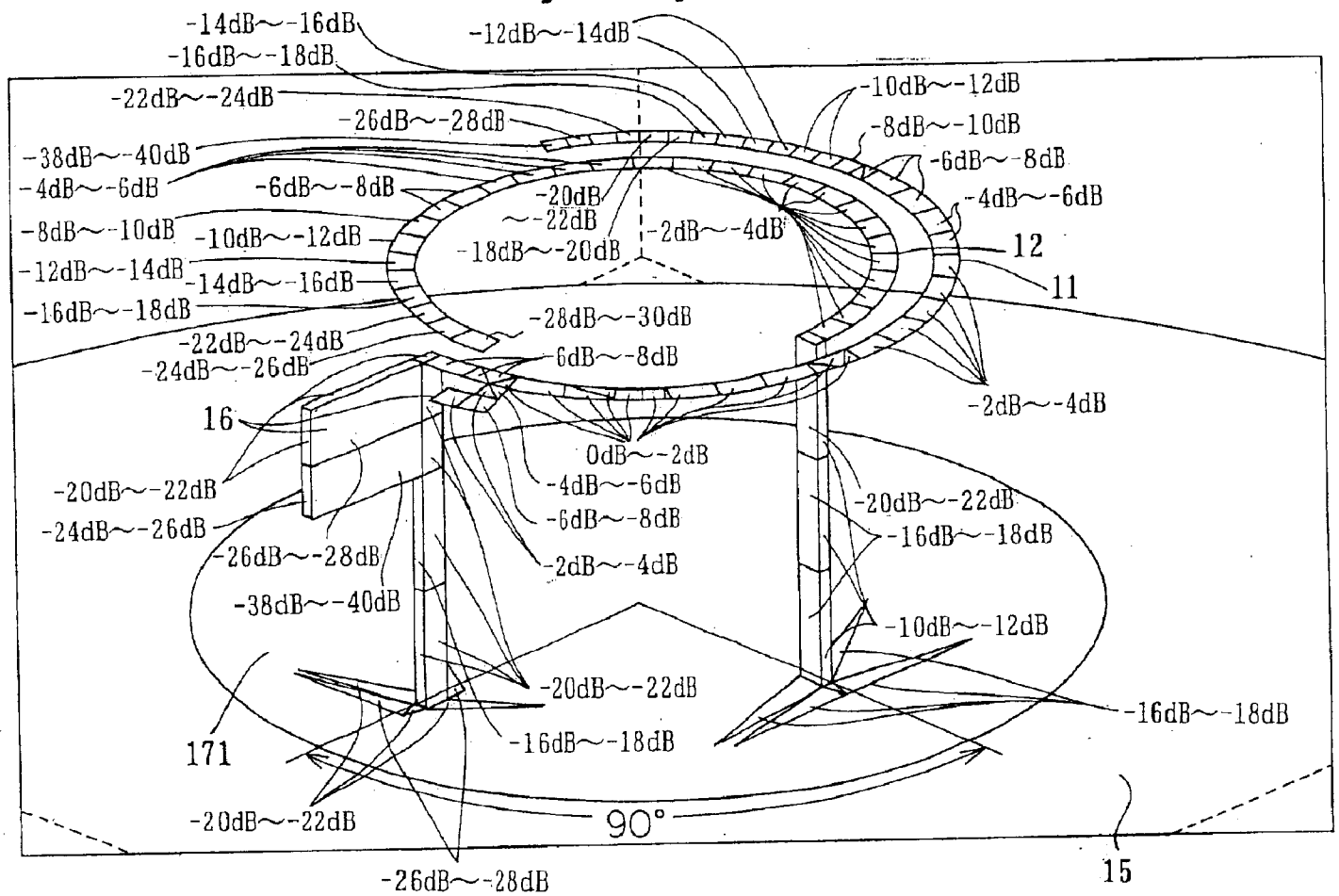
FIG. 33 is an explanatory diagram illustrating a simulation model and current distribution analysis of a 90-degree displaced double spiral.

More specifically, as shown in FIG. 33, those parts of the outer element (radiating element 11) and inner element (passive element 12) where currents are distributed in the range of −10 to −40 dB (0 dB=30 A/m) are displaced with respect to each other by virtually 90 degrees when viewed from the center of the 90-degree displaced double-spiral. Besides, as shown in FIG. 36, double-spiral elements of this embodiment have combined directional characteristics 363 resulting from a combination of directional characteristics 361 of the outer element (radiating element 11) and directional characteristics 362 of the inner element (passive element 12). This allows close-coupled electromagnetic fields and orthogonal directional characteristics to coexist and makes possible both increased gains and omnidirectional characteristics.

Figure 34:
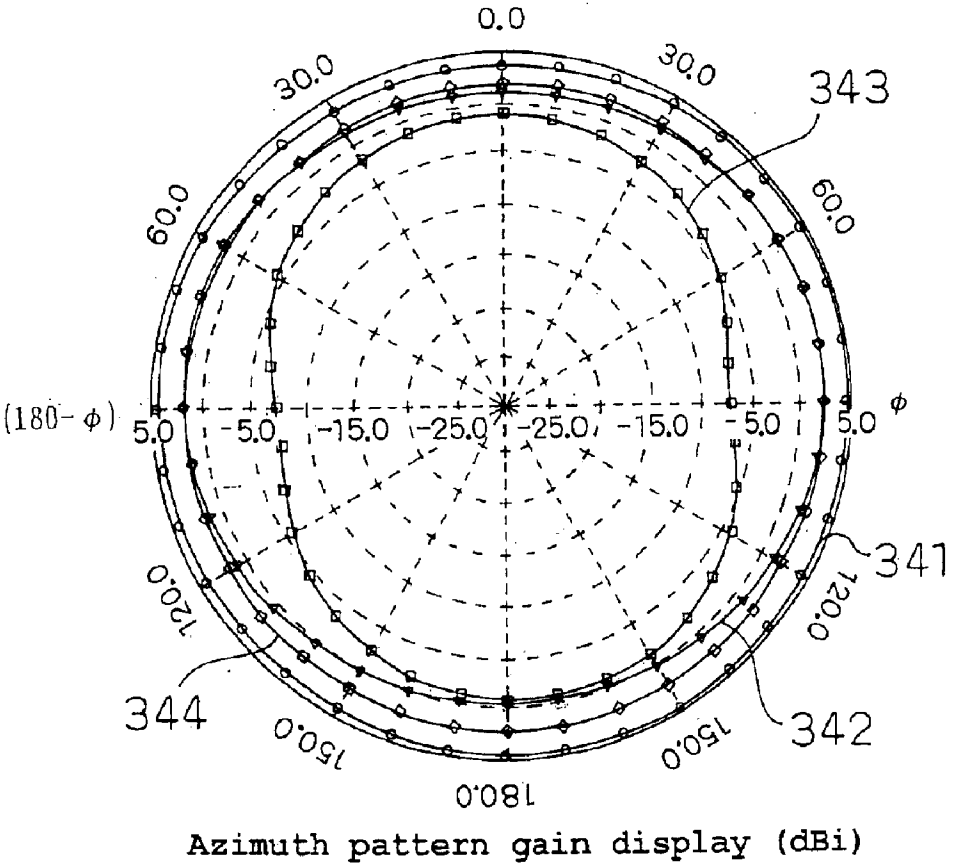
FIG. 34 is an explanatory diagram illustrating a simulation analysis of directive gains in the horizontal plane with respect to vertical polarization.

Directive gains of the 90-degree displaced double-spiral antenna which is the antenna device of this embodiment and a zero-degree displaced double-spiral antenna device (1), single-spiral antenna device (2), and ⅝-λ monopole antenna device (3) which are conventional antenna devices, in the horizontal plane with respect to vertical polarization, are shown in FIG. 34, which incidentally is an explanatory diagram illustrating a simulation analysis of directive gains in the horizontal plane with respect to vertical polarization.

As shown in FIG. 34, directional characteristics 341 of the 90-degree displaced double spiral of the antenna device according to this embodiment ensure more pronounced omnidirectional characteristics and higher gains than directional characteristics 342 of the zero-degree displaced double spiral, directional characteristics 343 of the single spiral, and directional characteristics 344 of the ⅝-λ monopole. In particular, the antenna device of this embodiment has higher gains than the ⅝-λ monopole antenna device which has the highest gains among conventional antenna devices and it has a fractional bandwidth of 4% or more. Theoretically, ¾-λ monopole antenna devices have the highest gain in the horizontal plane, but a ⅝-λ monopole antenna device manufactured by Nippon Antenna Co., Ltd. is a major high gain antenna device.

Average gains (elevation angle=0 degrees) and antenna efficiencies of the 90-degree displaced double-spiral antenna which is the antenna device of this embodiment and a zero-degree displaced double-spiral antenna device (1), single-spiral antenna device (2), and ⅝-λ monopole antenna device (3) which are conventional antenna device, with respect to vertical polarization, are shown in FIG. 35, which incidentally is an explanatory diagram comparing simulation analysis characteristics with respect to vertical polarization.

As shown in FIG. 35, the antenna device of this embodiment has a higher average gain (elevation angle =0 degrees) and higher antenna efficiency than any of the conventional antenna devices.

In this way, the antenna device of this embodiment has isotropically increased gains with respect to vertical polarization, and thus is suitable for mobile communication and the like which use ground waves. This is because in mobile communication, an antenna usually changes its position relative to a radio base station with time and it is very important to achieve high gains isotropically.

Next, description will be given with reference to FIGS. 37 to 39 about how the antenna device of this embodiment can transmit and receive circular polarization with high efficiency.

To begin with, the principles of how the antenna device of this embodiment can transmit and receive circular polarization with high efficiency will be described with reference to FIG. 37. Incidentally, FIG. 37 is an explanatory diagram illustrating a simulation model and current distribution analysis of the 90-degree displaced double spiral with respect to right hand circular polarization for GPS.

Figure 37:
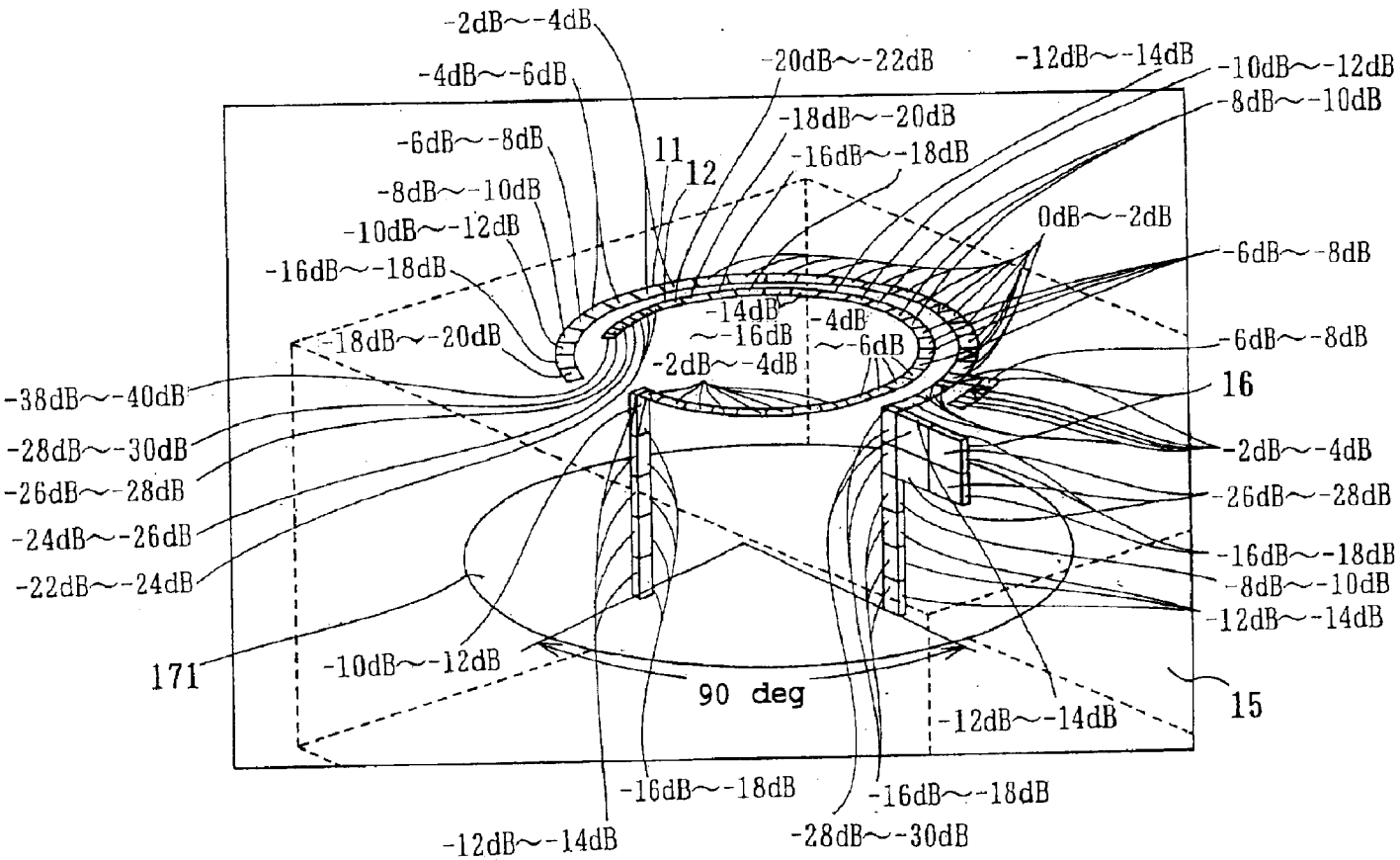
FIG. 37 is an explanatory diagram illustrating a simulation model and current distribution analysis of a 90-degree displaced double spiral with respect to right hand circular polarization for GPS.

As shown in FIG. 37, those parts of the outer element (radiating element 11) and inner element (passive element 12) where currents are distributed in the range of −10 to −40 dB (0 dB=50 A/m) are displaced with respect to each other by virtually 90-degrees when viewed from the center of the 90-degree displaced double-spiral. This allows close-coupled electromagnetic fields and orthogonal directional characteristics to coexist and makes possible both increased gains and omnidirectional characteristics, as is the case with the vertical polarization described above.

Figure 38:
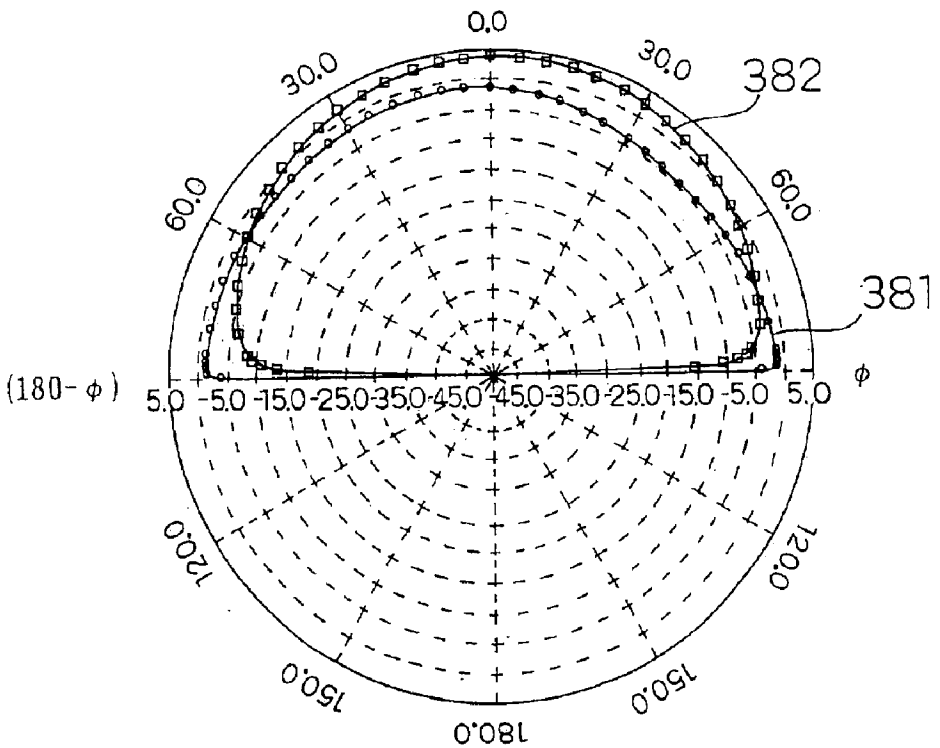
FIG. 38 is an explanatory diagram illustrating a simulation analysis of gain-direction characteristics in the vertical plane with respect to right hand circular polarization for GPS.

Gain-direction characteristics of the 90-degree displaced double-spiral antenna which is the antenna device of this embodiment and a patch antenna device which is a conventional transmitting and receiving antenna device for circular polarization, in the vertical plane with respect to circular polarization, are shown in FIG. 38, which incidentally is an explanatory diagram illustrating a simulation analysis of gain-direction characteristics in the vertical plane with respect to right hand circular polarization for GPS.

As shown in FIG. 38, directional characteristics 381 of the 90-degree displaced double spiral of the antenna device according to this embodiment ensure more pronounced omnidirectional characteristics and higher gains than directional characteristics 382 of the conventional patch antenna. In particular, the antenna device of this embodiment has high gains even at low elevation angles (in low-angled directions as measured from the horizontal plane) at which gain reduction cannot be avoided with conventional patch antennas.

Figure 39:
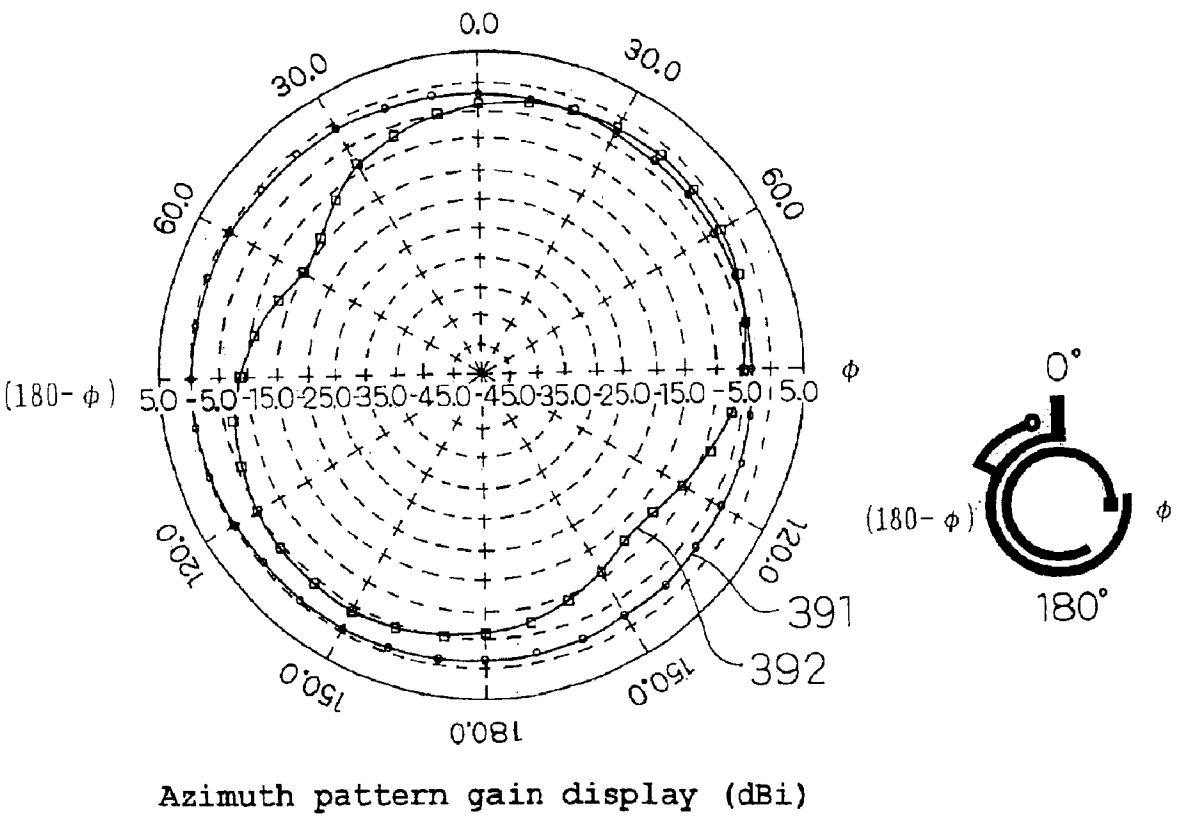
FIG. 39 is an explanatory diagram illustrating a simulation analysis of gain-direction characteristics in the horizontal plane with respect to right hand circular polarization (elevation angle=10 degrees) for GPS.

Gain-direction characteristics of the 90-degree displaced double-spiral antenna which is the antenna device of this embodiment and the patch antenna device which is a conventional transmitting and receiving antenna device for circular polarization, in the horizontal plane with respect to circular polarization, are shown in FIG. 39, which incidentally is an explanatory diagram illustrating a simulation analysis of gain-direction characteristics in the horizontal plane with respect to right hand circular polarization (elevation angle=10 degrees) for GPS.

As shown in FIG. 39, directional characteristics 391 of the 90-degree displaced double spiral of the antenna device according to this embodiment ensure more pronounced omnidirectional characteristics and higher gains than directional characteristics 392 of the conventional patch antenna.

In this way, the antenna device of this embodiment has isotropically increased gains with respect to circular polarization, and thus is suitable for satellite communications and the like. This is because, for example, an in-car GPS system or the like usually changes its position relative to a satellite with time and it is very important to achieve high gains isotropically. In addition, since the distance to a GPS satellite located at a low elevation angle is relatively larger than the distance to a GPS satellite located near the zenith (at a larger angle as measured from the horizontal plane), resulting in a weaker field intensity, it is very important to achieve high gains at low elevation angles.

(Second Embodiment)

Figure 17:
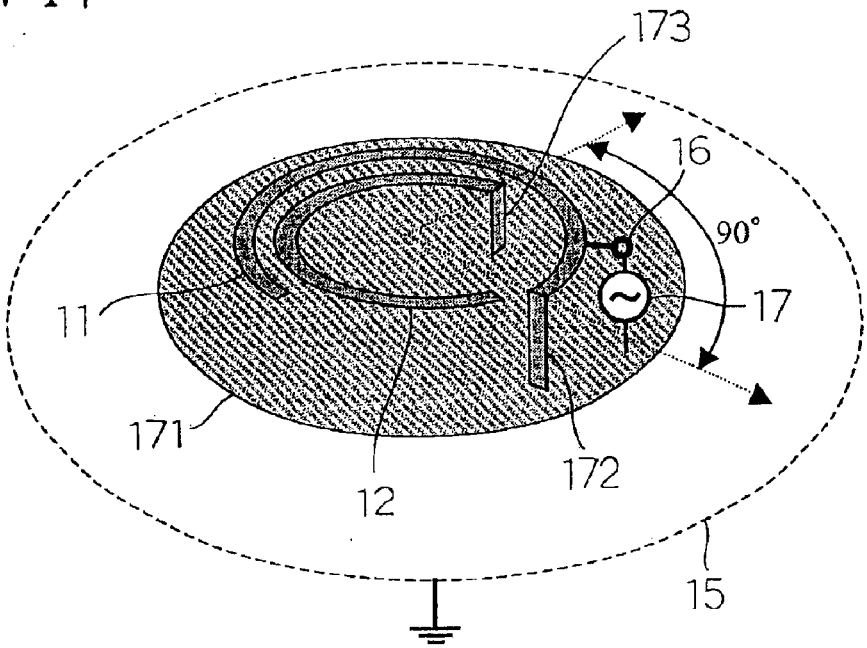
FIG. 17 is a perspective view of a 90-degree displaced double-spiral antenna device for left hand circular polarization with a suspended electrode according to a second embodiment of the present invention.
Figure 18:
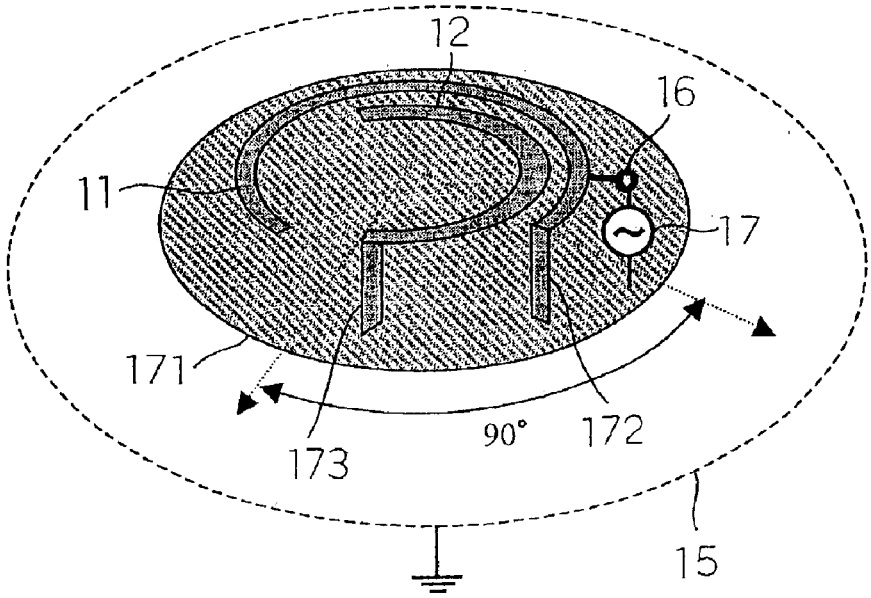
FIG. 18 is a perspective view of a 90-degree displaced double-spiral antenna device for right hand circular polarization with the suspended electrode according to a second embodiment of the present invention.

First, a configuration of an antenna device according to a second embodiment of the present invention will be described with reference to FIGS. 17 and 18, which are a perspective view of a 90-degree displaced double-spiral antenna device for left hand circular polarization with a suspended electrode 171 and a perspective view of a 90-degree displaced double-spiral antenna device for right hand circular polarization with the suspended electrode 171, respectively.

The radiating element 11 is arc-shaped and has the feed terminal 16 to connect to the power source 17 located above the earth ground 15. Incidentally, the feed terminal 16 is connected directly to the radiating element 11 as described above, but alternatively they may be connected across a small gap. According to this embodiment, the radiating element 11 is connected to a suspended electrode 171 at one end via a first connecting electrode 172 to stabilize its potential.

The passive element 12 is of virtually identical shape with the radiating element 11 and installed side by side with the radiating element 11. According to this embodiment, the radiating element 11 is connected to the suspended electrode 171 at one end via a second connecting electrode 173 to stabilize its potential The first connecting electrode 172 and second connecting electrode 173 are displaced with respect to each other in the plane which includes the arc shape, as is the case with the first embodiment described above. More specifically, the first connecting electrode 172 and second connecting electrode 173 are displaced with respect to each other by virtually 90 degrees when viewed from the virtual center of the arc shape.

The suspended electrode 171 is suspended by a support (not shown) between two planes: a plane which includes the radiating element 11 and the passive element 12 and a plane which includes the earth ground 15.

The earth ground 15 is grounded. It is disposed in opposing relation to the suspended electrode 171, being located across the suspended electrode 171 from the radiating element 11 and passive element 12.

Next, operation of the antenna device according to this embodiment will be described.

The antenna device of this embodiment transmits and receives radio waves by generating electric fields between the radiating element 11 and suspended electrode 171, between the passive element 12 and suspended electrode 171, and between the suspended electrode 171 and earth ground 15.

More specifically, a transmission output terminal (not shown) of a communications device (not shown) produces signal output to the radiating element 11 via the feed terminal 16.

This signal output generates electric fields between the radiating element 11 and suspended electrode 171, between the passive element 12 and suspended electrode 171, and between the suspended electrode 171 and earth ground 15.

Then, the combined sum of the three electric fields is sent out as a radio wave.

In this way, since the existence of the suspended electrode 171 allows the antenna device of this embodiment to send out a radio wave as the sum of the three electric fields, it is possible to achieve higher gains and a larger fractional bandwidth than the antenna device of the first embodiment described above.

The receive operation of the antenna device according to this embodiment is understood to be approximately opposite to the transmit operation described above, and thus detailed description thereof will be omitted.

The basic description of operation above commonly applies to any type of polarization used for transmission and reception. Therefore, the antenna device of this embodiment can transmit and receive both vertical polarization and circular polarization with high efficiency, as is the case with the antenna device of the first embodiment described above.

(Third Embodiment)

First, a configuration of an antenna device according to a third embodiment of the present invention will be described with reference to FIG. 48, which is an explanatory diagram illustrating the configuration of the antenna device according to the third embodiment of the present invention.

The antenna device of this embodiment comprises a magnetic-current-mode element and a electric-current-mode element which share a feeding point. Incidentally, the plane where current flows in the magnetic-current-mode element and the plane where current flows in the electric-current-mode element are virtually identical or parallel.

Now, the configuration of the antenna device according to this embodiment will be described in more detail.

Figure 48:
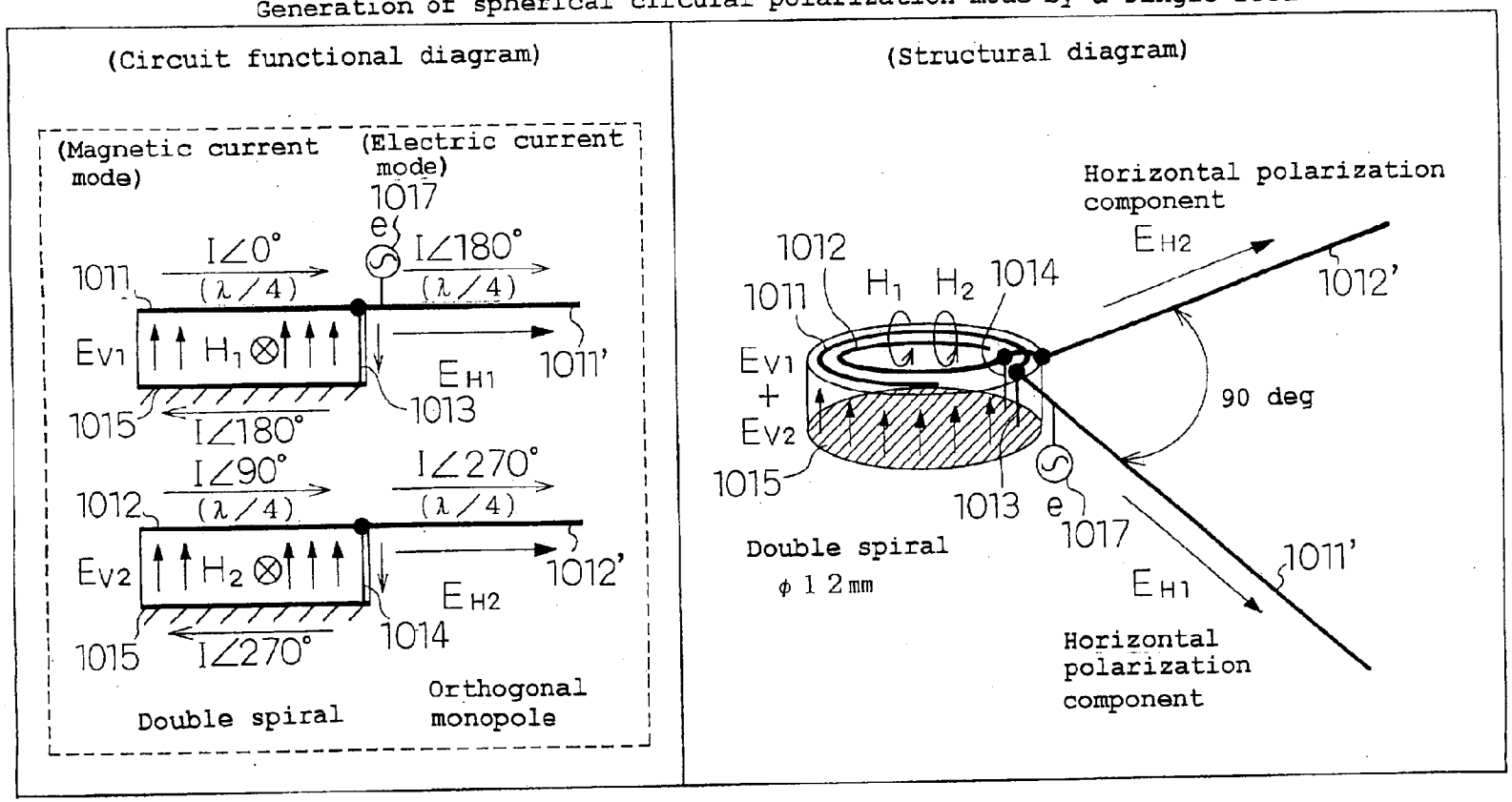
FIG. 48 is an explanatory diagram illustrating configuration of the antenna device according to the third embodiment of the present invention.

The magnetic-current-mode element consists of a radiating element 1011, passive element 1012, earth ground 1015, first connecting electrode 1013, and second connecting electrode 1014 (see the right side of FIG. 48).

The radiating element 1011 is arc-shaped and connected to the earth ground 1015 at one end via the first connecting electrode 1013 to stabilize its potential. Arc length of the radiating element 1011 is limited to an electrical wavelength approximately one quarter-wavelength ($\lambda/4$) of radio wavelength.

The passive element 1012 is of virtually identical shape with the radiating element 1011 and installed side by side with the radiating element 1011. Also, the radiating element 1011 is connected to the earth ground 1015 at one end via the second connecting electrode 1014 to stabilize its potential.

The first connecting electrode 1013 and second connecting electrode 1014 are displaced with respect to each other by virtually 90 degrees when viewed from the virtual center of the arc shapes.

The earth ground 1015 is grounded and is disposed in opposing relation to the radiating element 1011 and passive element 1012.

The electric-current-mode element consists of a first monopole element 1011' and second monopole element 1012' (see the right side of FIG. 48).

The first monopole element 1011' is a straight linear element approximately one quarter-wavelength ($\lambda/4$) of radio wavelength. Besides, the first monopole element 1011' is connected to the radiating element 1011 and is fed from a power source (feed source) 1017 located above the earth ground 1015.

The second monopole element 1012' is of virtually identical shape with the first monopole element 1011' and is connected to the passive element 1012.

The first monopole element 1011' and second monopole element 1012' form an angle of virtually 90 degrees. They are not disposed in opposing relation to the earth ground 1015 and are located on the outer side of the radiating element 1011 and passive element 1012.

Incidentally, the radiating element 1011, passive element 1012, first monopole element 1011', second monopole element 1012', earth ground 1015, first connecting electrode 1013, and second connecting electrode 1014 correspond to the first element, second element, third element, fourth element, earth ground, first connecting electrode, and second connecting electrode of the present invention, respectively.

Figure 46:
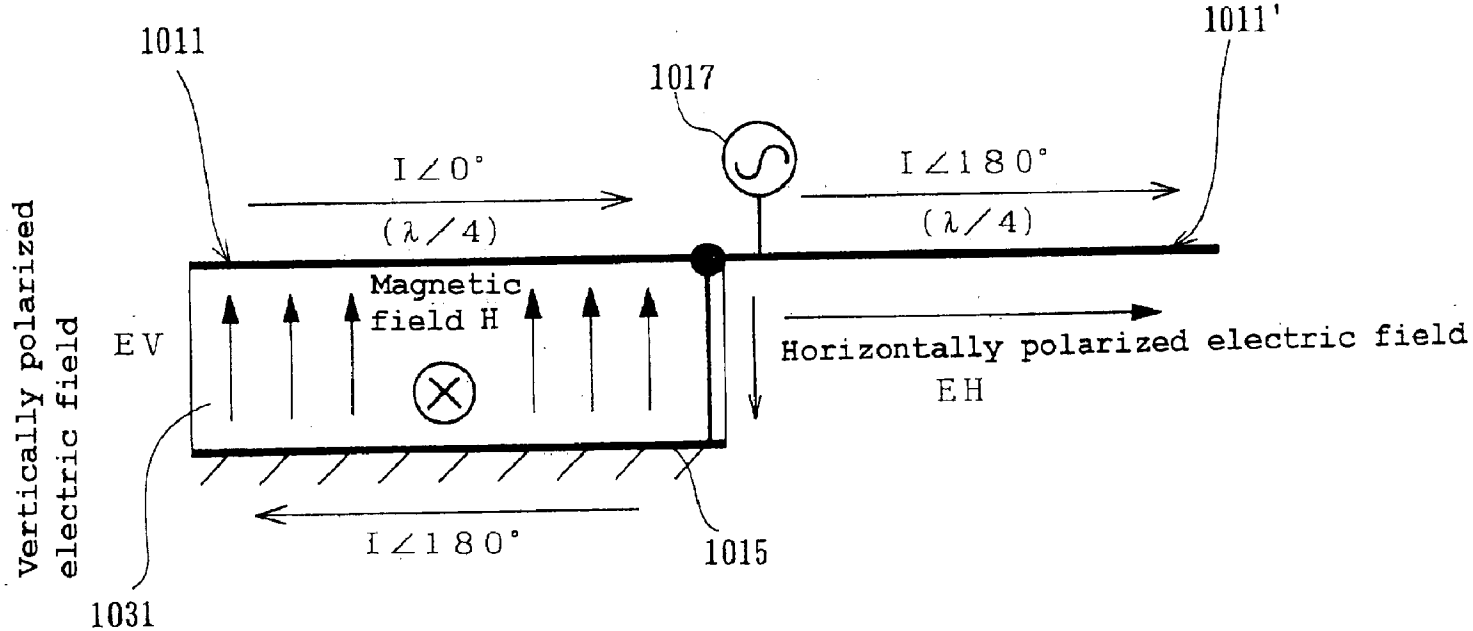
FIG. 46 is an explanatory diagram illustrating operation of an antenna device according to a third embodiment of the present invention.

Next, operation of the antenna device according to this embodiment will be described mainly with reference to FIG. 46, which is an explanatory diagram illustrating operation of the antenna device according to this embodiment. Incidentally, the measurement frequency for analysis of gain characteristics in the following discussion is 1575.42 MHz.

The antenna device of this embodiment inputs and outputs signals (i.e., transmits and receives radio waves) to transmitting and receiving terminals (not shown) of the communications device via terminals connected to the power source (feed source) 1017 (see the right side of FIG. 48), by generating a vertically polarized electric field EV (EV1) by means of the radiating element 1011 and generating a horizontally polarized electric field EH (EH1) by means of the first monopole element 1011'. Incidentally, an induced electric field H (H1) is illustrated near a dielectric (PPO) 1031 inserted between the magnetic-current-mode element 1011 and earth ground 1015.

Thus, through a combination of the magnetic-current-mode element and electric-current-mode element, a vertical polarization mode and horizontal polarization mode are generated by a single feed.

This will be described more specifically, for example, in relation to signal output (i.e., radio wave transmission).

When the first monopole element 1011' (see the right side of FIG. 48) is fed from the power source 1017, a 0-degree out-of-phase current flows through the radiating element 1011 (see the right side of FIG. 48). Since this induces a magnetic field H1, a 180-degree out-of-phase current flows (seethe top left side of FIG. 48) through the earth ground 1015 (see the right side of FIG. 48). Thus, EV1 is generated between the radiating element 1011 and earth ground 1015 (see the top left side of FIG. 48).

Also, electromagnetic induction resulting from the feed described above causes a 90-degree out-of-phase current to flow through the passive element 1012 (see the right side of FIG. 48), inducing a magnetic field H2, which in turn causes a 270-degree out-of-phase current to flow through the earth ground 1015 (see the bottom left side of FIG. 48) Thus, EV2 is generated between the passive element 1012 and earth ground 1015 (see the bottom left side of FIG. 48)

Consequently, the vertically polarized electric field EV due to the magnetic-current-mode element described above is generated as the sum of EV1 and EV2 while H is generated as the sum of H1 and H2 (see the right side of FIG. 48).

On the other hand, a 180-degree out-of-phase current flows through the first monopole element 1011' and a 270-degree out-of-phase current (see the left side of FIG. 48) flows through the second monopole element 1012' (see the right side of FIG. 48). Thus, EH1 is generated along the first monopole element 1011' and EH2 is generated along the second monopole element 1012' (see the right side of FIG. 48).

The horizontally polarized electric field EH due to the electric-current-mode element described above is generated as the sum of EH1 and EH2.

After all, the combined sum of the vertically polarized electric field EV and horizontally polarized electric field EH is sent out as a radio wave.

The receive operation of the antenna device according to this embodiment is understood to be approximately opposite to the transmit operation described above, and thus detailed description thereof will be omitted.

The basic description of operation above commonly applies to any type of polarization used for transmission and reception.

However, the horizontally polarized electric field EH due to the electric-current-mode element come into play especially when transmitting and receiving spherical circular polarization used for GPS (Global Positioning System) and the like. In other words, with a circular polarization mode antenna, it is desirable that two elements in linear polarization excitation mode (current mode) are disposed orthogonally in space and that their currents are +/−90 degrees out of phase with each other and equal in amplitude (needless to say, (1) these elements need not always be orthogonal or (2) a single element may be used, although the directivity will be degraded more or less).

Figure 50:
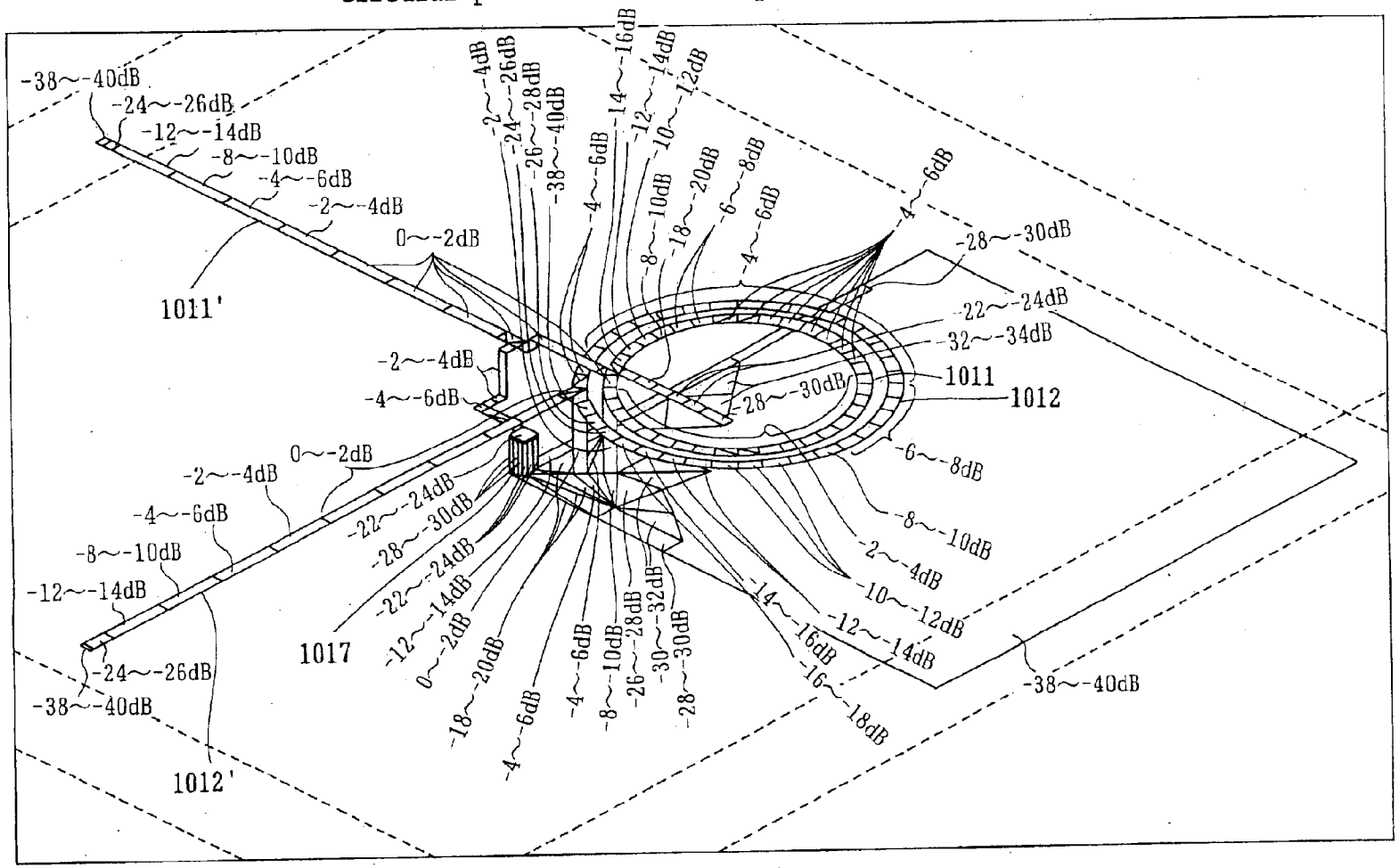
FIG. 50 is an explanatory diagram of the antenna device (principles model) according to the third embodiment of the present invention.

A simulation analysis conducted on a principles model such as the one shown in FIG. 50, which is an explanatory diagram of the antenna device (principles model) according to this embodiment, produced gain characteristics such as those shown in FIG. 51, which is an explanatory diagram illustrating gain characteristics of the antenna device (principles model) according to this embodiment (the horizontal polarization gain in the V plane (top right) and vertical polarization gain in the V plane (bottom right) were obtained by analysis of a right hand circular polarization gain in the V plane (left)).

Figure 52:
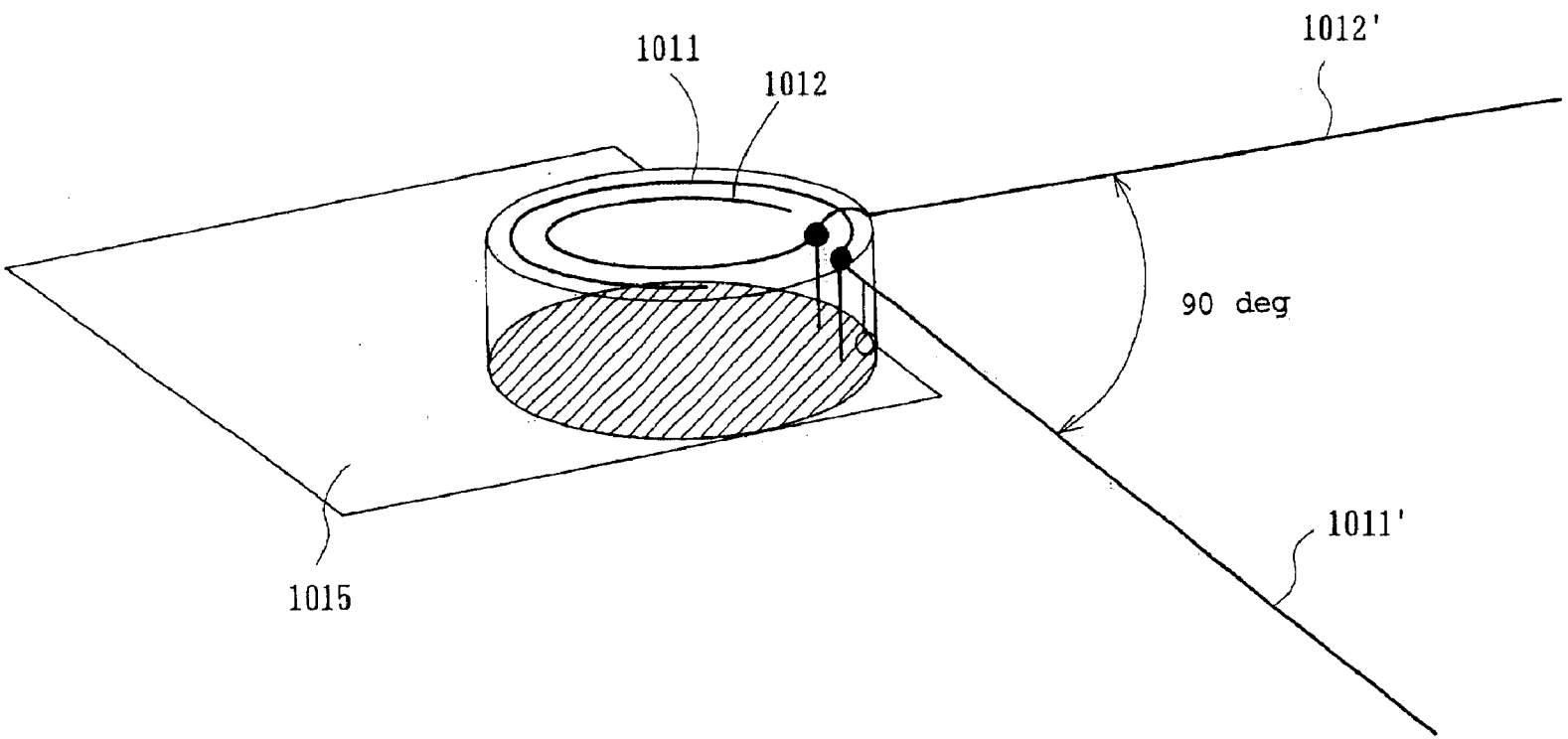
FIG. 52 is an explanatory diagram of the antenna device (principles functional model) according to the third embodiment of the present invention.
Figure 53:
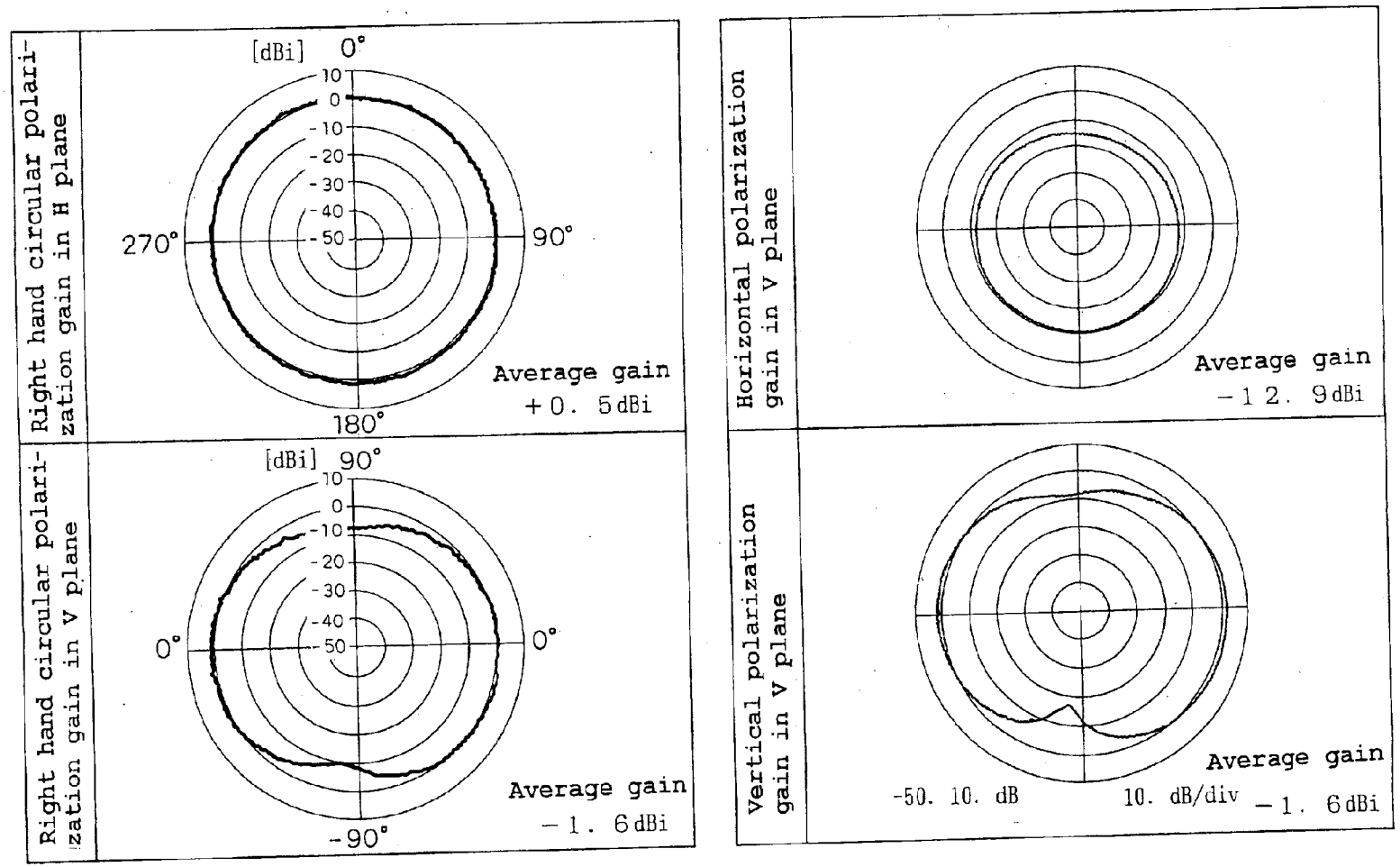
FIG. 53 is an explanatory diagram illustrating gain characteristics of the antenna device (principles functional model) according to the third embodiment of the present invention.

Also, a test conducted by actually operating a principles functional model such as the one shown in FIG. 52, which is an explanatory diagram of the antenna device (principles functional model) according to this embodiment, produced gain characteristics such as those shown in FIG. 53, which is an explanatory diagram illustrating gain characteristics of the antenna device (principles functional model) according to this embodiment (the horizontal polarization gain in the V plane (top right) and vertical polarization gain in the V plane (bottom right) were obtained by analysis of a right hand circular polarization gain in the V plane (bottom left)).

The magnetic-current-mode spiral element (double spiral) which consists of the radiating element 1011 and passive element 1012 is 12 mm in diameter. The electric-current-mode element (orthogonal monopole) which consists of the first monopole element 1011' and second monopole element 1012' is 48 mm long on each side. The earth ground 1015 is 20 mm square.

Figure 45:
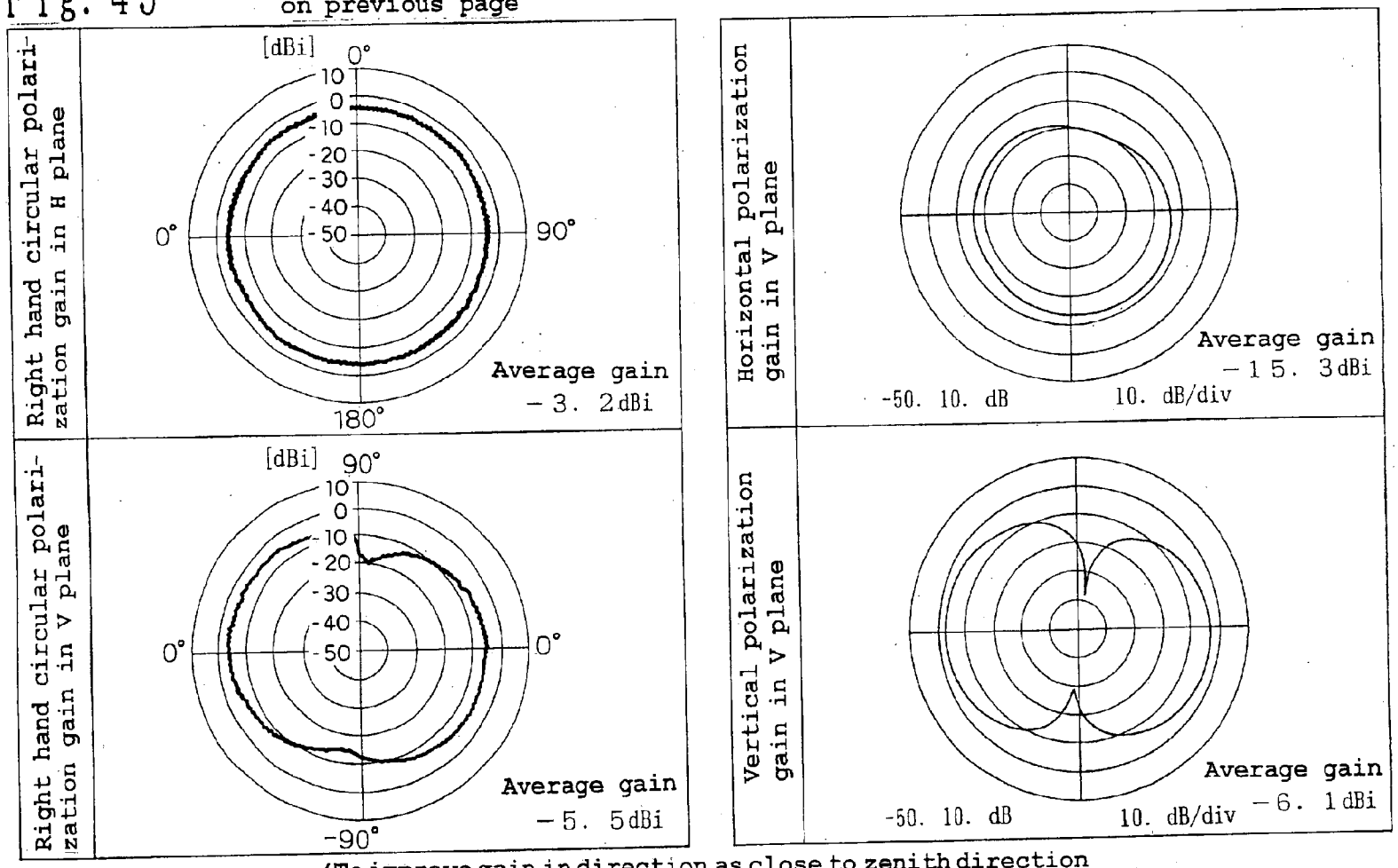
FIG. 45 is an explanatory diagram illustrating gain characteristics of the antenna device according to the present invention.

As a result, it was clearly proved both theoretically and experimentally that the gain characteristics (especially the horizontal polarization gain in the V plane) of the antenna device which has the magnetic current mode and electric current mode are far better than those of, for example, the double-spiral antenna device shown in FIG. 45.

(Fourth Embodiment)

Figure 47:
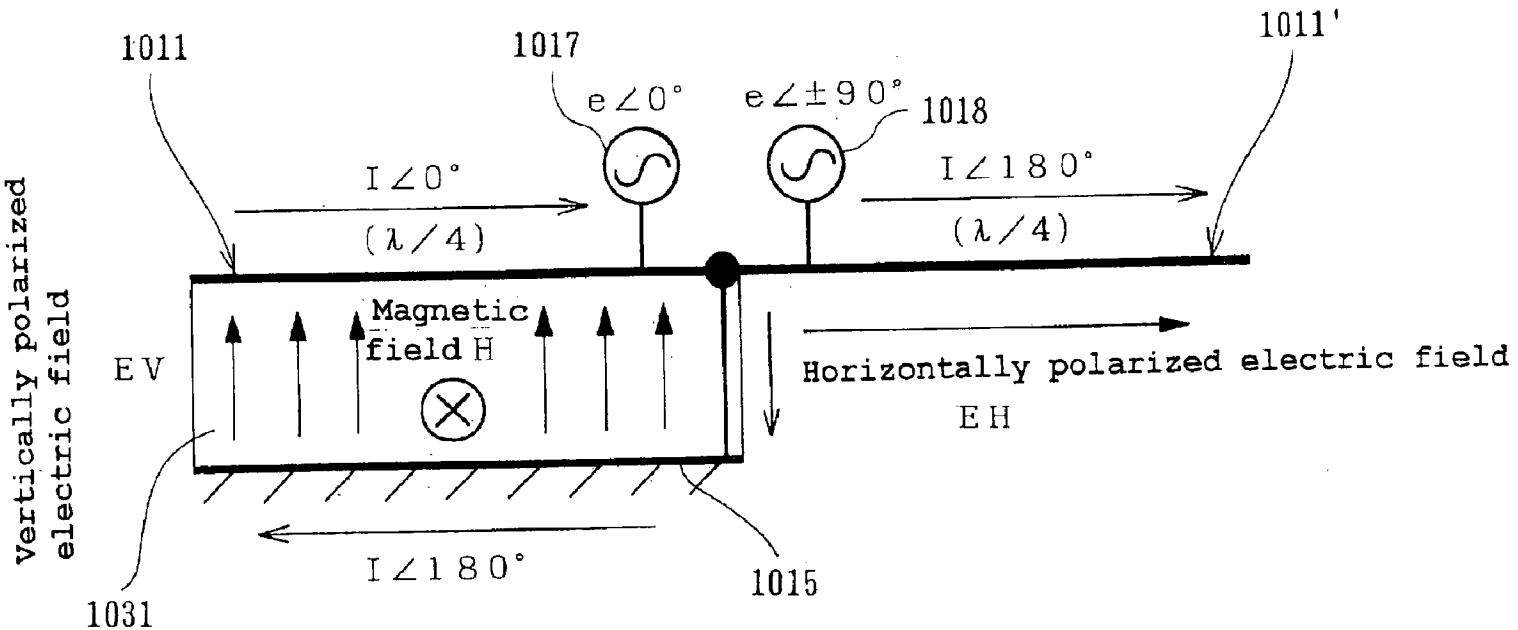
FIG. 47 is an explanatory diagram illustrating operation of an antenna device according to a fourth embodiment of the present invention.
Figure 49:
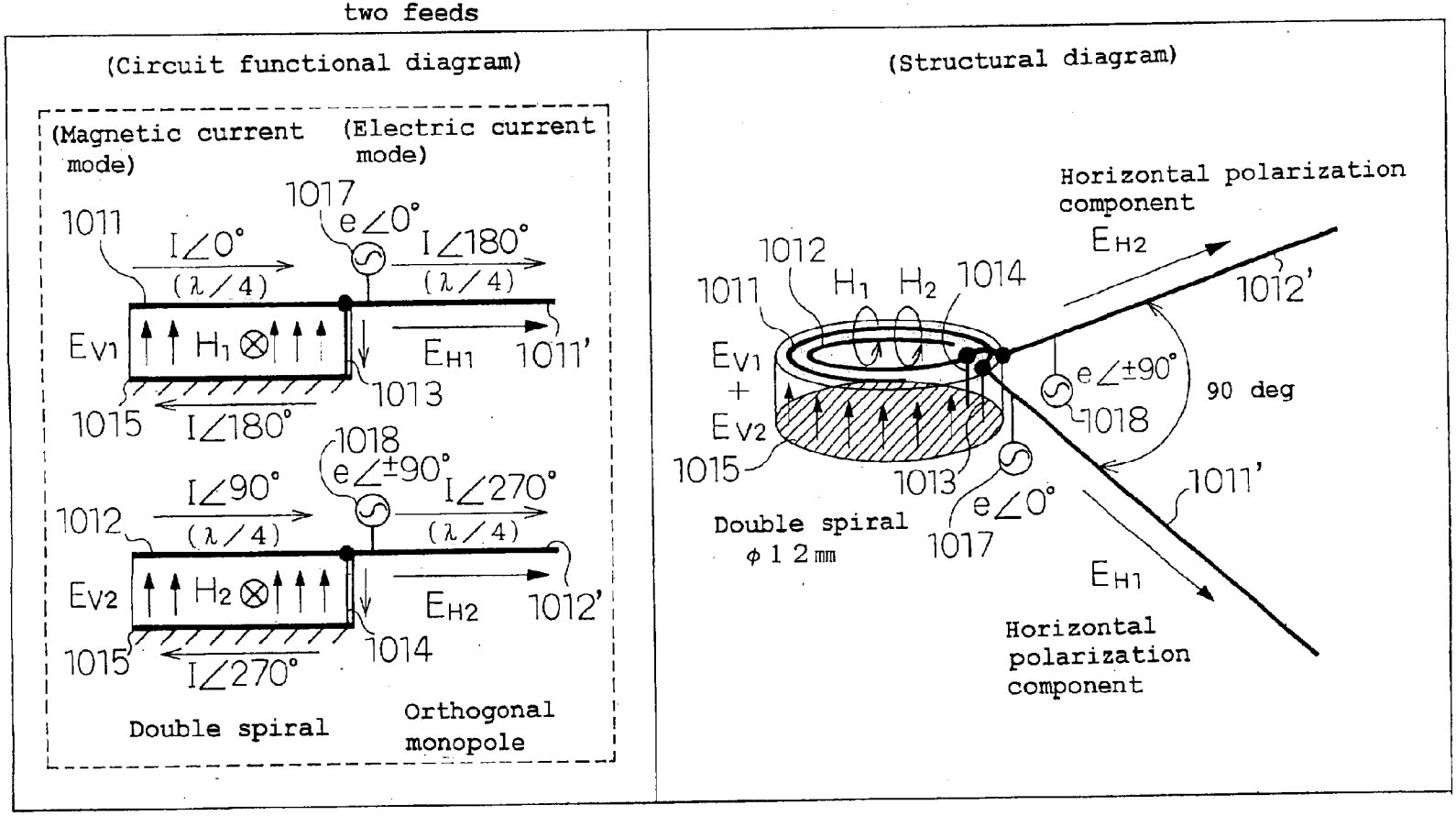
FIG. 49 is an explanatory diagram illustrating configuration of the antenna device according to the fourth embodiment of the present invention.

Next, a configuration and operation of an antenna device according to a fourth embodiment of the present invention will be described with reference to FIGS. 49 and 47, which are an explanatory diagram illustrating configuration of the antenna device according to this embodiment and an explanatory diagram illustrating operation of the antenna device according to this embodiment, respectively.

The configuration and operation of the antenna device according to this embodiment are analogous to those of the antenna device according to the third embodiment described above.

The antenna device of this embodiment inputs and outputs signals (i.e., transmits and receives radio waves) to transmitting and receiving terminals (not shown) of the communications device via terminals connected to the 0-degree out-of-phase power source (feed source) 1017 (see the right side of FIG. 48), by generating a vertically polarized electric field EV (EV1) by means of the radiating element 1011 and generating a horizontally polarized electric field EH (EH1) by means of the first monopole element 1011'. Incidentally, an induced electric field H (H1) is illustrated near the dielectric 1031 inserted between the radiating element 1011 and earthground 1015.

Thus, through a combination of the magnetic-current-mode element and electric-current-mode element, a circular polarization mode is generated by two feeds.

However, according to this embodiment, the second monopole element 1012' is also fed from a power source (feed source) 1018. Besides, there is a phase difference of virtually 90 degrees between the power supply to the first monopole element 1011' and the power supply to the second monopole element 1012'.

Consequently, the antenna device of this embodiment reliably ensures the above-mentioned currents 90 degrees apart in phase which should be delivered to the passive element 1012, by means of electromagnetic induction, and thus it can operate more stably.

(Fifth Embodiment)

Next, a configuration and operation of an antenna device according to a fifth embodiment of the present invention will be described with reference to FIG. 56, which is an explanatory diagram illustrating configuration of the antenna device according to this embodiment.

The configuration and operation of the antenna device according to this embodiment are analogous to those of the antenna device according to the third embodiment described above.

However, according to this embodiment, a first monopole element 2011' and second monopole element 2012' are arc-shaped. Besides, they are not disposed in opposing relation to the earth ground 1015 and are installed side by side with the radiating element 1011 and passive element 1012 (i.e., the antenna device of this embodiment is a so-called quad-spiral antenna device).

Here, the first monopole element 2011' and second monopole element 2012' are virtually orthogonal to each other if attention is paid to their junction (in the neighborhood of feeding point) with the radiating element 1011 or passive element 1012 where the above-mentioned horizontally polarized electric field is at its maximum.

Consequently, the antenna device of this embodiment ensures orthogonality of the two monopole elements while achieving size reduction, and thus can reliably transmit and receive the horizontally polarized electric field generated by the electric-current-mode element (i.e., the antenna device of this embodiment also excels in transmission and reception of spherical circular polarization used for GPS and the like).

Figure 54:
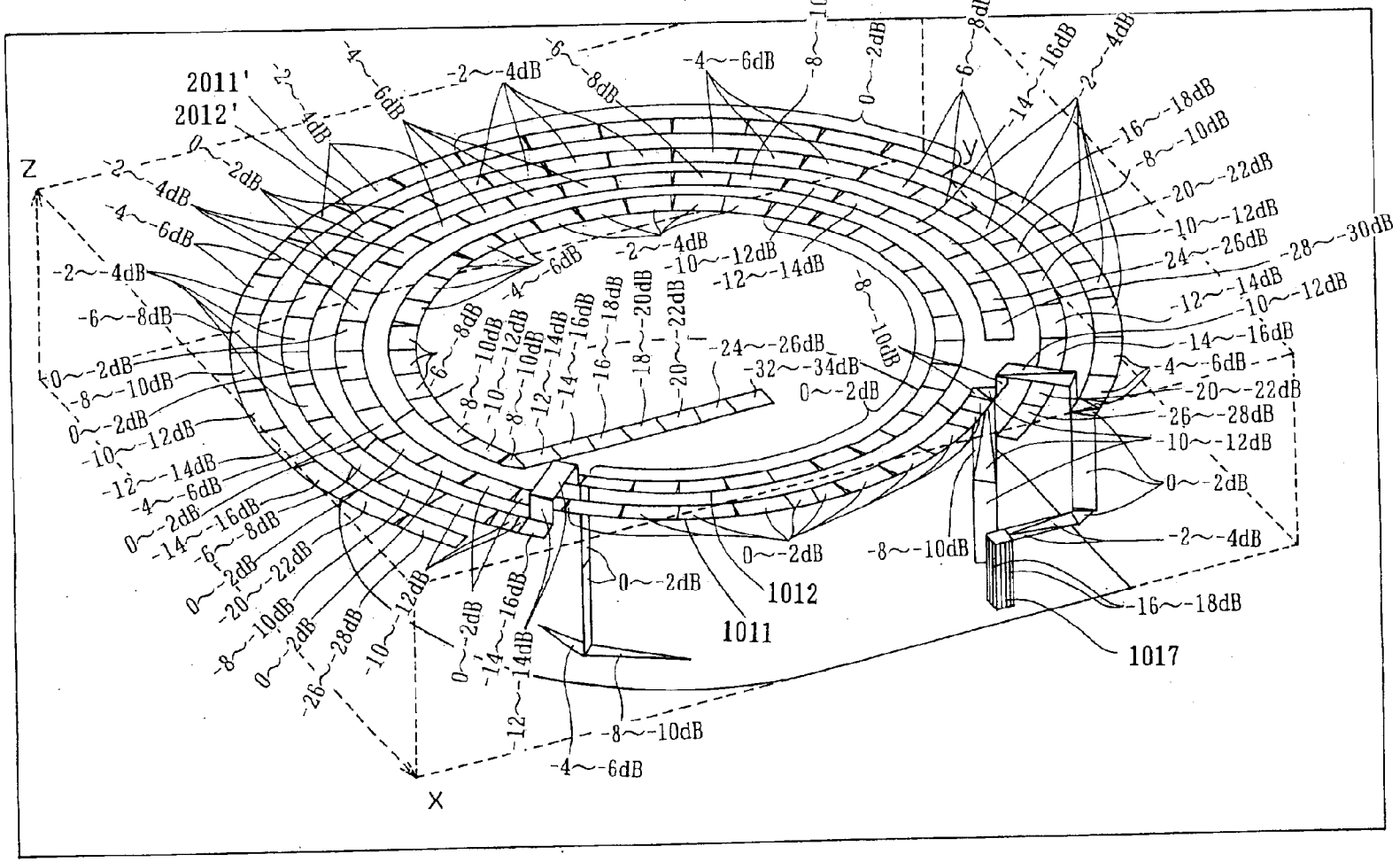
FIG. 54 is an explanatory diagram of the antenna device (principles model) according to a fifth embodiment of the present invention.
Figure 55:
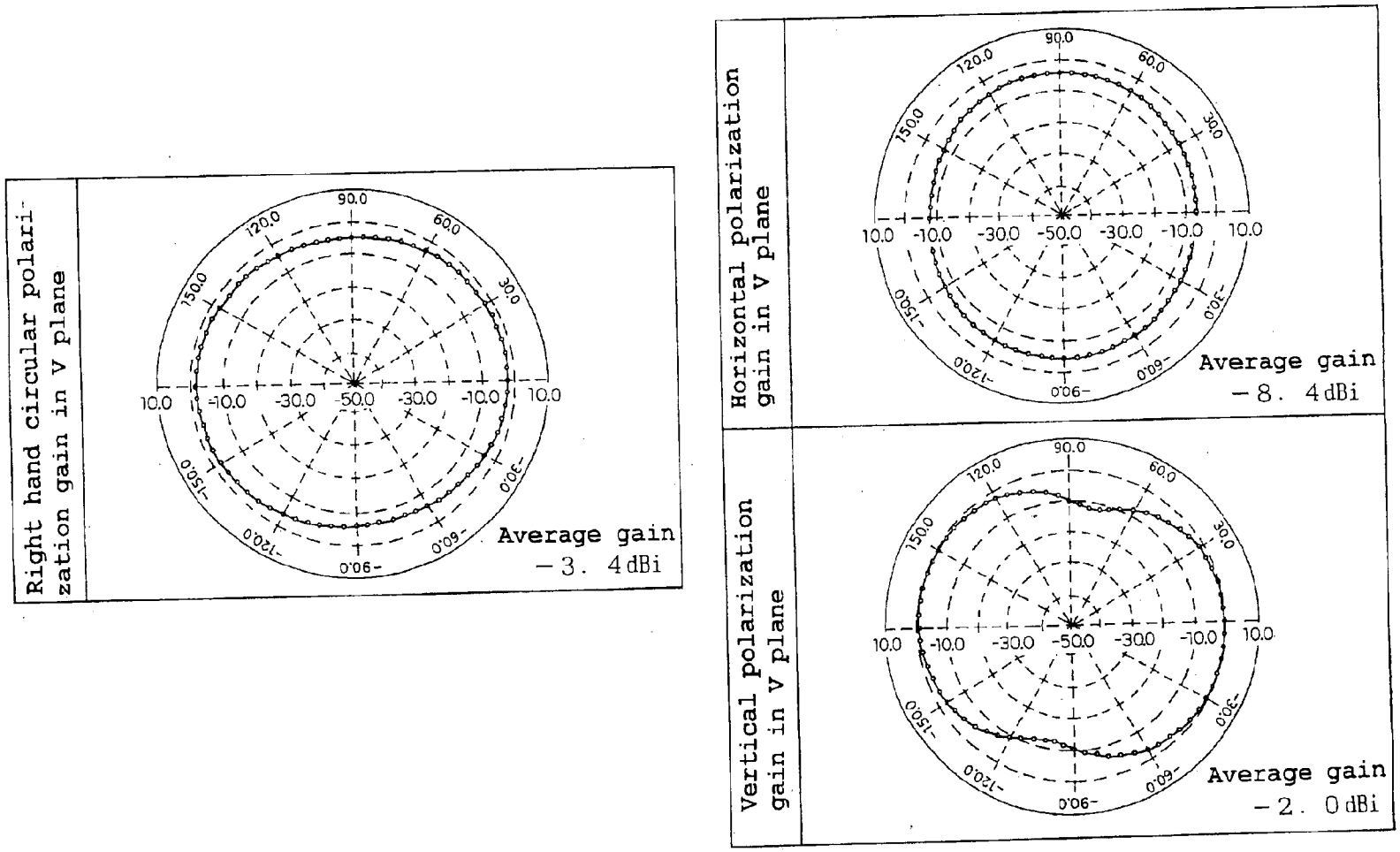
FIG. 55 is an explanatory diagram illustrating gain characteristics of the antenna device (principles model) according to the fifth embodiment of the present invention.

A simulation analysis conducted on a principles model such as the one shown in FIG. 54, which is an explanatory diagram of the antenna device (principles model) according to this embodiment, produced gain characteristics such as those shown in FIG. 55, which is an explanatory diagram illustrating gain characteristics of the antenna device (principles model) according to this embodiment (the horizontal polarization gain in the V plane (top right) and vertical polarization gain in the V plane (bottom right) were obtained by analysis of a right hand circular polarization gain in the V plane (left)).

This proves theoretically that the gain characteristics (especially the horizontal polarization gain in the V plane) of the quad-spiral antenna device is far better than those of, for example, the double-spiral antenna device shown in FIG. 45.

Figure 57:
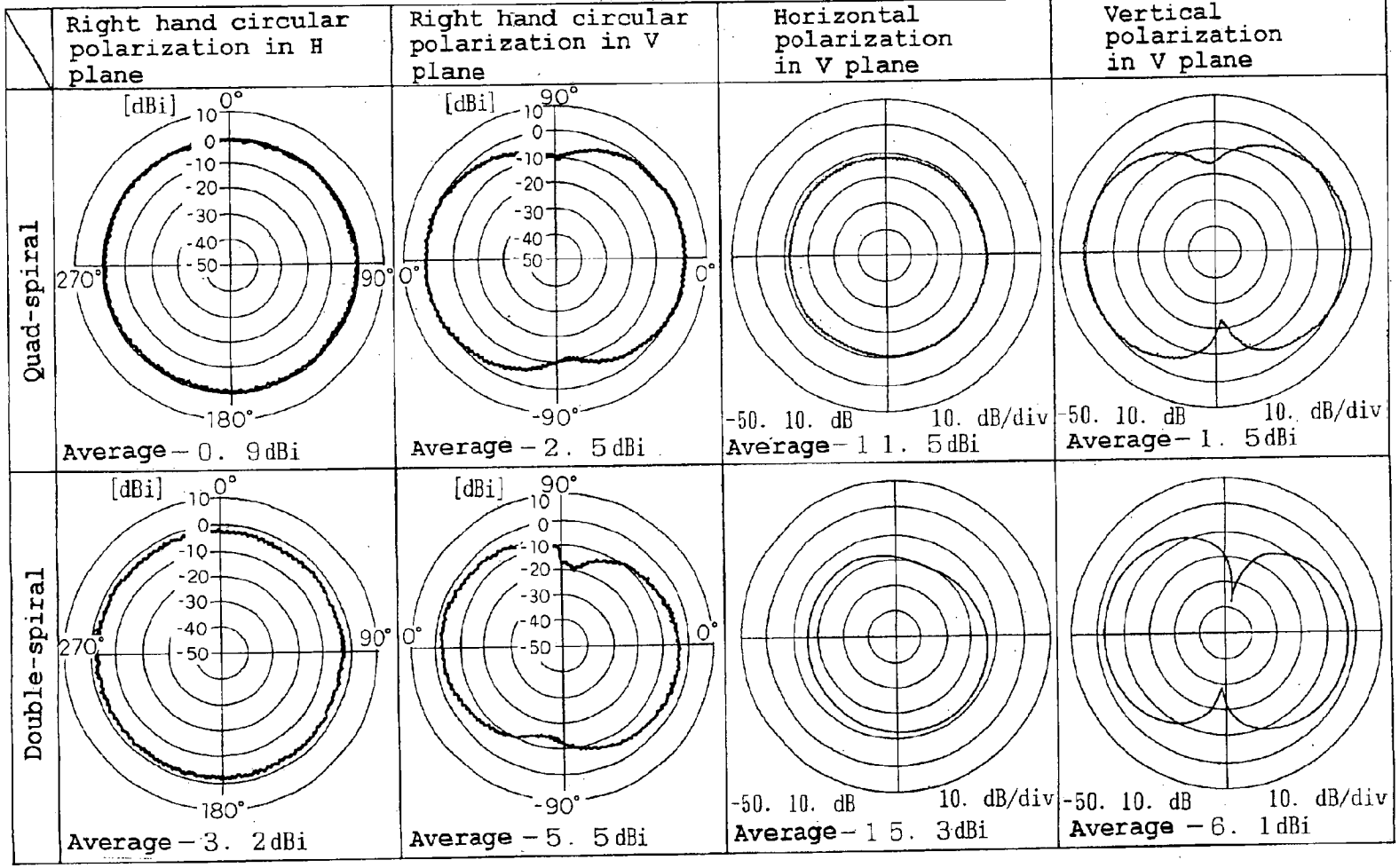
FIG. 57 is an explanatory diagram comparing gains between a quad-spiral antenna device (principles functional model) and double-spiral antenna device (principles functional model) according to the present invention.

Furthermore, a test conducted by actually operating the quad-spiral antenna device (principles functional model) and double-spiral antenna device (principles functional model) of the present invention produced gain characteristics such as those shown in FIG. 57, which is an explanatory diagram comparing gains between the quad-spiral antenna device (principles functional model) and double-spiral antenna device (principles functional model) according to the present invention.

Figure 58:
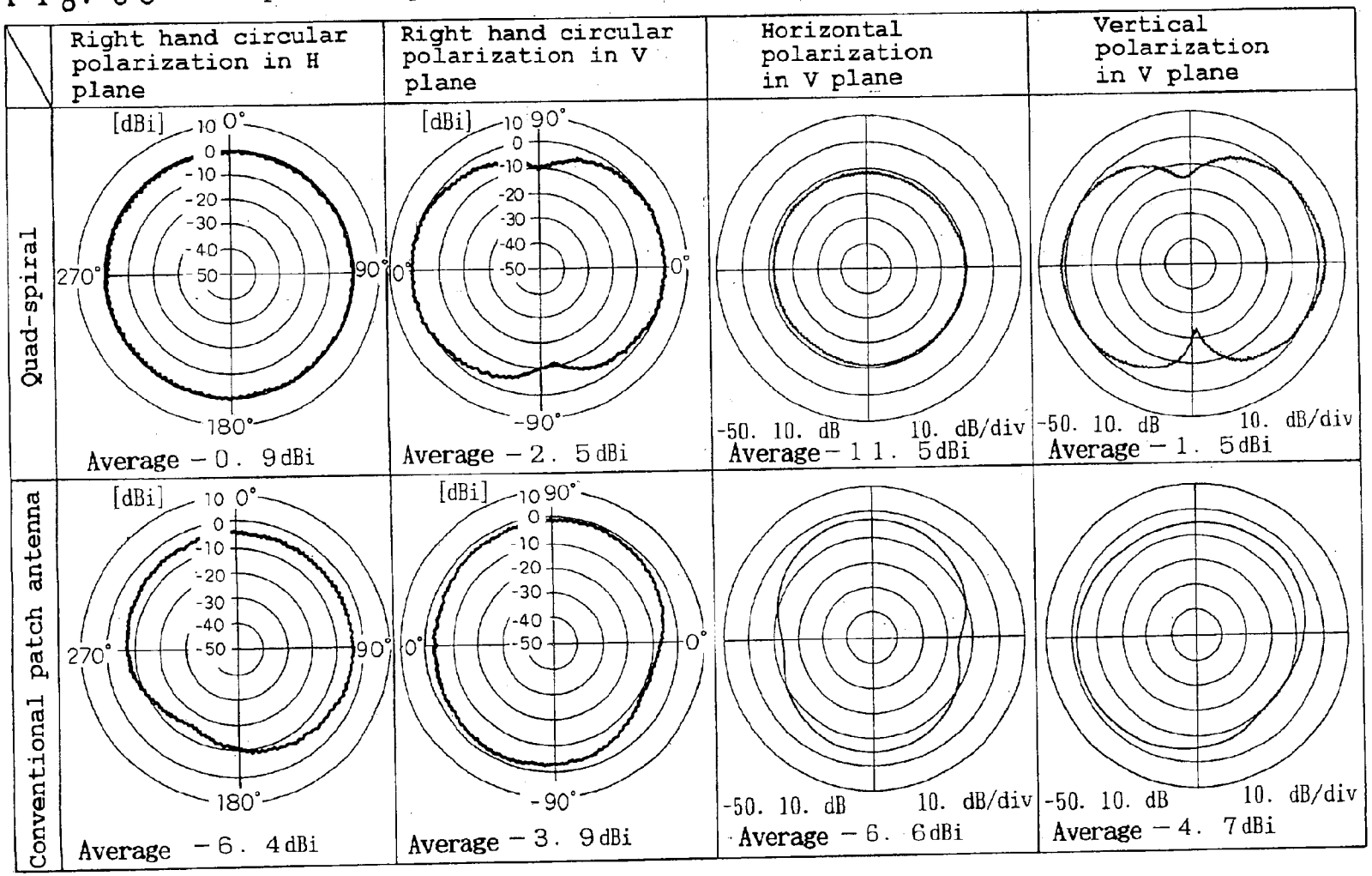
FIG. 58 is an explanatory diagram comparing gains between the quad-spiral antenna device (principles functional model) of the present invention and conventional patch antenna device.

Also, a test conducted by actually operating the quad-spiral antenna device (principles functional model) of the present invention and a conventional patch antenna device produced gain characteristics such as those shown in FIG. 58, which is an explanatory diagram comparing gains between the quad-spiral antenna device (principles functional model) of the present invention and conventional patch antenna device.

Also, a test conducted by actually operating the quad-spiral antenna device of the present invention, double-spiral antenna device of the present invention, and conventional patch antenna device produced results such as those shown in FIG. 59, which is an explanatory diagram comparing the quad-spiral antenna device of the present invention, double-spiral antenna device of the present invention, and conventional patch antenna device.

Thus, the double-spiral antenna device and quad-spiral antenna device of the present invention are smaller in size and better in terms of gains than the conventional patch antenna device although they employ PPO which has a smaller permittivity $\epsilon r$ and larger dielectric loss tangent $\tan\delta$ (and thus, larger dielectric loss) than ceramic.

The above-mentioned quad-spiral antenna device and double-spiral antenna device of the present invention employ PPO as a dielectric while the conventional patch antenna device employs ceramic as a dielectric, but as shown in FIG. 60, which is an explanatory diagram illustrating size reduction effect of the quad-spiral antenna device (a newly developed product) of the present invention, even if air is used as a dielectric for both the present invention and conventional patch antenna, the difference in the apparatus size required to secure equal gains is quite pronounced. Incidentally, the diameter of a model employing air is 34.5 mm, which is $(\epsilon_{eff})^{1/2}=2.3$ times the diameter of a model employing PPO (where $\epsilon_{eff}$ is effective permittivity)

These results clearly show that the antenna devices of the present invention (especially, the quad-spiral antenna device) have excellent gain characteristics while keeping their shape, size, volume, and weight at relatively low levels.

Figure 61:
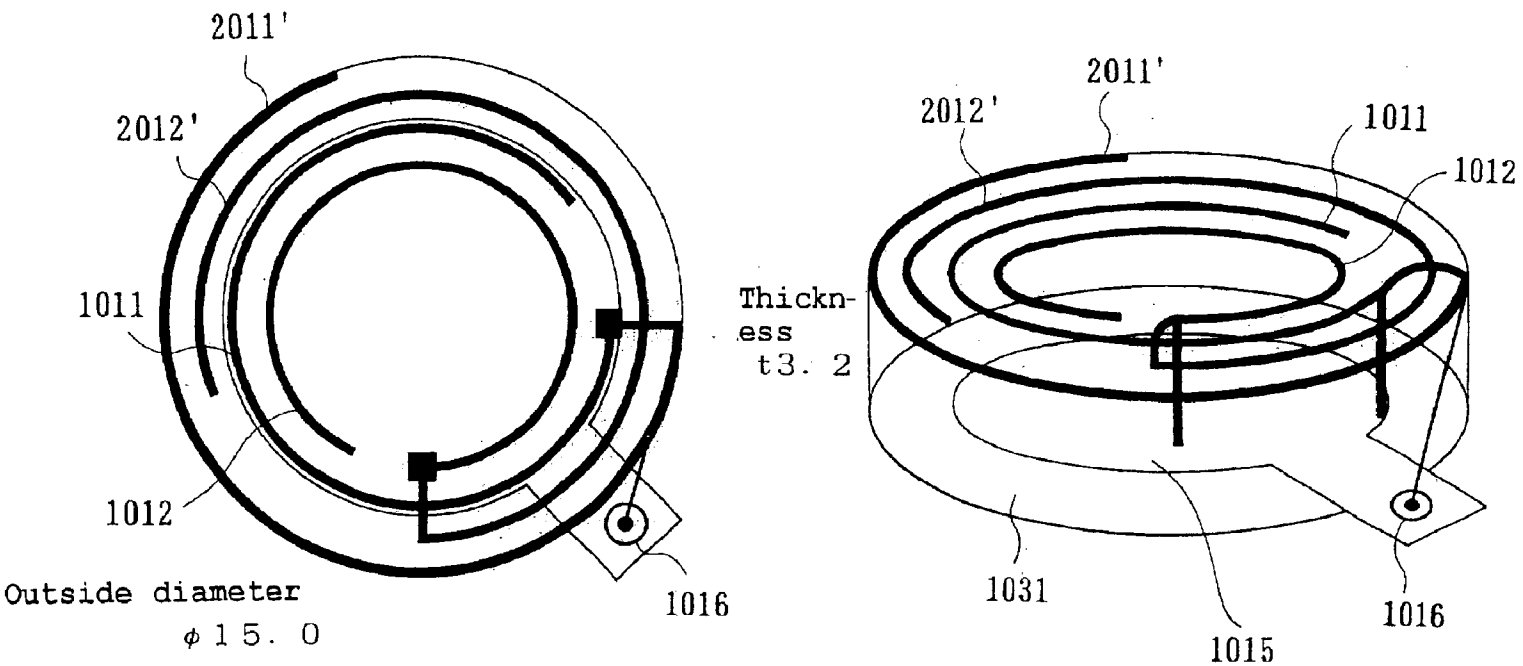
FIG. 61 is an explanatory diagram illustrating an antenna device of the present invention in which bending directions of a first to fourth elements are clockwise, counterclockwise, clockwise, and counterclockwise, respectively.
Figure 62:
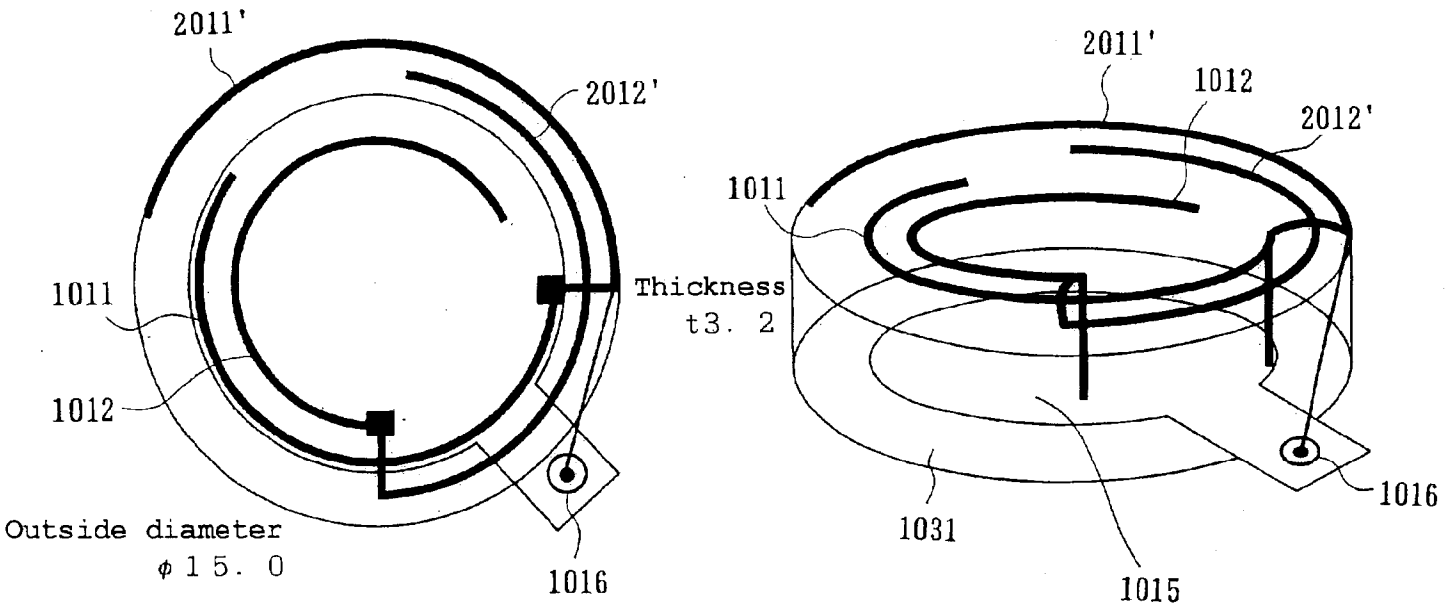
FIG. 62 is an explanatory diagram illustrating an antenna device of the present invention in which bending directions of a first to fourth elements are clockwise, clockwise, counterclockwise, and counterclockwise, respectively.
Figure 63:
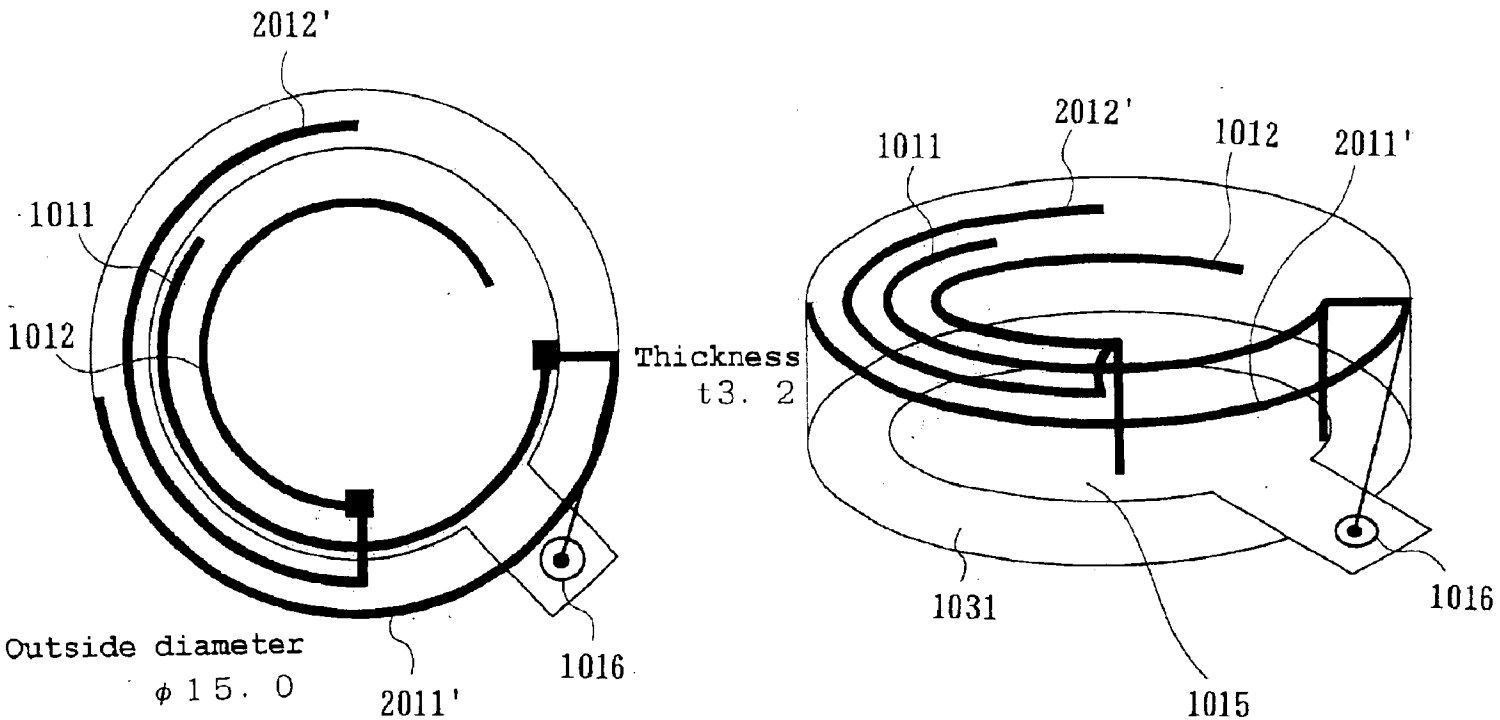
FIG. 63 is an explanatory diagram illustrating an antenna device of the present invention in which bending directions of a first to fourth elements are clockwise, clockwise, clockwise, and clockwise, respectively.

Needless to say, as with the winding directions of the double spiral described above (see FIG. 44), the winding directions of the quad-spiral (double-spiral and double-monopole-spiral) have many variations, including (a) +90-degree displaced clockwise/counterclockwise double spiral and +90-degree displaced clockwise/counterclockwise double monopole spiral (see FIG. 61), (b) +90 -degree displaced clockwise double spiral and +90-degree displaced counterclockwise double monopole spiral (see FIG. 62), (c) +90-degree displaced clockwise double winding and +90-degree displaced clockwise double monopole spiral (see FIG. 63), etc. Incidentally, FIG. 61 is an explanatory diagram illustrating an antenna device of the present invention in which bending directions of the first to fourth elements (1011, 1012, 1011', and 1012') are clockwise, counterclockwise, clockwise, and counterclockwise, respectively. FIG. 62 is an explanatory diagram illustrating an antenna device of the present invention in which bending directions of a first to fourth elements are clockwise, clockwise, counterclockwise, and counterclockwise, respectively. FIG. 63 is an explanatory diagram illustrating an antenna device of the present invention in which bending directions of a first to fourth elements are clockwise, clockwise, clockwise, and clockwise, respectively. In short, it does not matter whether the bending or curving directions of the first to fourth elements are the same or different.

The first to fifth embodiments have been described above.

Figure 3:
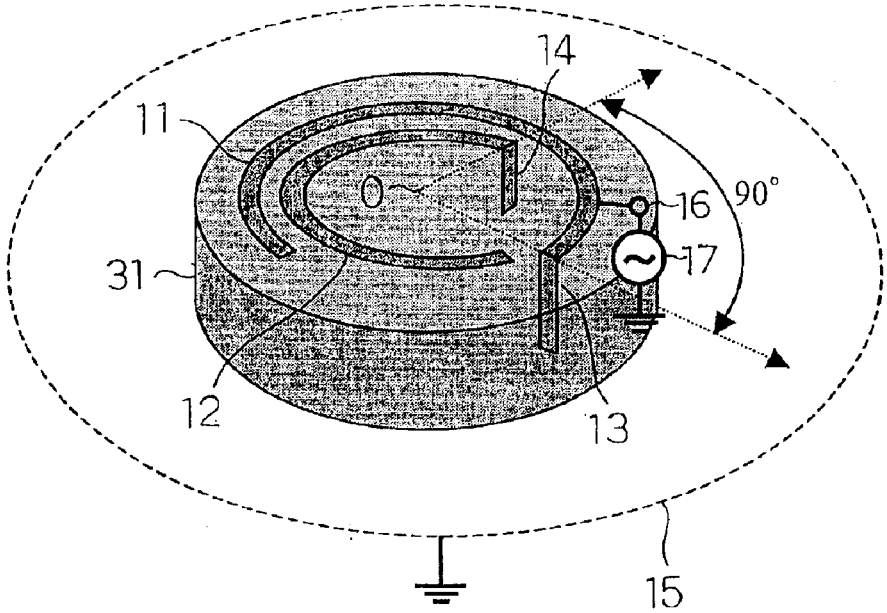
FIG. 3 is a perspective view of a 90-degree displaced double-spiral antenna device for left hand circular polarization with a dielectric inserted between a radiating element and earth ground, according to the present invention.
Figure 4:
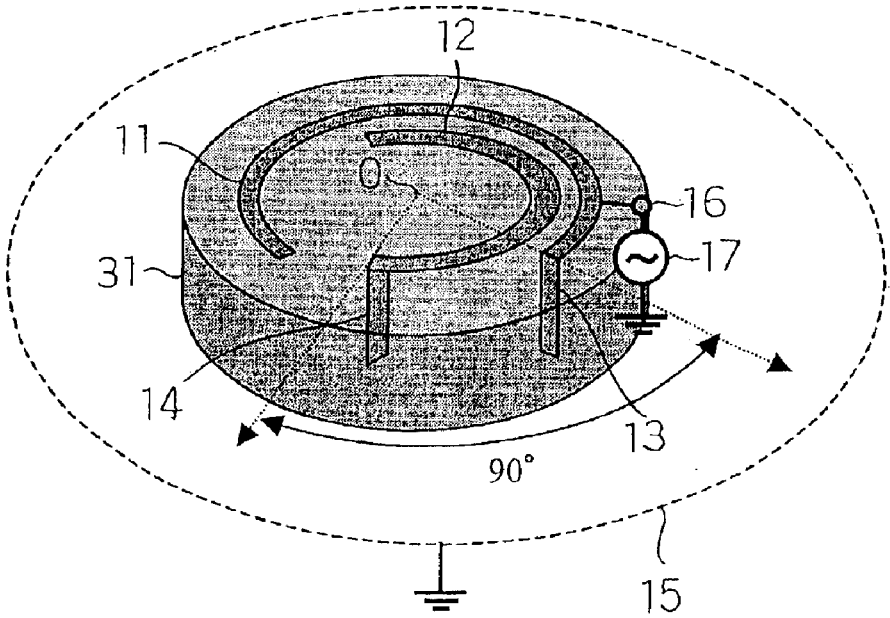
FIG. 4 is a perspective view of a 90-degree displaced double-spiral antenna device for right hand circular polarization with a dielectric inserted between a radiating element and earth ground, according to the present invention.

Besides, a dielectric may be inserted between the first element of the present invention and ground earth of the present invention. For example, as shown in FIGS. 3 and 4, a dielectric 31 may be inserted between the radiating element 11 and earth ground 15. Incidentally, FIG. 3 is a perspective view of the 90-degree displaced double-spiral antenna device for left hand circular polarization with the dielectric 31 inserted between the radiating element 11 and earth ground 15 while FIG. 4 is a perspective view of the 90-degree displaced double-spiral antenna device for right hand circular polarization with the dielectric 31 inserted between the radiating element 11 and earth ground 15.

Figure 19:
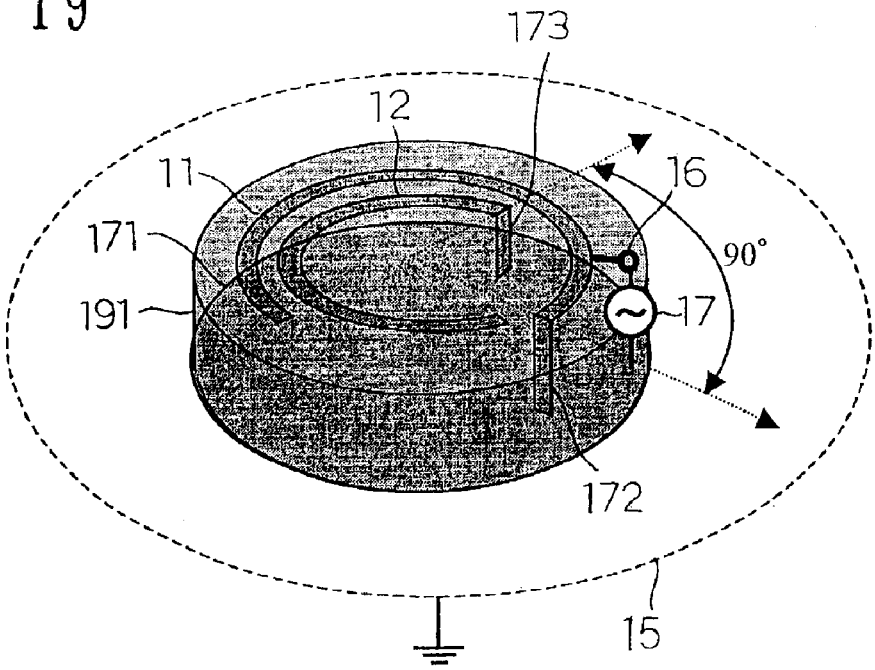
FIG. 19 is a perspective view of a 90-degree displaced double-spiral antenna device for left hand circular polarization with a dielectric inserted between a radiating element and suspended electrode, according to the present invention.
Figure 20:
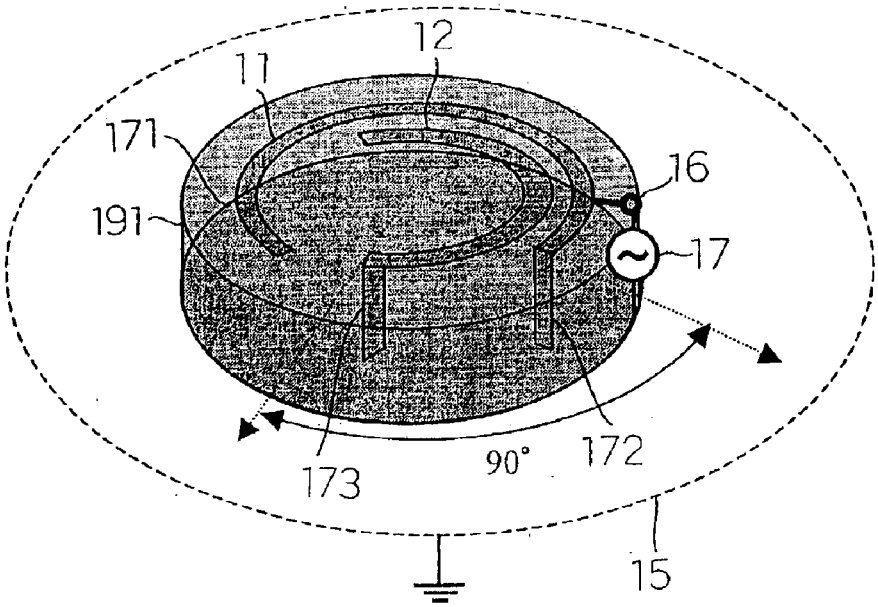
FIG. 20 is a perspective view of a 90-degree displaced double-spiral antenna device for right hand circular polarization with a dielectric inserted between the radiating element and suspended electrode, according to the present invention.

Also, a dielectric may be inserted between the first element of the present invention and suspended electrode of the present invention. For example, as shown in FIGS. 19 and 20, a dielectric 191 may be inserted between the radiating element 11 and suspended electrode 171. Incidentally, FIG. 19 is a perspective view of the 90-degree displaced double-spiral antenna device for left hand circular polarization with a dielectric inserted between the radiating element 11 and suspended electrode 171 while FIG. 20 is a perspective view of the 90-degree displaced double-spiral antenna device for right hand circular polarization with the dielectric 191 inserted between the radiating element 11 and suspended electrode 171, according to the present invention.

Also, a dielectric may be inserted between the suspended electrode of the present invention and earth ground of the present invention.

Besides, the dielectric of the present invention may be made of ceramic, Teflon (manufactured by DuPont), epoxy resin, ABS, or the like, but insertion of a substance with a high permittivity will reduce the height and size of the antenna device.

However, when mounting an antenna device on a portable communications terminal or the like, ill effects that the high permittivity will have on the human body must be taken into consideration, and thus a substance with too high a permittivity cannot be inserted. However, the antenna device of the present invention are capable of transmission and reception with higher efficiency even if a substance with a low permittivity is inserted while achieving smaller size than conventional antenna devices. More specifically, as shown in FIG. 40, the 90-degree displaced double-spiral antenna device which is a concrete example of the antenna device according to the present invention is smaller in all respects including volume, area, and weight than the conventional patch antenna even though it uses a dielectric made of a resin with a permittivity of only 10. Also, it has high gains even though its dielectric loss is as large as 0.004 (although the term "dissipation loss" is used in FIG. 40, more precisely, the term "dielectric loss" should be used). Incidentally, FIG. 40 is an explanatory diagram comparing a 90-degree displaced double-spiral GPS antenna and conventional patch antenna.

Figure 9:
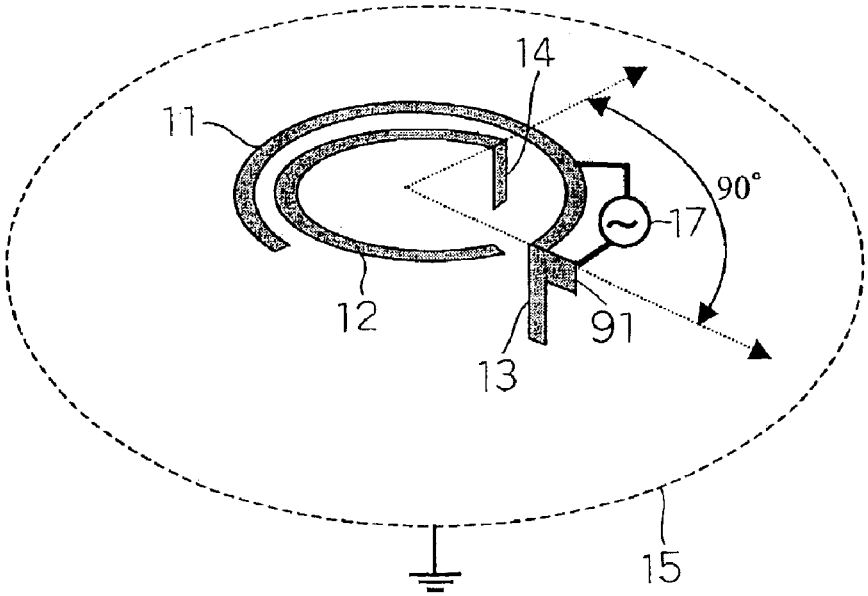
FIG. 9 is a perspective view of the 90-degree displaced double-spiral antenna device for left hand circular polarization with a neutral electrode on the radiating element, according to the present invention.
Figure 10:
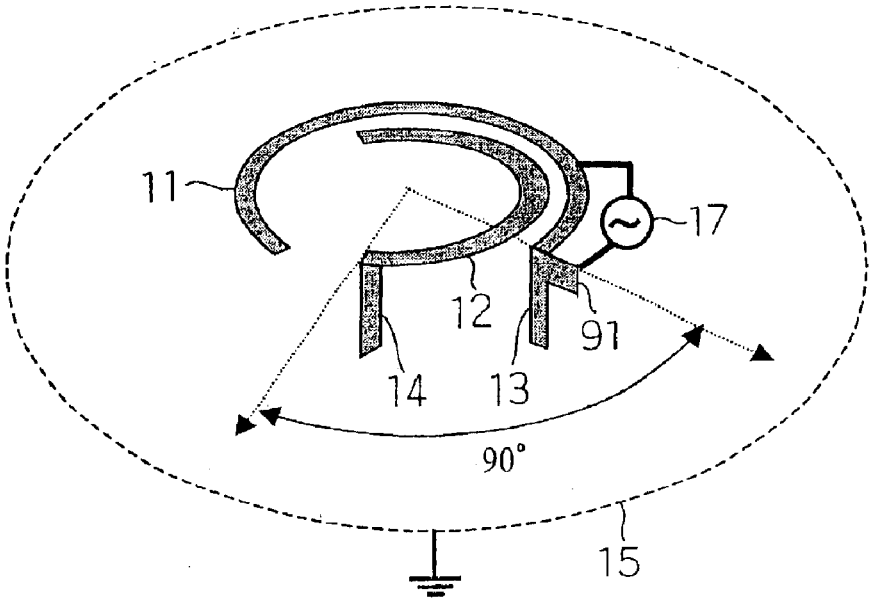
FIG. 10 is a perspective view of the 90-degree displaced double-spiral antenna device for right hand circular polarization with a neutral electrode on the radiating element, according to the present invention.

Also, the first element of the present invention may be provided with a neutral electrode to draw power. For example, as shown in FIGS. 9 and 10, the radiating element 11 may be equipped with a neutral electrode 91 to draw power from the power source 17. Incidentally, FIG. 9 is a perspective view of the 90-degree displaced double-spiral antenna device for left hand circular polarization with the neutral electrode 91 on the radiating element 11 while FIG. 10 is a perspective view of the 90-degree displaced double-spiral antenna device for right hand circular polarization with the neutral electrode 91 on the radiating element 11.

Such a neutral electrode allows all currents of a quarter-wavelength to be distributed over the radiating element 11, and thus has the effect of maximizing radiant efficiency (gain characteristics). If the neutral electrode 91 is not provided, the currents of a quarter-wavelength is distributed to the radiating element 11 and first connecting electrode 13, reducing current components in the radiating element 11 and lowering the radiant efficiency (gain characteristics) to some extent.

Figure 5:
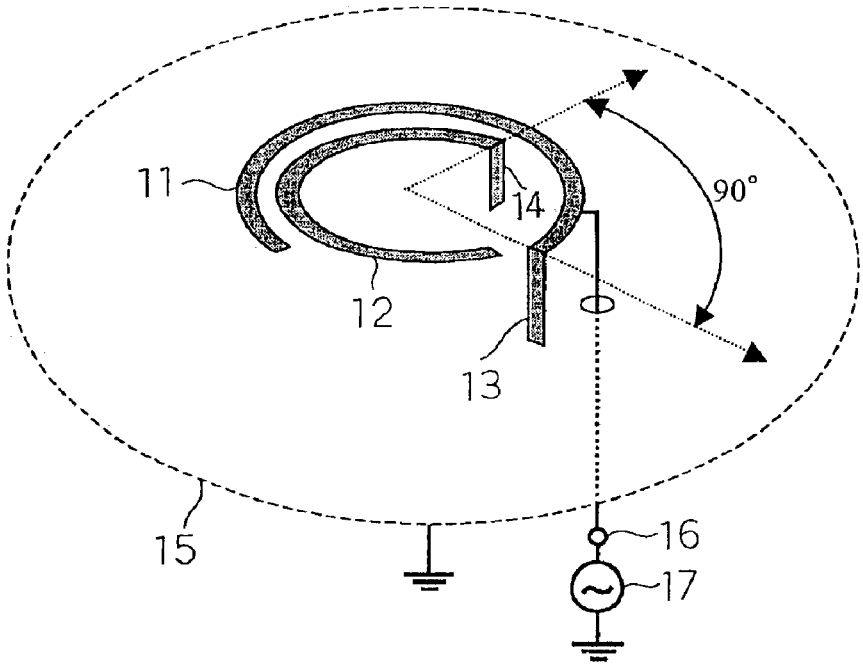
FIG. 5 is a perspective view of the 90-degree displaced double-spiral antenna device for left hand circular polarization which is fed from below the earth ground, according to the present invention.
Figure 6:
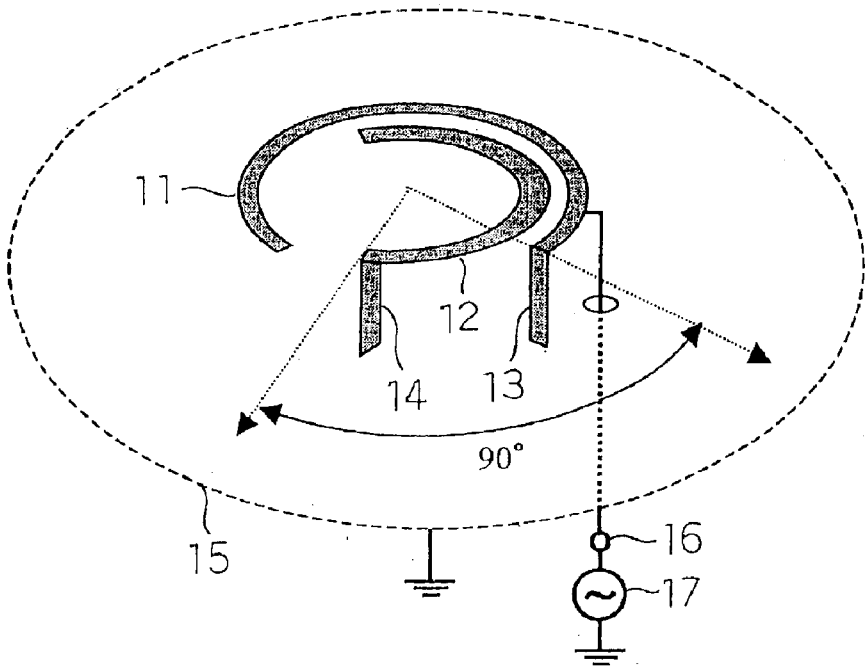
FIG. 6 is a perspective view of the 90-degree displaced double-spiral antenna device for right hand circular polarization which is fed from below the earth ground, according to the present invention.

Besides, in the embodiments described above, the power supplied according to the present invention is provided from above the earth ground of the present invention. However, the present invention is not limited to this, and the power supplied according to the present invention may be provided from below the earth ground of the present invention. For example, as shown in FIGS. 5 and 6, the power supplied from the feed terminal 16 may be provided from below the earth ground 15. Incidentally, FIG. 5 is a perspective view of the 90-degreed is placed double-spiral antenna device for left hand circular polarization which is fed from below the earth ground 15 while FIG. 6 is a perspective view of the 90-degree displaced double-spiral antenna device for right hand circular polarization which is fed from below the earth ground 15.

Also, in the embodiments described above, the power supplied according to the present invention is fed to the first element of the present invention. However, the present invention is not limited to this, and the power supplied according to the present invention may be fed to the second element of the present invention. In short, the power supplied according to the present invention may be fed to the first element of the present invention and/or second element of the present invention.

Also, the present invention may use any combination of the following factors freely as shown in FIGS. 7, 8, 11 to 16, and 21 to 32: (1) whether or not a suspended electrode is present, (2) whether or not a dielectric is inserted, (3) whether or not a neutral electrode is present, and (4) and whether to supply power from above the earth ground or from below the earth ground.

Figure 7:
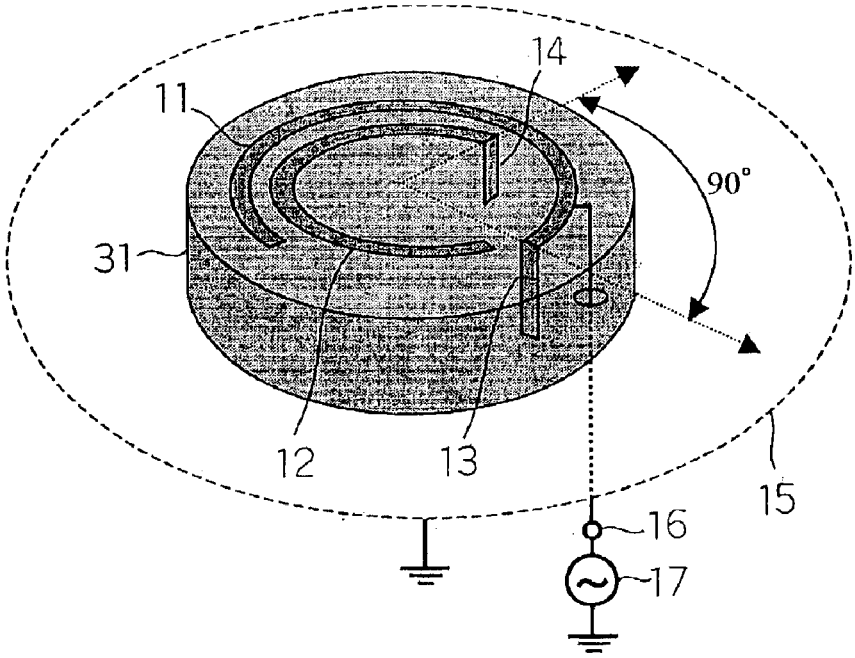
FIG. 7 is a perspective view of the 90-degree displaced double-spiral antenna device for left hand circular polarization without a suspended electrode, with a dielectric inserted between the radiating element and earth ground, without a neutral electrode, and with power supplied from below the earth ground, according to the present invention.
Figure 8:
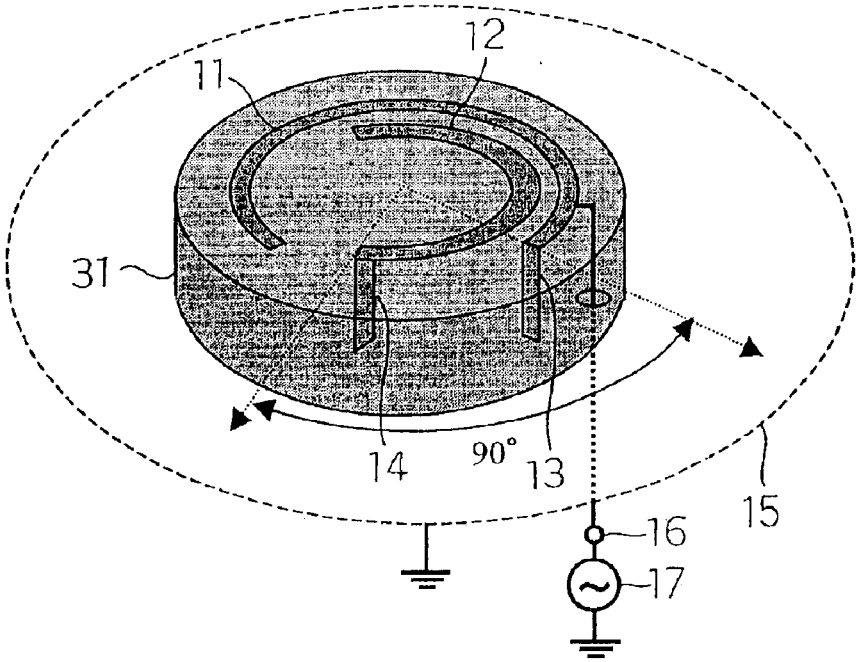
FIG. 8 is a perspective view of the 90-degree displaced double-spiral antenna device for right hand circular polarization without a suspended electrode, with a dielectric inserted between the radiating element and earth ground, without a neutral electrode, and with power supplied from below the earth ground, according to the present invention.
Figure 11:
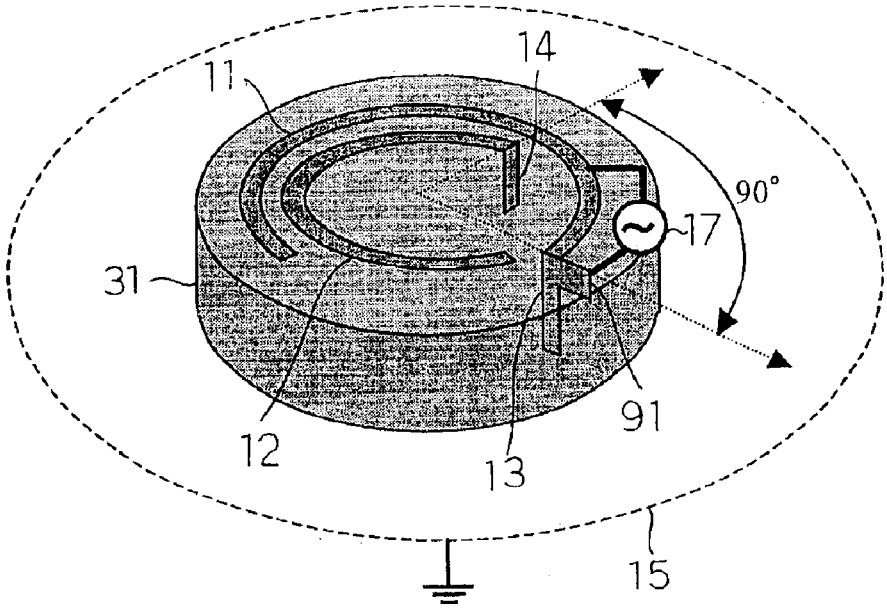
FIG. 11 is a perspective view of the 90-degree displaced double-spiral antenna device for left hand circular polarization without a suspended electrode, with a dielectric inserted between the radiating element and earth ground, with a neutral electrode, and with power supplied from above the earth ground, according to the present invention.
Figure 12:
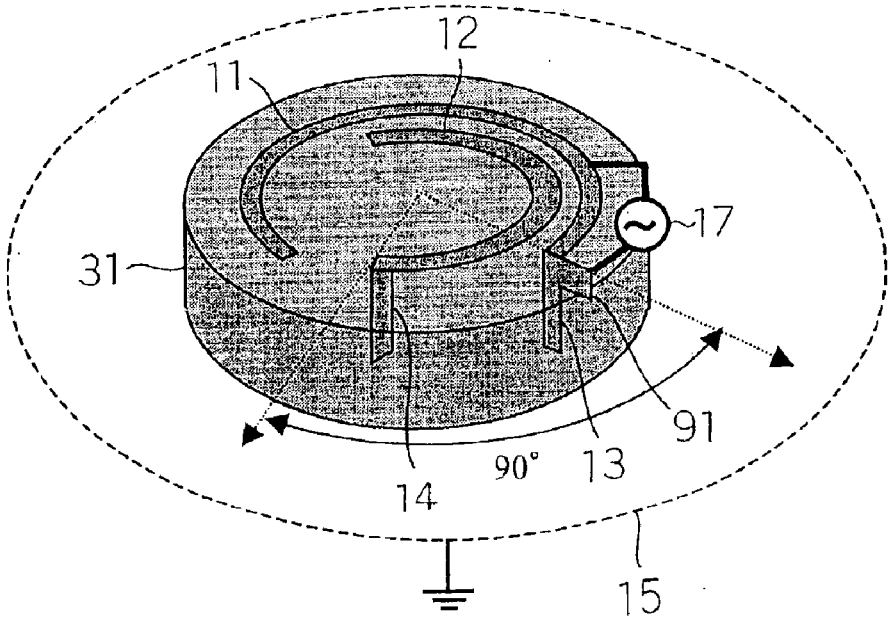
FIG. 12 is a perspective view of the 90-degree displaced double-spiral antenna device for right hand circular polarization without a suspended electrode, with a dielectric inserted between the radiating element and earth ground, with a neutral electrode, and with power supplied from above the earth ground, according to the present invention.
Figure 13:
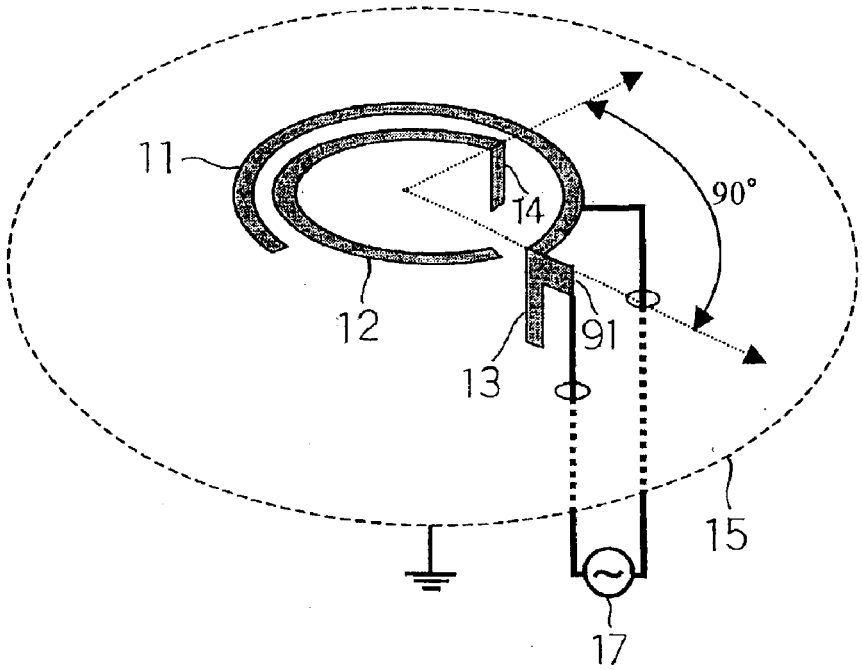
FIG. 13 is a perspective view of the 90-degree displaced double-spiral antenna device for left hand circular polarization without a suspended electrode, without a dielectric inserted between the radiating element and earth ground, with a neutral electrode, and with power supplied from below the earth ground, according to the present invention.
Figure 14:
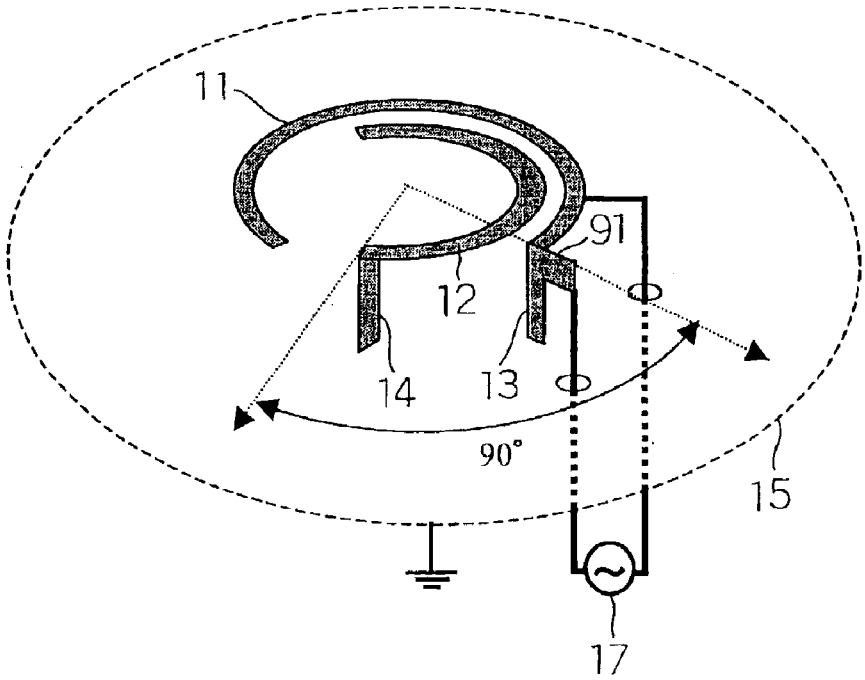
FIG. 14 is a perspective view of the 90-degree displaced double-spiral antenna device for right hand circular polarization without a suspended electrode, without a dielectric inserted between the radiating element and earth ground, with a neutral electrode, and with power supplied from below the earth ground, according to the present invention.
Figure 15:
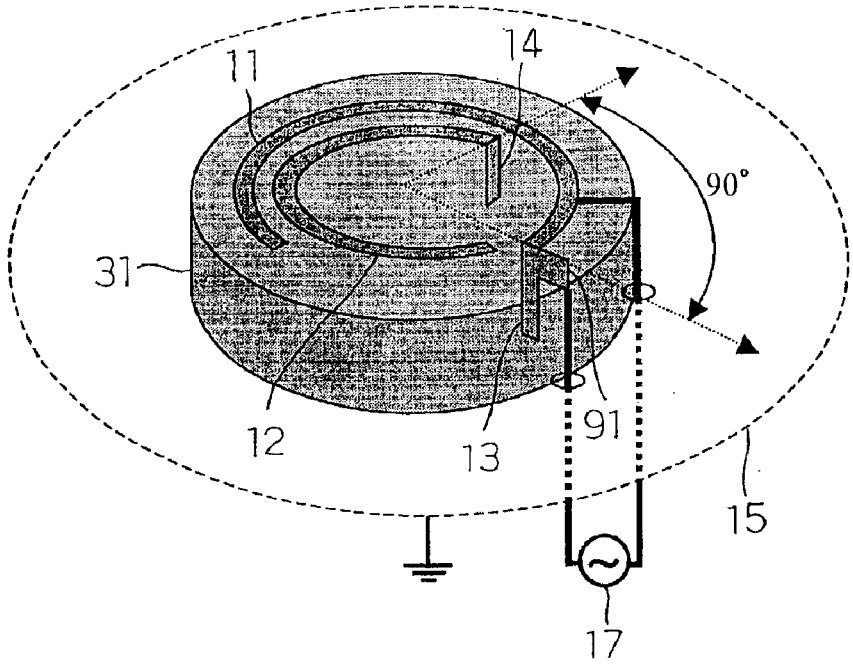
FIG. 15 is a perspective view of the 90-degree displaced double-spiral antenna device for left hand circular polarization without a suspended electrode, with a dielectric inserted between the radiating element and earth ground, with a neutral electrode, and with power supplied from below the earth ground, according to the present invention.
Figure 16:
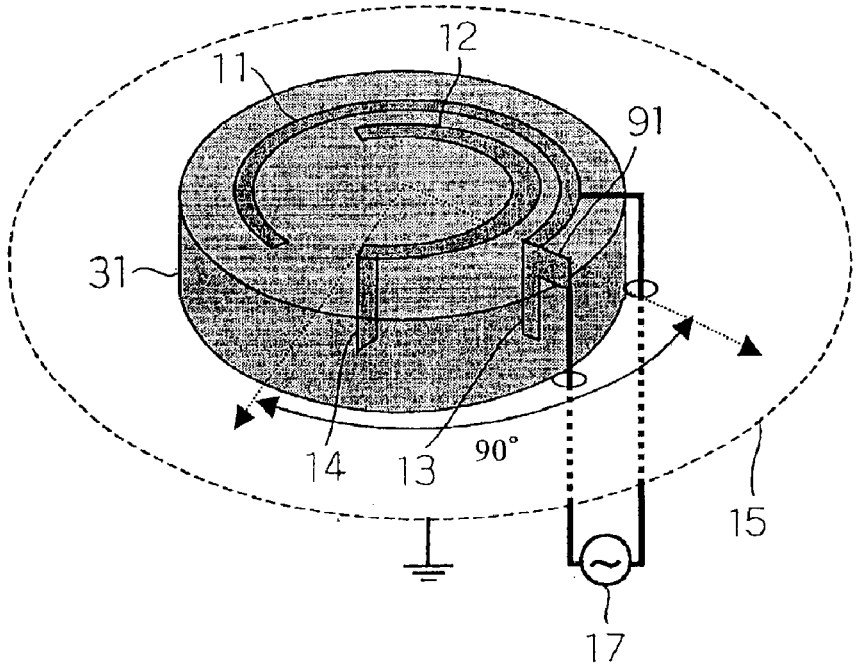
FIG. 16 is a perspective view of the 90-degree displaced double-spiral antenna device for right hand circular polarization without a suspended electrode, with a dielectric inserted between the radiating element and earth ground, with a neutral electrode, and with power supplied from below the earth ground, according to the present invention.

FIG. 7 is a perspective view of the 90-degree displaced double-spiral antenna device for left hand circular polarization without a suspended electrode, with the-dielectric 31 inserted between the radiating element 11 and earth ground 15, without a neutral electrode, and with power supplied from below the earth ground 15. FIG. 8 is a perspective view of the 90-degree displaced double-spiral antenna device for right hand circular polarization without a suspended electrode, with the dielectric 31 inserted between the radiating element 11 and earth ground 15, without a neutral electrode, and with power supplied from below the earth ground 15. FIG. 11 is a perspective view of the 90-degree displaced double-spiral antenna device for left hand circular polarization without a suspended electrode, with the dielectric 31 inserted between the radiating element 11 and earth ground 15, with the neutral electrode 91, and with power supplied from above the earth ground 15. FIG. 12 is a perspective view of the 90-degree displaced double-spiral antenna device for right hand circular polarization without a suspended electrode, with the dielectric 31 inserted between the radiating element 11 and earth ground 15, with the neutral electrode 91, and with power supplied from above the earth ground 15. FIG. 13 is a perspective view of the 90-degree displaced double-spiral antenna device for left hand circular polarization without a suspended electrode, without a dielectric inserted between the radiating element 11 and earth ground 15, with the neutral electrode 91, and with power supplied from below the earth ground 15. FIG. 14 is a perspective view of the 90-degree displaced double-spiral antenna device for right hand circular polarization without a suspended electrode, without a dielectric inserted between the radiating element 11 and earth ground 15, with the neutral electrode 91, and with power supplied from below the earth ground 15. FIG. 15 is a perspective view of the 90-degree displaced double-spiral antenna device for left hand circular polarization without a suspended electrode, with the dielectric 31 inserted between the radiating element 11 and earth ground 15, with the neutral electrode 91, and with power supplied from below the earth ground 15. FIG. 16 is a perspective view of the 90-degree displaced double-spiral antenna device for right hand circular polarization without a suspended electrode, with the dielectric 31 inserted between the radiating element 11 and earth ground 15, with the neutral electrode 91, and with power supplied from below the earth ground 15.

Figure 21:
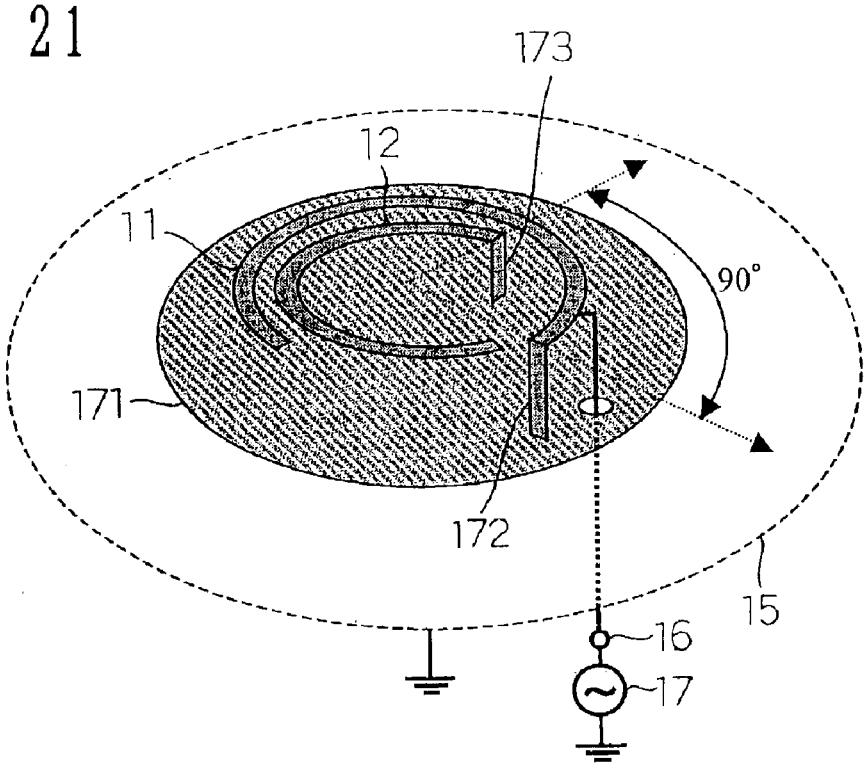
FIG. 21 is a perspective view of the 90-degree displaced double-spiral antenna device for left hand circular polarization with a suspended electrode, without a dielectric inserted between the radiating element and suspended electrode, without a neutral electrode, and with power supplied from below the earth ground, according to the present invention.
Figure 22:
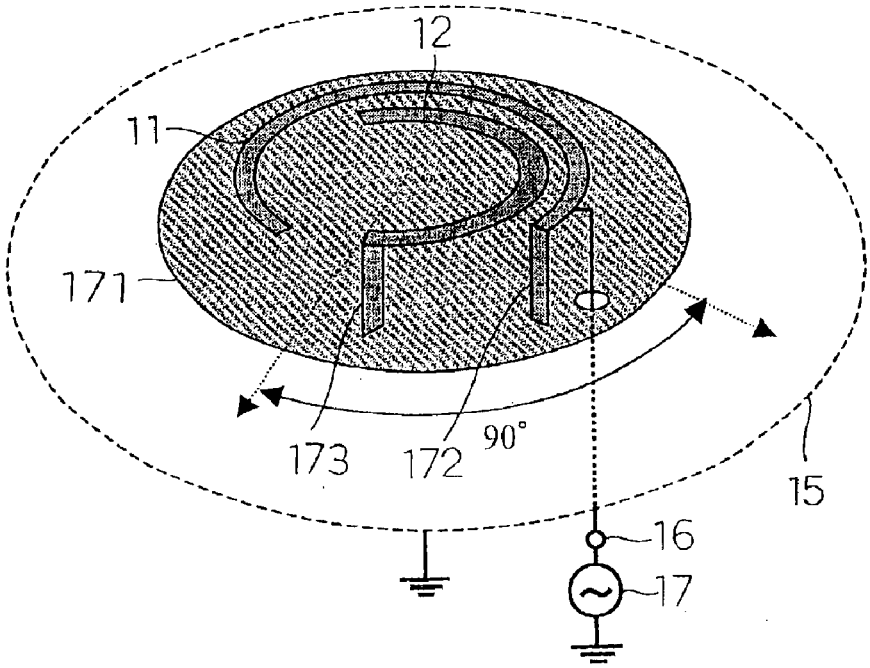
FIG. 22 is a perspective view of the 90-degree displaced double-spiral antenna device for right hand circular polarization with a suspended electrode, without a dielectric inserted between the radiating element and suspended electrode, without a neutral electrode, and with power supplied from below the earth ground, according to the present invention.
Figure 23:
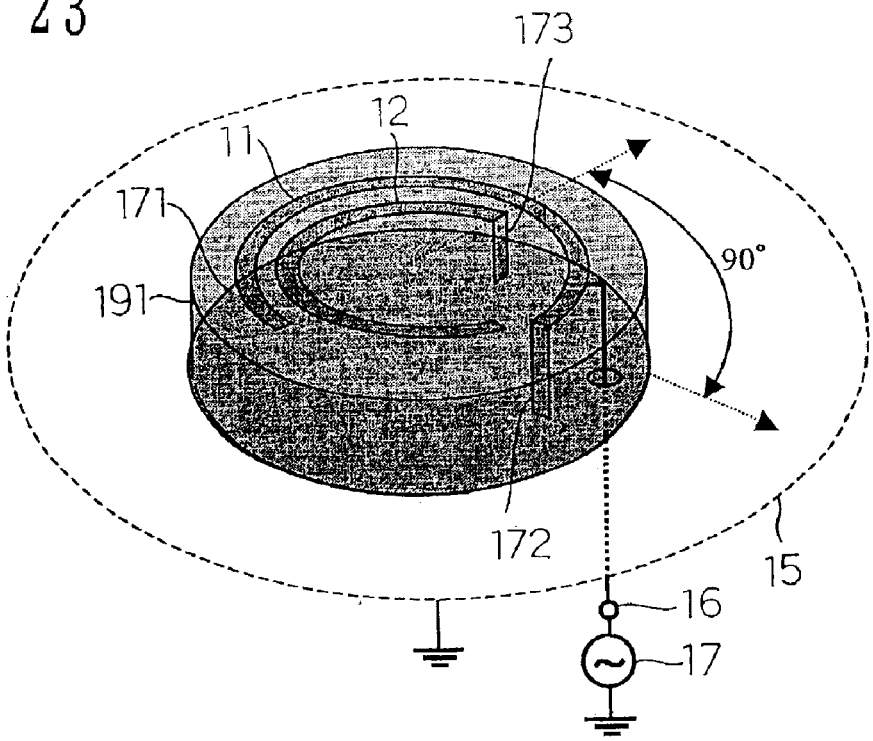
FIG. 23 is a perspective view of the 90-degree displaced double-spiral antenna device for left hand circular polarization with a suspended electrode, with a dielectric inserted between the radiating element and suspended electrode, without a neutral electrode, and with power supplied from below the earth ground, according to the present invention.
Figure 24:
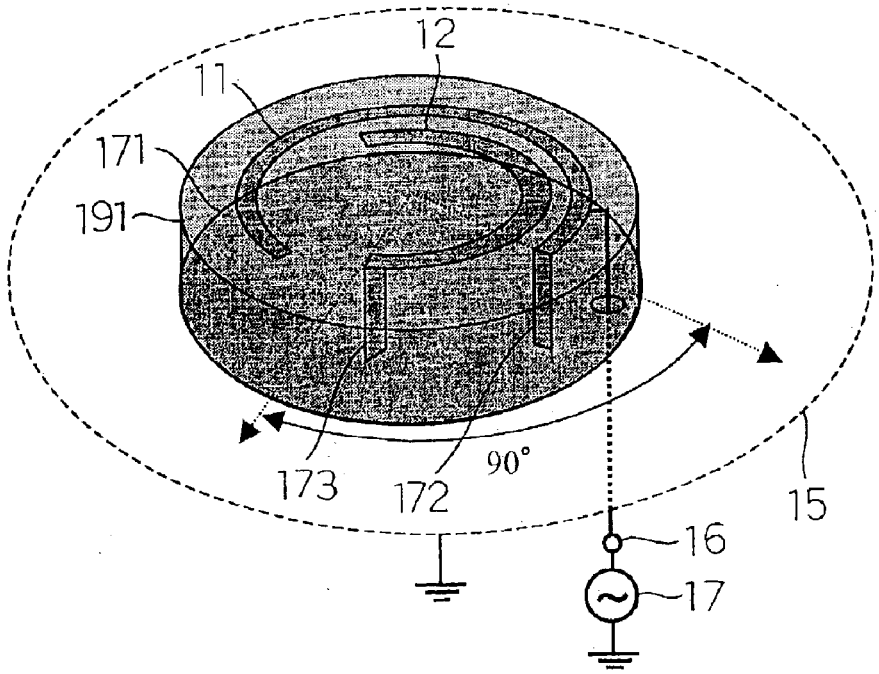
FIG. 24 is a perspective view of the 90-degree displaced double-spiral antenna device for right hand circular polarization with a suspended electrode, with a dielectric inserted between the radiating element and suspended electrode, without a neutral electrode, and with power supplied from below the earth ground, according to the present invention.
Figure 25:
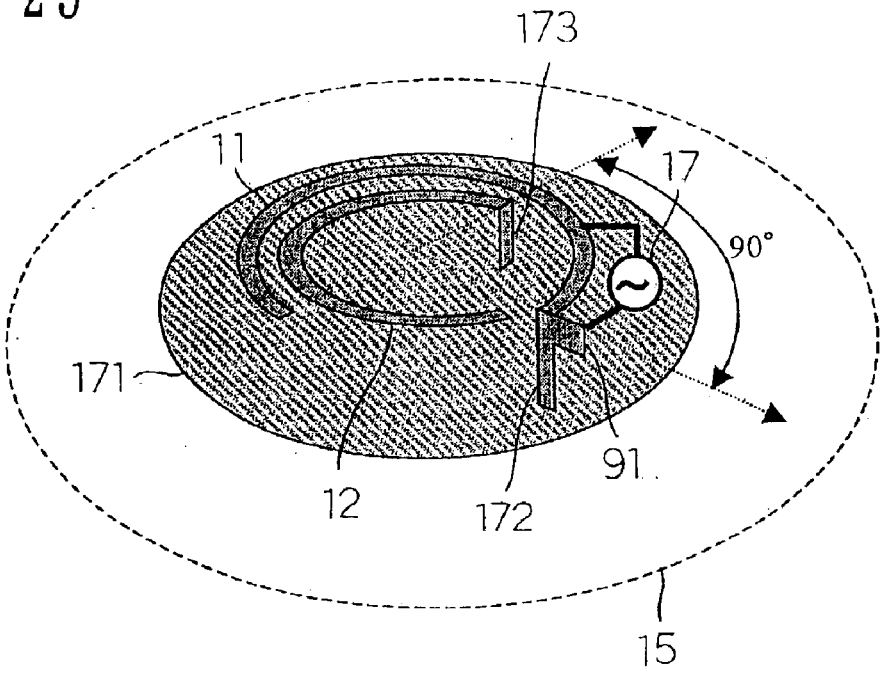
FIG. 25 is a perspective view of the 90-degree displaced double-spiral antenna device for left hand circular polarization with a suspended electrode, without a dielectric inserted between the radiating element and suspended electrode, with a neutral electrode, and with power supplied from above the earth ground, according to the present invention.
Figure 26:
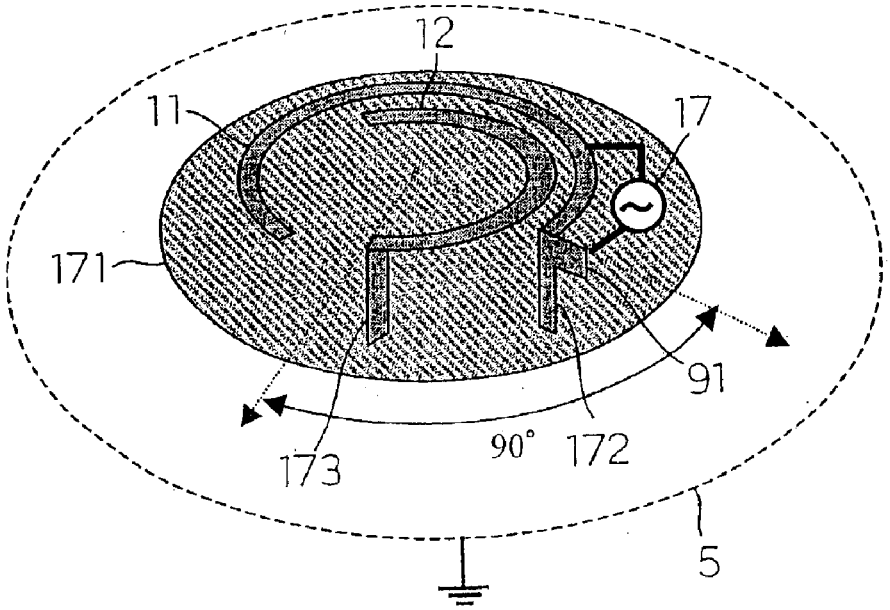
FIG. 26 is a perspective view of the 90-degree displaced double-spiral antenna device for right hand circular polarization with a suspended electrode, without a dielectric inserted between the radiating element and suspended electrode, with a neutral electrode, and with power supplied from above the earth ground, according to the present invention.
Figure 27:
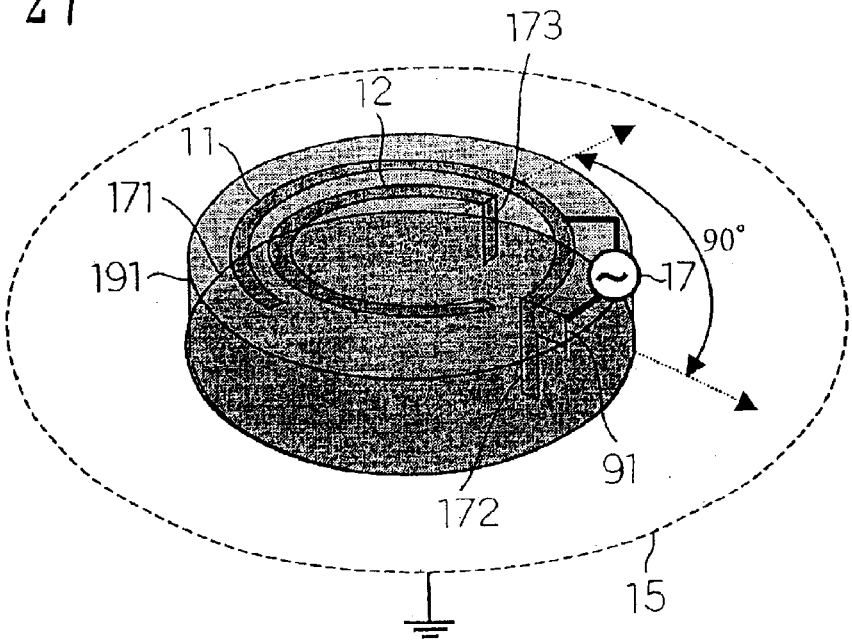
FIG. 27 is a perspective view of the 90-degree displaced double-spiral antenna device for left hand circular polarization with a suspended electrode, with a dielectric inserted between the radiating element and suspended electrode, with a neutral electrode, and with power supplied from above the earth ground, according to the present invention.
Figure 28:
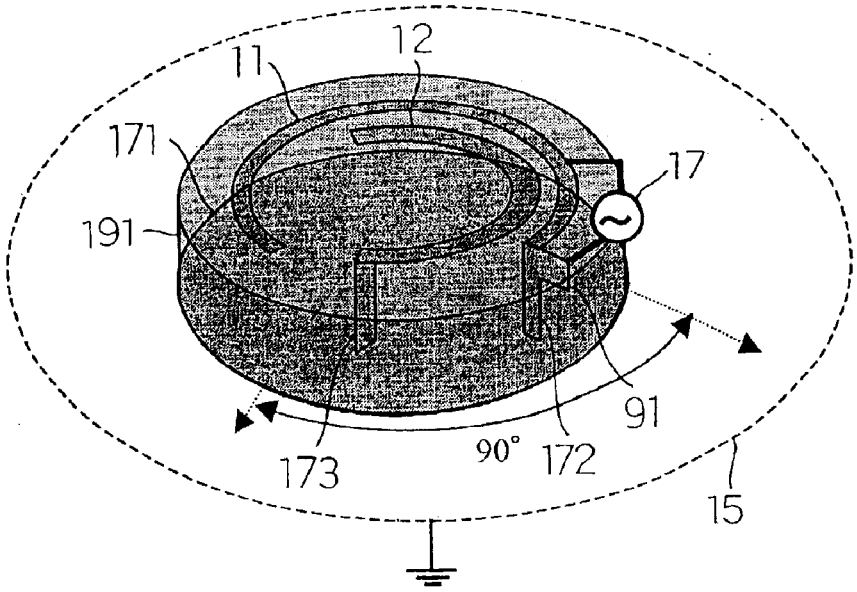
FIG. 28 is a perspective view of the 90-degree displaced double-spiral antenna device for right hand circular polarization with a suspended electrode, with a dielectric inserted between the radiating element and suspended electrode, with a neutral electrode, and with power supplied from above the earth ground, according to the present invention.
Figure 29:
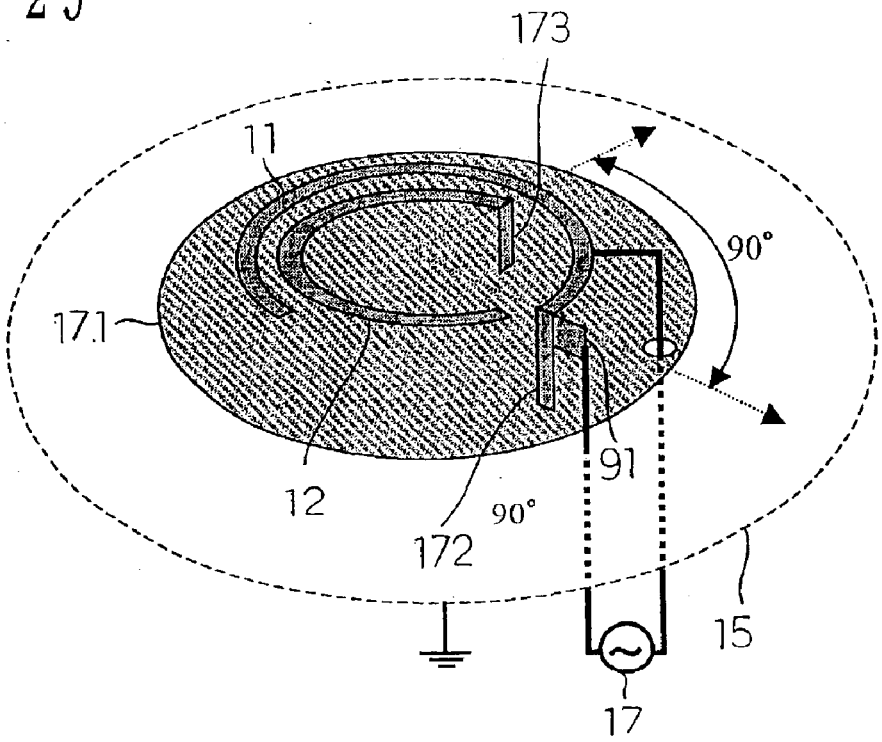
FIG. 29 is a perspective view of the 90-degree displaced double-spiral antenna device for left hand circular polarization with a suspended electrode, without a dielectric inserted between the radiating element and suspended electrode, with a neutral electrode, and with power supplied from below the earth ground, according to the present invention.
Figure 30:
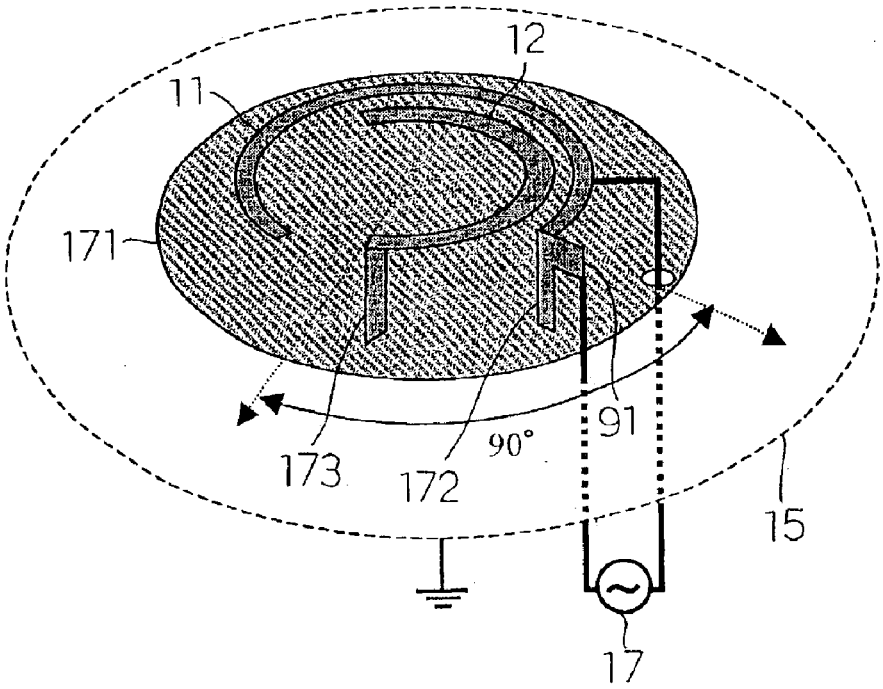
FIG. 30 is a perspective-view of the 90-degree displaced double-spiral antenna device for right hand circular polarization with a suspended electrode, without a dielectric inserted between the radiating element and suspended electrode, with a neutral electrode, and with power supplied from below the earth ground, according to the present invention.
Figure 31:
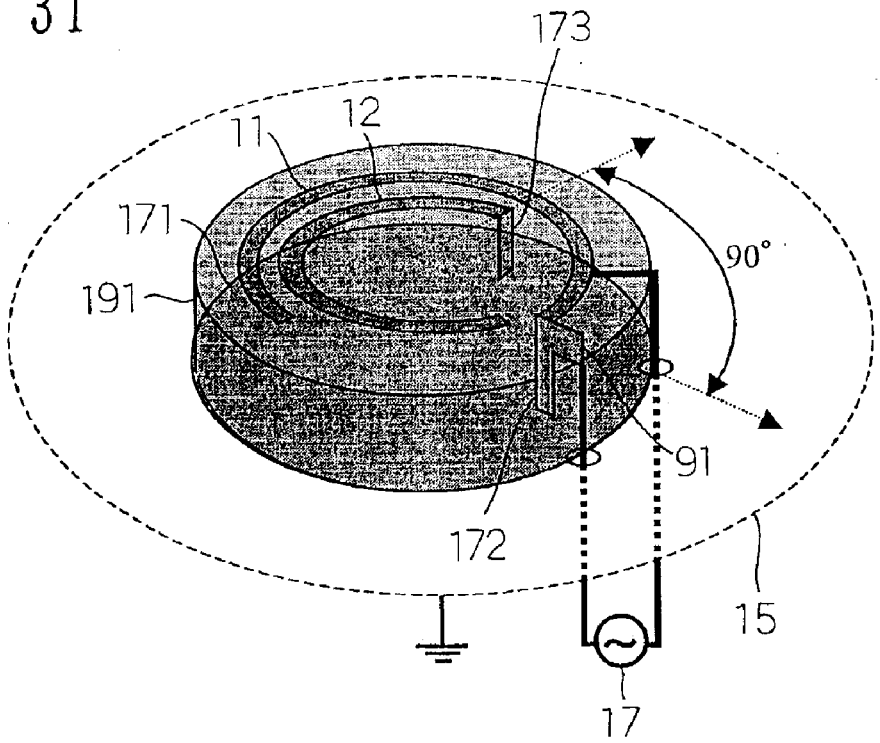
FIG. 31 is a perspective view of the 90-degree displaced double-spiral antenna device for left hand circular polarization with a suspended electrode, with a dielectric inserted between the radiating element and suspended electrode, with a neutral electrode, and with power supplied from below the earth ground, according to the present invention.
Figure 32:
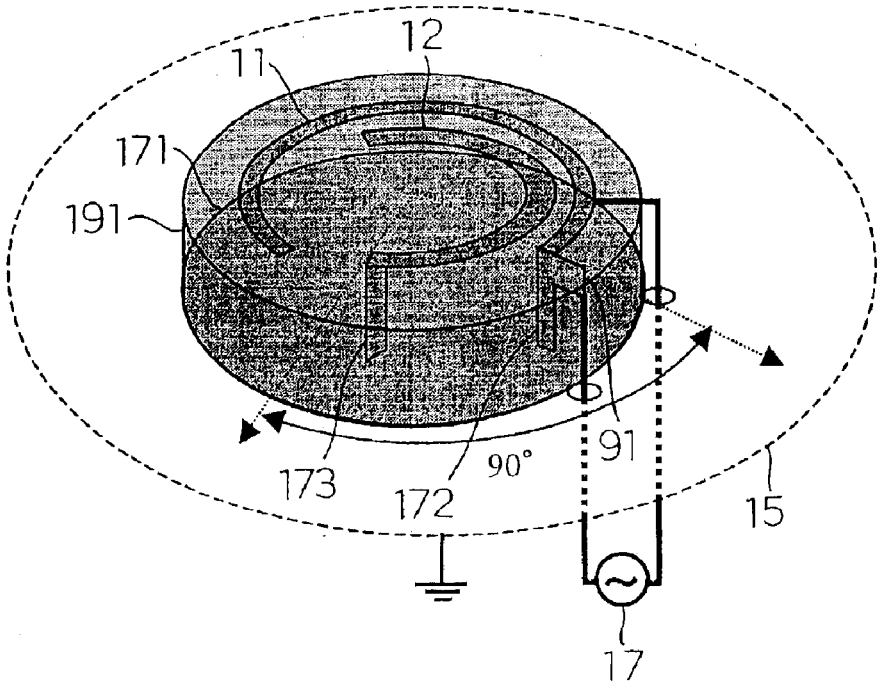
FIG. 32 is a perspective view of the 90-degree displaced double-spiral antenna device for right hand circular polarization with a suspended electrode, with a dielectric inserted between the radiating element and suspended electrode, with a neutral electrode, and with power supplied from below the earth ground, according to the present invention.

FIG. 21 is a perspective view of the 90-degree displaced double-spiral antenna device for left hand circular polarization with the suspended electrode 171, without a dielectric inserted between the radiating element 11 and suspended electrode 171, without a neutral electrode, and with power supplied from below the earth ground 15. FIG. 22 is a perspective view of the 90-degree displaced double-spiral antenna device for right hand circular polarization with the suspended electrode 171, without a dielectric inserted between the radiating element 11 and suspended electrode 171, without a neutral electrode, and with power supplied from below the earth ground 15. FIG. 23 is a perspective view of the 90-degree displaced double-spiral antenna device for left hand circular polarization with the suspended electrode 171, with the dielectric 191 inserted between the radiating element 11 and suspended electrode 171, without a neutral electrode, and with power supplied from below the earth ground 15. FIG. 24 is a perspective view of the 90-degree displaced double-spiral antenna device for right hand circular polarization with the suspended electrode 171, with the dielectric 191 inserted between the radiating element 11 and suspended electrode 171, without a neutral electrode, and with power supplied from below the earth ground 15. FIG. 25 is a perspective view of the 90-degree displaced double-spiral antenna device for left hand circular polarization with the suspended electrode 171, without a dielectric inserted between the radiating element 11 and suspended electrode 171, with the neutral electrode 91, and with power supplied from above the earth ground 15. FIG. 26 is a perspective view of the 90-degree displaced double-spiral antenna device for right hand circular polarization with the suspended electrode 171, without a dielectric inserted between the radiating element 11 and suspended electrode 171, with the neutral electrode 91, and with power supplied from above the earth ground 15. FIG. 27 is a perspective view of the 90-degree displaced double-spiral antenna device for left hand circular polarization with the suspended electrode 171, with the dielectric 191 inserted between the radiating element 11 and suspended electrode 171, with the neutral electrode 91, and with power supplied from above the earth ground 15. FIG. 28 is a perspective view of the 90-degree displaced double-spiral antenna device for right hand circular polarization with the suspended electrode 171, with the dielectric 191 inserted between the radiating element 11 and suspended electrode 171, with the neutral electrode 91, and with power supplied from above the earth ground 15. FIG. 29 is a perspective view of the 90-degree displaced double-spiral antenna device for left hand circular polarization with the suspended electrode 171, without a dielectric inserted between the radiating element 11 and suspended electrode 171, with the neutral electrode 91, and with power supplied from below the earth ground 15. FIG. 30 is a perspective view of the 90-degree displaced double-spiral antenna device for right hand circular polarization with the suspended electrode 171, without a dielectric inserted between the radiating element 11 and suspended electrode 171, with the neutral electrode 91, and with power supplied from below the earth ground 15. FIG. 31 is a perspective view of the 90-degree displaced double-spiral antenna device for left hand circular polarization with the suspended electrode 171, with the dielectric 191 inserted between the radiating element 11 and suspended electrode 171, with the neutral electrode 91, and with power supplied from below the earth ground 15. FIG. 32 is a perspective view of the 90-degree displaced double-spiral antenna device for right hand circular polarization with the suspended electrode 171, with the dielectric 191 inserted between the radiating element 11 and suspended electrode 171, with the neutral electrode 91, and with power supplied from below the earth ground 15.

Figure 43:
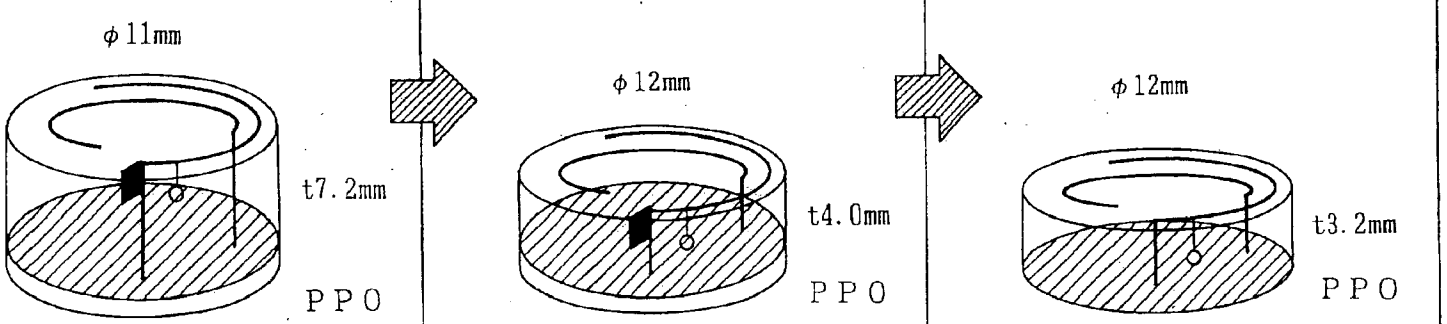
FIG. 43 is an explanatory diagram illustrating relationships between size reductions and gain characteristics of the double spiral in the antenna device of the present invention when PPO (polyphenylene oxide) is used as a dielectric.

As shown in FIG. 43, which is an explanatory diagram illustrating relationships between size reductions and gain characteristics of the double spiral in the antenna device of the present invention when PPO (polyphenylene oxide) is used as a dielectric, an attempt to keep down the size and volume of an antenna device by reducing its diameter (outside diameter) $\phi$ and thickness t will inevitably result in reduction of average gains in both the H (horizontal) plane and V (vertical) plane, but gain reduction caused by reduced thickness due to elimination of a spacer (suspended electrode) is considerably smaller than gain reduction caused by reduction in the thickness of an electric-field generating part.

Also, as shown in FIG. 44, which is an explanatory diagram illustrating relationships between the winding directions and gain characteristics of the double spiral for right hand circular polarization in the antenna device of the present invention, generally the elements must be elongated when high gain characteristics are required, but an antenna device has high average gains in the case of clockwise/counterclockwise winding ((D) and (E) in FIG. 44) in which the two elements differ in their curving direction.

However, as shown in FIG. 45, which is an explanatory diagram illustrating gain characteristics of the antenna device according to the present invention (the horizontal polarization gain in the V plane (top right) and vertical polarization gain in the V plane (bottom right) were obtained by analysis of a right hand circular polarization gain in the V plane (bottom left)), even in the case of clockwise/counterclockwise winding in which the two elements differ in their curving direction, if the connecting electrodes are displaced 90 degrees with respect to each other in the plane which includes the curved shapes ((D) +90-degree displacement in FIG. 44) the horizontal polarization gain in the V plane is more or less reduced. In the case of 0-degree displacement ((E) in FIG. 44) in which the two elements differ in their curving direction, that is clockwise and counterclockwise and the connecting electrodes adjoin each other in the plane which includes the curved shapes, the horizontal polarization gain in the V plane is improved in particular, resulting in the best average gain.

Also, in this embodiment, the first element according to the present invention is located on the outer side of the second element according to the present invention when viewed from the virtual center of the bent or curved shapes. However, this is not restrictive, and the first element according to the present invention may be located on the inner side of the second element according to the present invention when viewed from the virtual center of the bent or curved shapes. In short, the first and second elements according to the present invention may assume any position in relation to each other.

Figure 41:
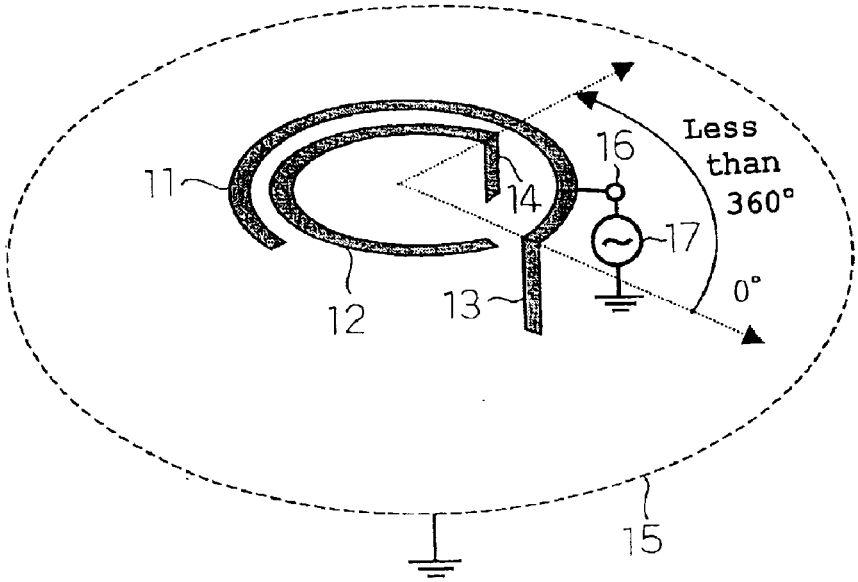
FIG. 41 is a perspective view of a 90-degree displaced double-spiral antenna device for left hand circular polarization in which first and second connecting electrodes are separated by 0 to 360 degrees as viewed from the virtual center of the spiral shape, according to the present invention.
Figure 42:
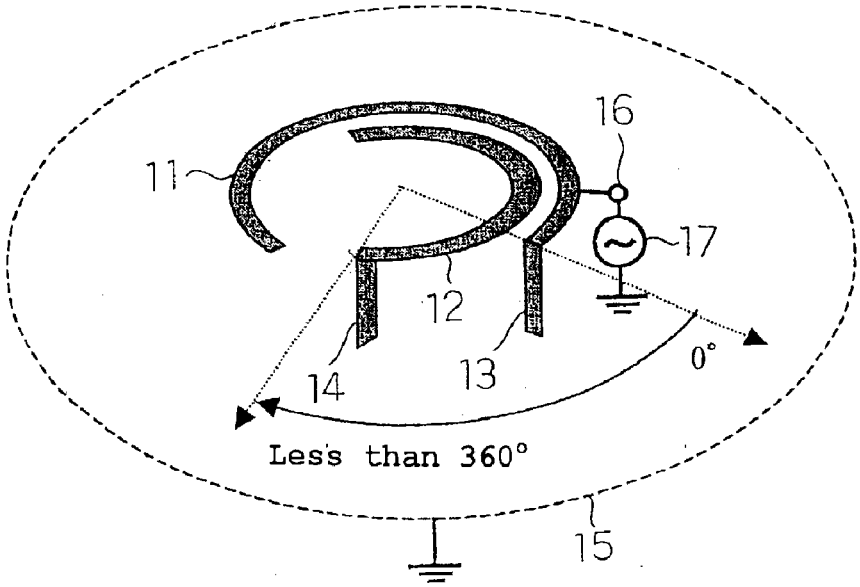
FIG. 42 is a perspective view of a 90-degree displaced double-spiral antenna device for right hand circular polarization in which first and second connecting electrodes are separated by 0 to 360 degrees as viewed from the virtual center of the spiral shape, according to the present invention.

Also, "being displaced with respect to each other in the plane which includes the bent or curved shapes" according to the present invention means in the above embodiments that the first and second connecting electrodes are displaced with respect to each other by virtually 90 degrees when viewed from the virtual center of the bent or curved shapes. However, this is not restrictive, and "being displaced with respect to each other in the plane which includes the bent or curved shapes" according to the present invention may mean that the first and second connecting electrodes are displaced with respect to each other by any angle between 0 and 360 degrees when viewed from the virtual center of the spiral shape, for example, as shown in FIGS. 41 and 42. Incidentally, FIG. 41 is a perspective view of a 90-degree displaced double-spiral antenna device for left hand circular polarization in which the first and second connecting electrodes 13 and 14 are separated by 0 to 360 degrees as viewed from the virtual center of the spiral shape while FIG. 42 is a perspective view of a 90-degree displaced double spiral antenna device for right hand circular polarization in which the first and second connecting electrodes 13 and 14 are separated by 0 to 360 degrees as viewed from the virtual center of the spiral shape. However, omnidirectional characteristics and high gain characteristics are most prominent when the angle described above is virtually 90 degrees, making the directional characteristics of the two elements cross each other at right angles as described above.

Besides, the present invention also includes a communications system which comprises the antenna device of the present invention, a transmission processing circuit that processes signals sent from the antenna device, and a reception processing circuit that processes signals received by the antenna device.

The communications system of the present invention also comprises a communications earth ground for use in communications. The earth ground of the present invention and the communications earth ground of the present invention may be connected to a ground plane in close vicinity to each other. The antenna device and the main unit of the communications system may be installed on opposite sides of the above-mentioned ground plane to which the earth ground and communications earth ground are connected in close vicinity to each other.

Industrial Applicability

As can be seen from the above description, the present invention has the advantage of being able to provide an antenna device and communications system, for example, with improved directivity, efficiency, etc.

What is claimed is:

1. An antenna device comprising:

a first element which is provided with a feeding point for drawing power and has a bent or curved shape;

a second element which is installed side by side with said first element and has a bent or curved shape;

an earth ground disposed in opposing relation to said first element and said second element;

a first connecting electrode for connecting one end of said first element to said earth ground; and a second connecting electrode for connecting one end of said second element to said earth ground, wherein said first and second connecting electrodes are displaced with respect to each other in the plane which includes said bent or curved shapes; and said first and second connecting electrodes are displaced with respect to each other by virtually 90 degrees when viewed from virtual center of said bent or curved shapes.

2. The antenna device according to claim 1, wherein a dielectric is inserted between said first element and said earth ground.

3. The antenna device according to claim 1, wherein said first element is provided with a neutral electrode for drawing power.

4. The antenna device according to claim 1, wherein said power is supplied from above or below said earth ground.

5. The antenna device according to claim 1, wherein said first element is located on the outer or inner side of said second element when viewed from the virtual center of said bent or curved shapes.

6. The antenna device according to claim 1, wherein said first and second elements differ from each other in the curving or bending direction.

7. An antenna device comprising:

a first element which is provided with a feeding point for drawing power and has a bent or curved shape;

a second element which is installed side by side with said first element and has a bent or curved shape;

a suspended electrode disposed in opposing relation to said first element and said second element;

an earth ground disposed in opposing relation to said suspended electrode, being located across said suspended electrode from said first element and said second element;

a first connecting electrode for connecting one end of said first element to said suspended electrode; and a second connecting electrode for connecting one end of said second element to said suspended electrode, and wherein said first and second connecting electrodes are displaced with respect to each other in the plane which includes said bent or curved shapes.

8. The antenna device according to claim 7, wherein the fact that "being displaced with respect to each other in the plane which includes said bent or curved shapes" means that said first and second connecting electrodes are displaced with respect to each other by virtually 90 degrees when viewed from the virtual center of said bent or curved shapes.

9. The antenna device according to claim 7 or 8, wherein a dielectric is inserted between said first element and said suspended electrode.

10. The antenna device according to any one of claim 7 or 8, wherein said first element is provided with a neutral electrode for drawing power.

11. The antenna device according to any one of claim 7 or 8, wherein said power is supplied from above or below said earth ground.

12. The antenna device according to any one of claim 7 or 8, wherein said first element is located on the outer or inner side of said second element when viewed from the virtual center of said bent or curved shapes.

13. The antenna device according to any one of claim 7 or 8, wherein a dielectric is inserted between said suspended electrode and said earth ground.

14. An antenna device comprising:

a first element which is provided with a feeding point for drawing power and has a bent or curved shape;

a second element which is installed side by side with said first element and has a bent or curved shape;

an earth ground disposed in opposing relation to said first element and said second element;

a first connecting electrode for connecting one end of said first element to said earth ground; and a second connecting electrode for connecting one end of said second element to said earth ground, and wherein said first and second connecting electrodes adjoin each other in the plane which includes said bent or curved shapes; and said first and second elements differ in their bending or curving direction, one being clockwise and the other being counterclockwise.

15. An antenna device comprising:

a magnetic-current-mode element and an electric-current-mode element which share a feeding point;

wherein said magnetic-current-mode element comprises a first element which has a bent or curved shape, a second element which is installed side by side with said first element and has a bent or curved shape, an earth ground disposed in opposing relation to said first element and said second element, a first connecting electrode for connecting one end of said first element to said earth ground, and a second connecting electrode for connecting one end of said second element to said earth ground;

said electric-current-mode element comprises a third element disposed above the earth around and connected to said first element; and power is supplied between said first element and said third element.

16. The antenna device according to claim 15, wherein the plane where current flows in said magnetic-current-mode element and the plane where current flows in said electric-current-mode element are virtually identical or parallel.

17. An antenna device comprising: a magnetic-current-mode element and an electric-current-mode element which share a feeding point;

wherein said magnetic-current-mode element comprises a first element which has a bent or curved shape, a second element which is installed side by side with said first element and has a bent or curved shape, an earth ground disposed in opposing relation to said first element and said second element, a first connecting electrode for connecting one end of said first element to said earth around, and a second connecting electrode for connecting one end of said second element to said earth ground;

said electric-current-mode element comprises a third element disposed above the earth ground and connected to said first element;

power is supplied between said first element and said third element, and said electric-current-mode element further comprises a fourth element connected to said second element.

18. The antenna device according to claim 17, wherein said third element and said fourth element are virtually orthogonal to each other.

19. The antenna device according to claim 17 or 18, wherein said third element and/or said fourth element are not disposed in opposing relation to said earth ground and are located on the outer side of said first element and said second element.

20. The antenna device according to claim 17 or 18, wherein said third element and/or said fourth element have a straight linear shape.

21. The antenna device according to claim 17 or 18, wherein said third element and/or said fourth element have a bent or curved shape.

22. The antenna device according to claim 21, wherein said first to fourth elements are bent or curved in the same direction or in different directions.

23. An antenna device comprising: a magnetic-current-mode element and an electric-current-mode element which share a feeding point;

wherein said magnetic-current-mode element comprises a first element which has a bent or curved shape, a second element which is installed side by side with said first element and has a bent or curved shape, an earth around disposed in opposing relation to said first element and said second element, a first connecting electrode for connecting one end of said first element to said earth ground, and a second connecting electrode for connecting one end of said second element to said earth ground;

said electric-current-mode element comprises a third element disposed above the earth ground and connected to said first element, and a fourth element connected to the second element;

power is supplied between said first element and said third element;

power is also supplied to said second element or said fourth element; and the power supply to said first element or said third element and the power supply to said second element or said fourth element are virtually 90 degrees apart in phase.

24. A communications system comprising:

an antenna device according to any one of claim 1, 7, 8, 6, 14, 16, 15, 17, 18 or 23;

a transmission processing circuit which processes signals sent from said antenna device; and a reception processing circuit which processes signals received by said antenna device.

25. The communications system according to claim 24, wherein:

said communications system comprises a communications earth ground for use in communications; and said earth ground and said communications earth ground are connected in close vicinity to each other.

26. The communications system according to claim 25, wherein said antenna device and the main unit of said communications system are installed on opposite sides of the ground plane to which said earth ground and said communications earth ground are connected in close vicinity to each other.

* * * * *

UNITED STATES PATENT AND TRADEMARK OFFICE

CERTIFICATE OF CORRECTION

PATENT NO. : 6,859,174 B2
DATED : February 22, 2005
INVENTOR(S) : Joji Kane et al.

It is certified that error appears in the above-identified patent and that said Letters Patent is hereby corrected as shown below:

Column 23,
Line 18, after "from", insert -- a --.
Lines 62 and 65, "claim" should read -- claims --.

Column 24,
Lines 1 and 5, "claim" should read -- claims --.
Line 40, "around" should read -- ground --.

Column 25,
Line 24, "around" should read -- ground --.

Signed and Sealed this

Nineteenth Day of July, 2005

JON W. DUDAS
*Director of the United States Patent and Trademark Office*